US010017282B2

(12) United States Patent
Yohe et al.

(10) Patent No.: US 10,017,282 B2
(45) Date of Patent: Jul. 10, 2018

(54) APPARATUS AND METHOD OF FORMING A SHIPPING UNIT FROM A PLURALITY OF BOXES CONTAINING COMPONENTS

(71) Applicant: DYCO INC., Bloomsburg, PA (US)

(72) Inventors: Peter D. Yohe, Bloomsburg, PA (US); Ronald H. Cordingly, Berwick, PA (US); Kevin K. John, Bloomsburg, PA (US); Justin L. Mowery, Bloomsburg, PA (US); Thomas M. Zurewich, Orangeville, PA (US); Joshua Jay Gordon, Bloomsburg, PA (US)

(73) Assignee: Dyco Inc., Bloomsburg, PA (US)

( * ) Notice: Subject to any disclaimer, the term of this patent is extended or adjusted under 35 U.S.C. 154(b) by 841 days.

(21) Appl. No.: 14/571,635

(22) Filed: Dec. 16, 2014

(65) Prior Publication Data

US 2015/0175283 A1 Jun. 25, 2015

Related U.S. Application Data

(60) Provisional application No. 61/920,620, filed on Dec. 24, 2013.

(51) Int. Cl.

| | |
|---|---|
| ***B65B 7/20*** | (2006.01) |
| ***B65B 13/02*** | (2006.01) |
| ***B65B 13/20*** | (2006.01) |
| ***B65G 57/30*** | (2006.01) |
| ***B65B 35/50*** | (2006.01) |
| ***B65D 21/02*** | (2006.01) |
| ***B65D 77/04*** | (2006.01) |

(52) U.S. Cl.

CPC ..... *B65B 7/20* (2013.01); *B65B 13/02* (2013.01); *B65B 13/20* (2013.01); *B65B 35/50* (2013.01); *B65D 21/0201* (2013.01); *B65D 21/0209* (2013.01); *B65D 77/0426* (2013.01); *B65D 2577/043* (2013.01)

(58) Field of Classification Search

None

See application file for complete search history.

(56) References Cited

U.S. PATENT DOCUMENTS 5,029,710 A * 7/1991 Workman ..... B65D 5/001 206/503

5,412,923 A * 5/1995 Lashyro ..... B65B 9/13 53/397

* cited by examiner

*Primary Examiner* — Hemant M Desai

*Assistant Examiner* — Tanzim Imam

(74) *Attorney, Agent, or Firm* — McNees Wallace & Nurick LLC

(57) ABSTRACT

An apparatus and method of arranging boxes containing components for transport (shipping units).

16 Claims, 88 Drawing Sheets

APPARATUS AND METHOD OF FORMING A SHIPPING UNIT FROM A PLURALITY OF BOXES CONTAINING COMPONENTS

FIELD OF THE INVENTION

The present invention generally relates to boxes containing components, and more particularly, to an apparatus and method of forming shipping units of boxes suitable for transport.

BACKGROUND

In the manufacture, filling, packaging and sales of articles, such as blow-molded articles filled with products, it is desirable to achieve multiple-uses from the boxes used to secure and protect the articles. For example, the newly manufactured empty articles can be positioned in boxes and transported to another location for filling the articles with product. Once the articles are filled with product, the filled articles can then be replaced in the boxes and delivered to a retail location in which consumers can remove the filled article from the boxes for purchase.

There are challenges with arranging the boxes in a stable, compact, consolidated form that permits the boxes to be easily loaded onto a transport vehicle, such as a tractor trailer. In some instances, manual labor has been used to perform this task, which is repetitive, cumbersome and inefficient.

Accordingly, there is a need for an apparatus and method of arranging boxes containing articles suitable for transportation.

SUMMARY OF THE INVENTION

In an exemplary embodiment, a method for forming a shipping unit includes a plurality of boxes containing components including providing a plurality of boxes closed at a first end and open at a second end, forming partially closed boxes for receiving components therein. The method further includes inwardly folding a pair of opposed flaps at the second end of the partially closed boxes, forming partially folded boxes. The method further includes arranging a first non-inverted row of partially folded boxes and inwardly folding the pair of remaining opposed flaps at the second end of a portion of the plurality of partially folded boxes of the first non-inverted row, forming first fully folded boxes. The method further includes inverting the first fully folded boxes and placing the inverted first fully folded boxes between extended pairs of opposed flaps at second ends of the first non-inverted row of corresponding partially folded boxes, the inverted first fully folded boxes forming a first inverted top row, the first non-inverted row of partially folded boxes positioned beneath and supporting the first inverted top row, forming a first vertically stacked row. The method further includes arranging a second non-inverted row of partially folded boxes beneath and supporting the first vertically stacked row, the first non-inverted row of partially folded boxes of the first vertically stacked row positioned between extended pairs of opposed flaps at second ends of the second non-inverted row of corresponding partially folded boxes, the first vertically stacked row and the second non-inverted row of partially folded boxes forming a first extended vertically stacked row, the first extended vertically stacked row forming the shipping unit.

In another exemplary embodiment, an apparatus for forming a shipping unit includes a plurality of boxes containing components, the shipping unit including a top row of inverted boxes. The apparatus includes a flap conditioner for receiving boxes closed at a first end and open at a second end, forming partially closed boxes to receive components therein. The flap conditioner inwardly folds one pair of opposed flap pairs at the second end, forming partially folded boxes. The flap conditioner selectively engages remaining opposed flap pairs of each partially folded box in one of a first mode or a second mode. In the first mode, the flap conditioner engages and secures the remaining opposed flap pairs of the partially folded boxes in a predetermined open position or predetermined range of open positions. In the second mode, the flap conditioner inwardly folds the remaining pair of opposed flap pairs of the partially folded boxes and selectively provides an additional treatment in close proximity to flap creases of the remaining opposed flap pairs of the partially folded boxes. At least one of the inward folding and additional treatment of the remaining opposed flap pairs of the partially folded boxes is sufficient to at least partially reduce the tendency of the remaining opposed flap pairs to return to an open position. A staging area receives a predetermined number of partially folded boxes (a row) from the flap conditioner. The staging area comprises a first portion configured to receive partially folded boxes from the flap conditioner. A second portion is configured to receive partially folded boxes from the first portion, the boxes received in the second portion being inverted fully folded boxes (a top row). The staging area continues to secure the opposed flap pairs received from the flap conditioner operating in the first mode in the predetermined open position or predetermined range of open positions. A stacking area receives a first non-inverted row of partially folded boxes from the first portion of the staging area positioned beneath the top row of inverted fully folded boxes from the second portion of the staging area. The top row of inverted fully folded boxes is positioned between extended opposed flaps at second ends of the first non-inverted row of partially folded boxes. The stacking area continues to secure the opposed flap pairs received from the flap conditioner in the predetermined open position or predetermined range of open positions. The stacking area includes movable flap conditioning devices such that the top row of inverted fully loaded boxes are supported by the first non-inverted row of partially folded boxes and the top row of inverted fully loaded boxes are positioned between extended opposed flaps at second ends of the first non-inverted row of partially folded boxes, forming a first vertically stacked row. Upon formation of the first vertically stacked row, a lifting device raises the first vertically stacked row prior to receiving a second non-inverted row of partially folded boxes from the first portion of the staging area. The second non-inverted row of partially folded boxes is positioned beneath the first non-inverted row of partially folded boxes of the first vertically stacked row. The stacking area includes flap conditioning devices such that the first non-inverted row of partially folded boxes of the first vertically stacked row is positioned between extended opposed flaps at second ends of the second non-inverted row of partially folded boxes and the second row of partially folded boxes supporting the first vertically stacked row. The first vertically stacked row and the second non-inverted row of partially folded boxes form a first extended vertically stacked row. An accumulator receives and positions the first extended vertically stacked row or the first extended vertically stacked row and subsequently formed extended vertically stacked rows together to form the shipping unit.

In a further embodiment, in a method for forming a shipping unit including a plurality of boxes containing components in which a plurality of top rows of boxes are fully closed and inverted, with each inverted fully closed top row box supported by a corresponding first non-inverted row box closed at a first end and open at a second end and positioned beneath the inverted fully closed top row box, the first non-inverted row box having an inwardly folded pair of opposed flaps at the second end forming a partially folded box, the inverted fully folded top row box positioned between an extended pair of opposed flaps at the second end of the partially folded first non-inverted row box, with each partially folded first non-inverted row box supported by a corresponding partially folded second non-inverted row box positioned beneath the partially folded first row box, the partially folded first non-inverted row box positioned between an extended pair of opposed flaps at the second end of the corresponding partially folded second non-inverted row box; the inverted fully closed top row box, the corresponding partially folded first non-inverted row box and the corresponding partially folded second non-inverted row box forming a vertically stacked row, with the vertically stacked row or the vertically stacked row combined with other vertically stacked rows collectively forming the shipping unit. The improvement includes arranging the first non-inverted row of partially folded boxes and positioning corresponding inverted fully folded boxes of the top row of inverted fully folded boxes vertically above the first non-inverted row of partially folded boxes and between the extended pairs of opposed flaps at second ends of the first non-inverted row of corresponding partially folded boxes, the inverted fully folded boxes forming a first inverted top row, the first non-inverted row of partially folded boxes supporting the first inverted top row of inverted fully closed boxes and forming a first vertically stacked row. The method further includes arranging a second non-inverted row of partially folded boxes beneath and supporting the first vertically stacked row, the first non-inverted row of partially folded boxes of the first vertically stacked row positioned between the extended pairs of opposed flaps at second ends of the second non-inverted row of corresponding partially folded boxes, the first vertically stacked row and the second non-inverted row of partially folded boxes forming a first extended vertically stacked row, the first extended vertically stacked row forming the shipping unit.

Other features and advantages of the present invention will be apparent from the following more detailed description of the preferred embodiment, taken in conjunction with the accompanying drawings which illustrate, by way of example, the principles of the invention.

DETAILED DESCRIPTION

Specific embodiments of apparatus and method for forming a shipping unit comprising one or more boxes according to the disclosure are described below with reference to the drawings.

As collectively shown in FIGS. 1-14, an exemplary embodiment of a method for forming a shipping unit is now discussed.

Figure 12:
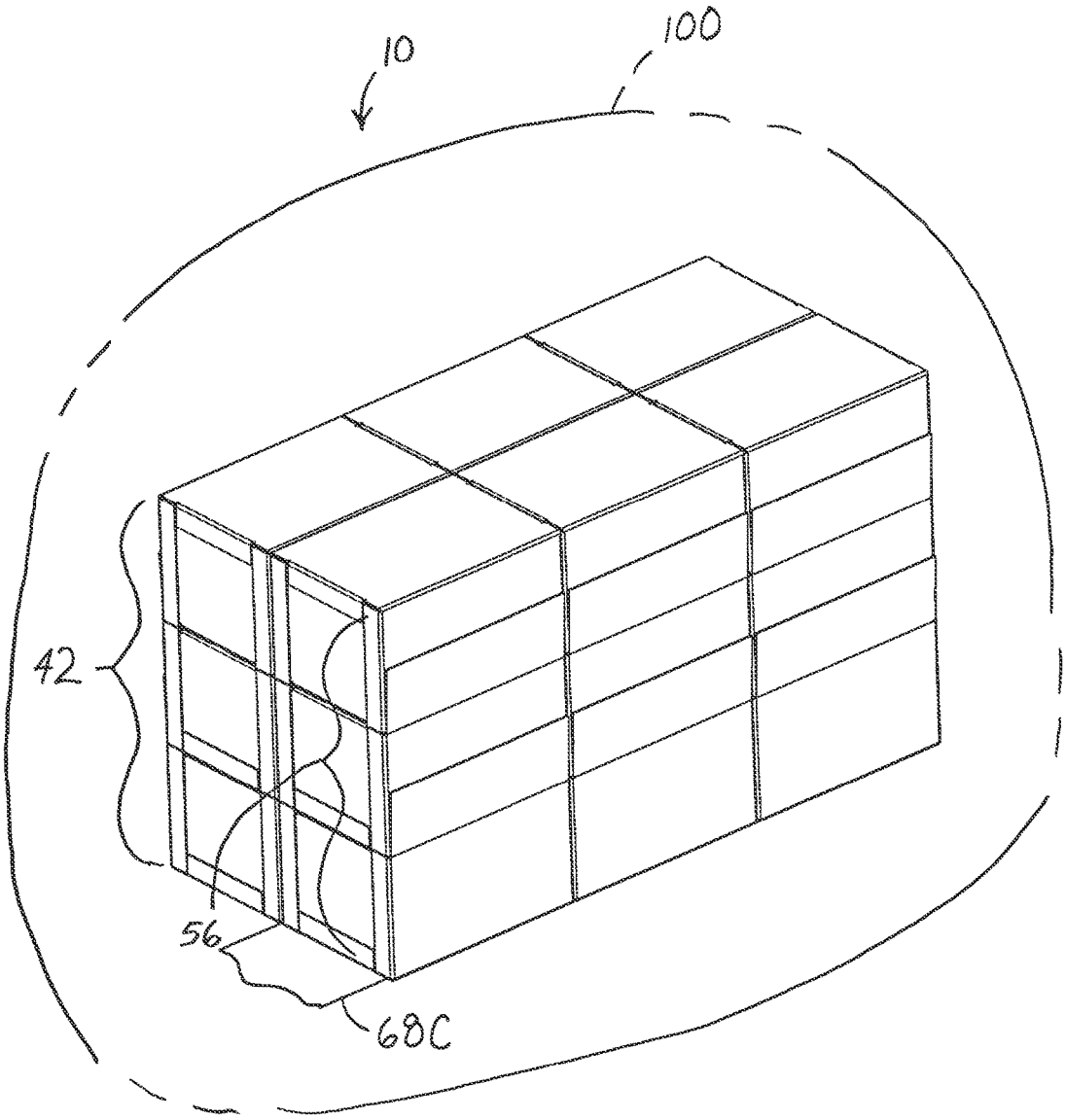
FIG. 12 is an upper perspective view of a shipping unit comprised of the second extended vertically stacked row of FIG. 11 arranged near the first extended vertically stacked row of FIG. 9 according to the disclosure.

While a shipping unit 10 is shown in FIG. 12, and is comprised of a plurality of boxes, it is to be understood that a shipping unit can comprise a single box or any combination of boxes. It is also to be understood for that components contained inside of the one or more boxes comprising a shipping unit can include empty containers that are to be filled with product, but can also include any substance or matter that can be placed inside of a box for transport.

Figure 1:
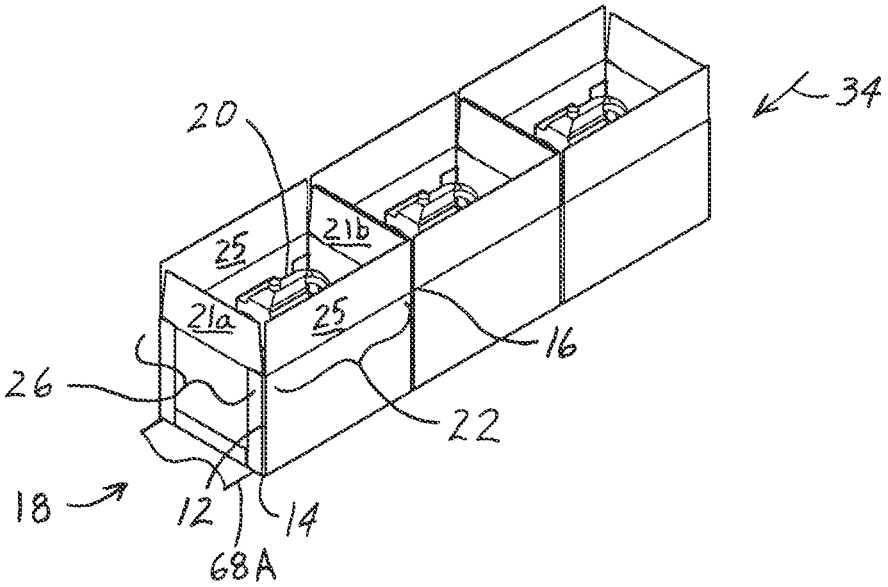
FIG. 1 is an upper perspective view of partially closed boxes according to the disclosure.

As shown in FIG. 1, an exemplary embodiment of a box 12, also referred to as a regular slotted carton (RSC) is usable with an apparatus 11 (FIG. 15) for transporting components 20 of the present disclosure. As further shown in FIGS. 1 and 2, box 12 has a first end 14 in which the flaps are closed, and a second end 16 having two opposed pairs of flaps 22, 26. Pair of flaps 22 includes a front flap 21*a* and a rear flap 21*b* relative to conveyance direction 34 of conveyor 68A, and pair of flaps 26 includes opposed flaps 25. In one embodiment pair of flaps 22 are the major flaps, while in another embodiment, a pair of flaps 22 are the minor flaps, with the same being true for pair of flaps 26 in further embodiments. The terms minor flaps in major flaps are well known in the art and not further discussed herein. As shown in FIG. 1, box 12 defines a partially closed box 18. In one embodiment, apparatus 11 (FIG. 15) receives partially closed boxes 18 from which shipping units 10, such as shown in FIG. 12 are formed.

Figure 2:
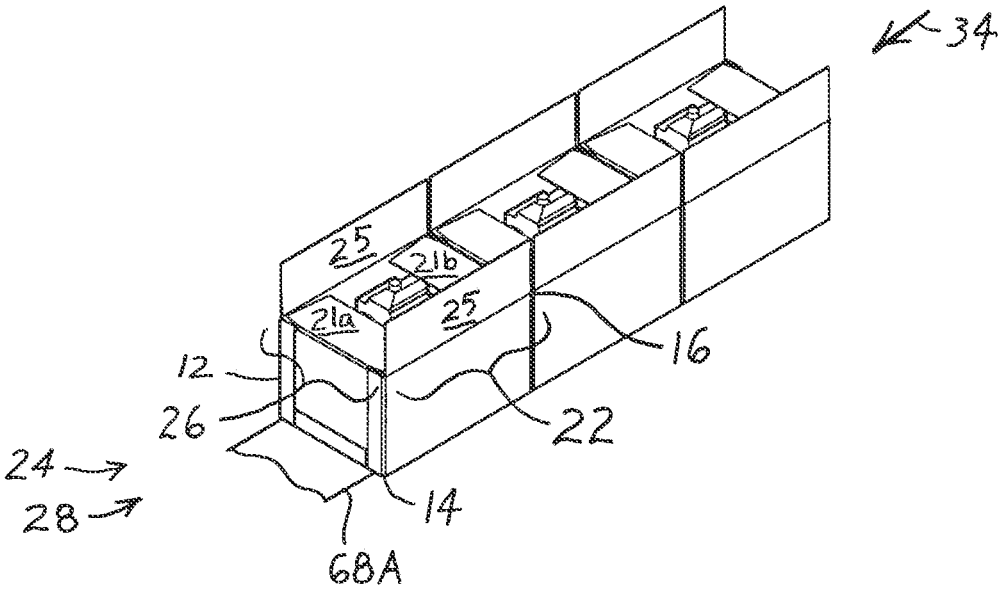
FIG. 2 is an upper perspective view of partially folded boxes according to the disclosure.
Figure 3:
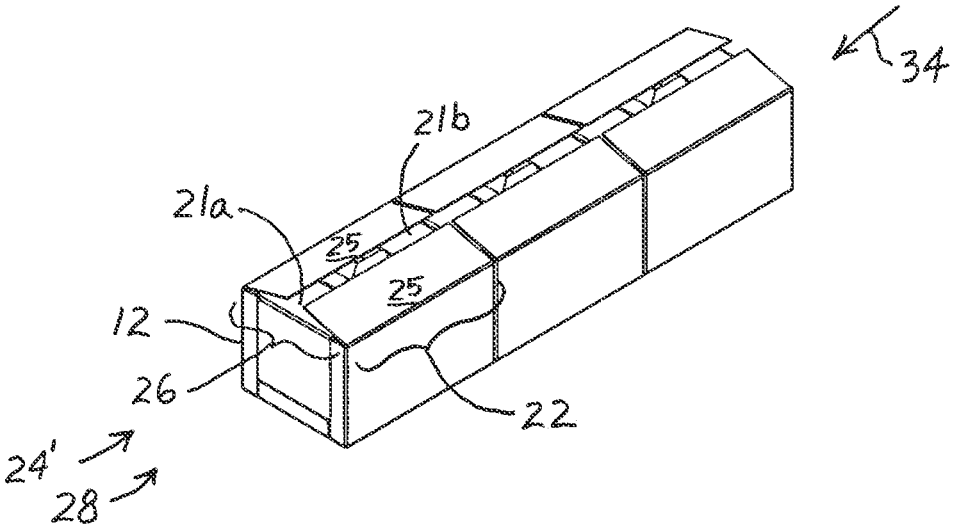
FIG. 3 is an upper perspective view of an exemplary embodiment of partially folded boxes according to the disclosure.

As shown in FIG. 2, front flap 21*a* and rear flap 21*b* of partially closed boxes 18 are folded inwardly about their respective flap creases or creases, with opposed flaps 25 of pair of flaps 26 remaining in an extended (unfolded) position, forming or defining. partially folded boxes 24. In one embodiment, at least one flap 25 of pair of flaps 26 can be folded inwardly about their respective creases to define partially folded boxes 24. In other embodiments, with flaps 21*a*, 21*b* folded inwardly about their respective creases, at least one of opposed flaps 25 of pair of flaps 26 can be partially folded inwardly or partially folded outwardly, while continuing to be defined as a partially folded box 24. For example, as shown in FIG. 3, with flaps 21*a*, 21*b* folded inwardly, opposed flaps 25 of pair of flaps 26 are partially folded inwardly and identified as partially folded box 24'. In yet other embodiments, with flaps 25 folded inwardly about their respective creases, one or more of opposed flaps 21*a*, 21*b* can be partially folded inwardly or partially folded outwardly, while continuing to be defined as partially folded boxes 24. As will be discussed in further detail below, partially folded boxes 24 are formed from partially closed boxes 18 in a portion of apparatus 11 referred to as a flap conditioner 70 (FIG. 15).

Figure 4:
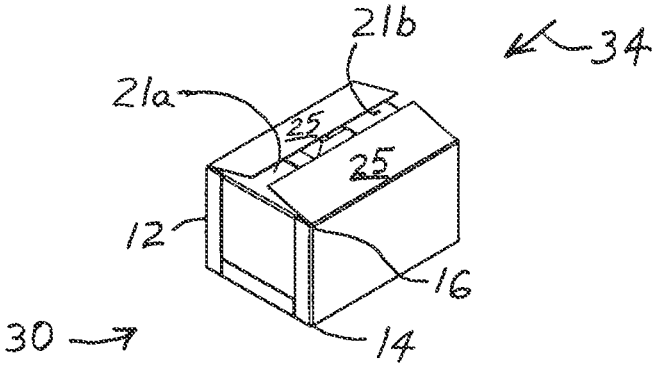
FIG. 4 is an upper perspective view of a fully folded box according to the disclosure.
Figure 5:
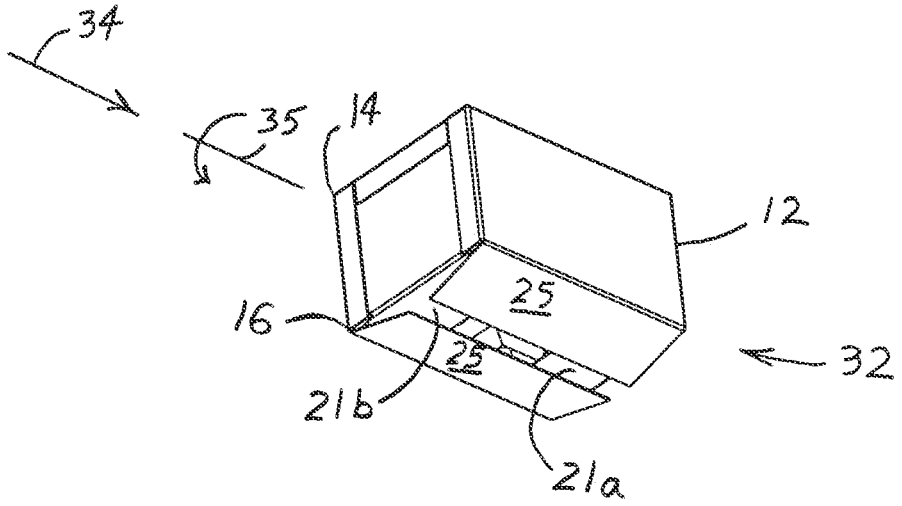
FIG. 5 is a lower perspective view of an inverted first fully folded box according to the disclosure.

As shown in FIG. 4, with flaps 21*a*, 21*b* folded inwardly about their respective creases, opposed flaps 25 are folded inwardly about their respective creases over flaps 21*a*, 21*b*, such that the opposed surfaces of flaps 25 are substantially coplanar defining a first fully folded box 30. In one embodiment of first fully folded box 30, opposed flaps 25 are folded inwardly about their respective creases and flaps 21*a*, 21*b* are folded inwardly about their respective creases over flaps 25, such that the opposed services of flaps 21*a*, 21*b* are substantially coplanar, defining first fully folded box 30. As shown in FIG. 5, first fully folded box 30 is rotated about an axis 35 that is parallel to conveyance direction 34, defining an inverted first fully folded box 32.

Figure 8:
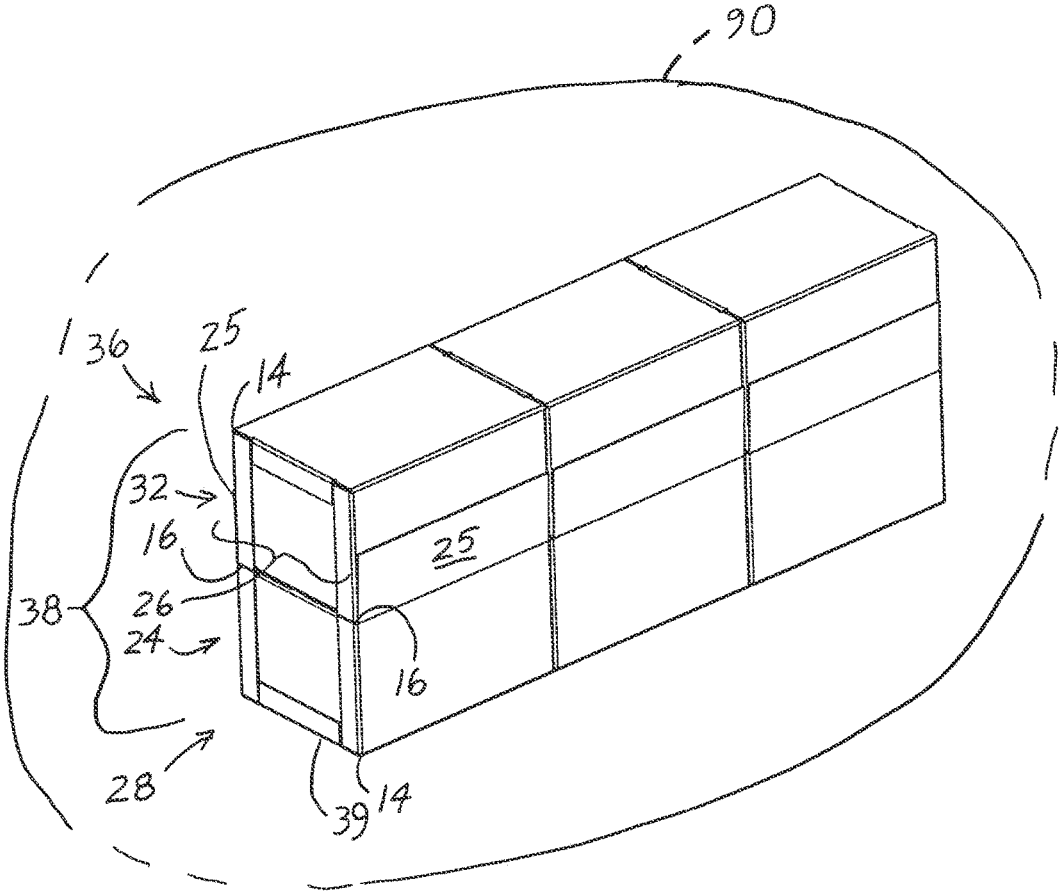
FIG. 8 is an upper perspective view of a first vertically stacked row formed from the inverted first fully folded boxes and corresponding partially folded boxes of a first non-inverted row of FIG. 7 according to the disclosure.
Figure 9:
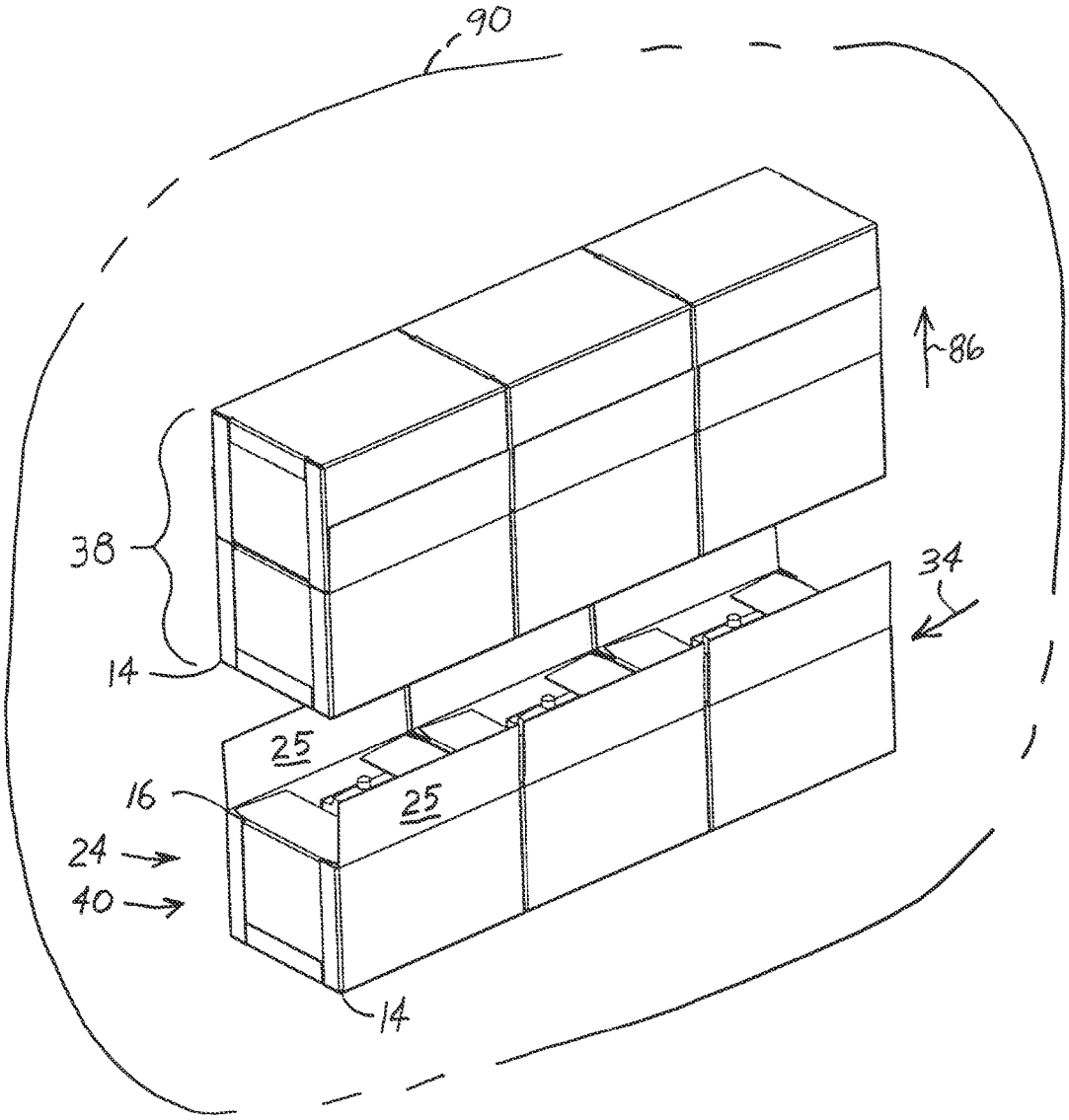
FIG. 9 is an upper perspective view of the first vertically stacked row of FIG. 8 vertically positioned above a corresponding second non-inverted row of boxes according to the disclosure.
Figure 10:
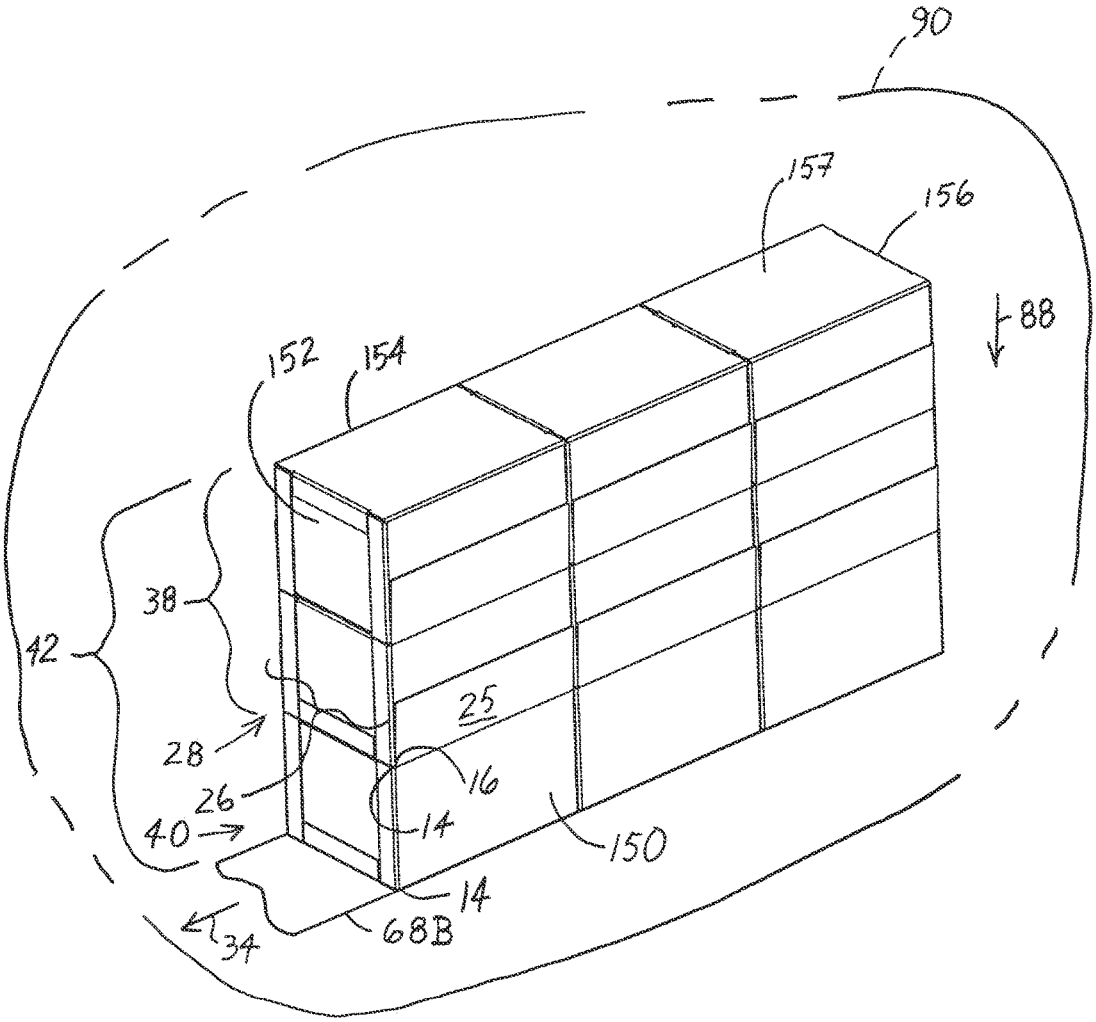
FIG. 10 is an upper perspective view of an extended first vertically stacked row formed from the first vertically stacked row and corresponding second non-inverted row of boxes of FIG. 9 according to the disclosure.
Figure 71:
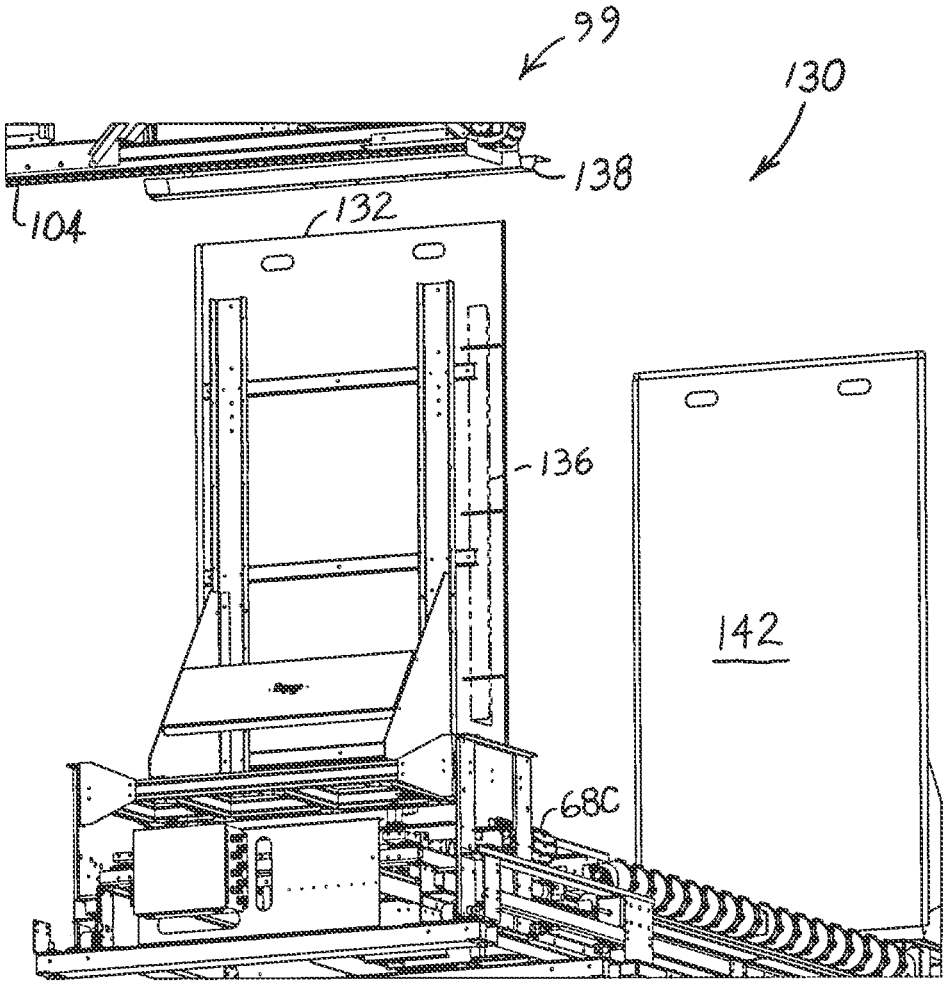
FIG. 71 is an enlarged partial perspective view of an exemplary support assembly of the accumulator according to the disclosure.

FIGS. 6-10 depict a manipulation of boxes 12 by apparatus 11 (FIG. 15), with FIGS. 6-10 showing the manner in which the boxes 12 are manipulated by only showing the boxes, i.e., without concealing or obscuring the boxes by the different portions of the apparatus, ultimately forming a first extended vertically stacked row 42 (FIG. 10). FIGS. 11A-11E depict a similar manipulation of boxes by apparatus 11, ultimately forming a second extended vertically stacked row 56 (FIG. 11E). FIGS. 6-10 and FIGS. 11A-11E are disclosed for purposes of establishing terminology for interim groupings or arrangements of the boxes in a manner believed to more clearly describe the operation of the apparatus of the present disclosure, as well as introduce such groupings, e.g., first extended vertically stacked row 42 and second extended vertically stacked row 56, which are further manipulated together (FIGS. 72-78) for ultimately describing a manner of further box manipulation for forming a yet larger shipping unit in another portion of apparatus 11 referred to as an accumulator 100 (FIG. 15). Once FIGS. 6-10 (and FIGS. 11A-11E) describe the manner of box manipulation performed by different portions of apparatus 11, FIGS. 15-71 are directed to the different portions of apparatus 11 that perform the described box manipulation. However, for purposes of consistency, the terminology of boxes used with FIGS. 6-10 will be used when discussing FIGS. 15-71. FIGS. 72-78 schematically show additional box grouping manipulations performed in a portion of apparatus 11 (i.e., the accumulator 100 (FIG. 15)) using a combination of simplified apparatus components of accumulator 100 for manipulating box groupings previously formed, such as first extended vertically stacked row 42 and second extended vertically stacked row 56 that is shown in FIG. 12, for purposes of clarity.

Figure 15:
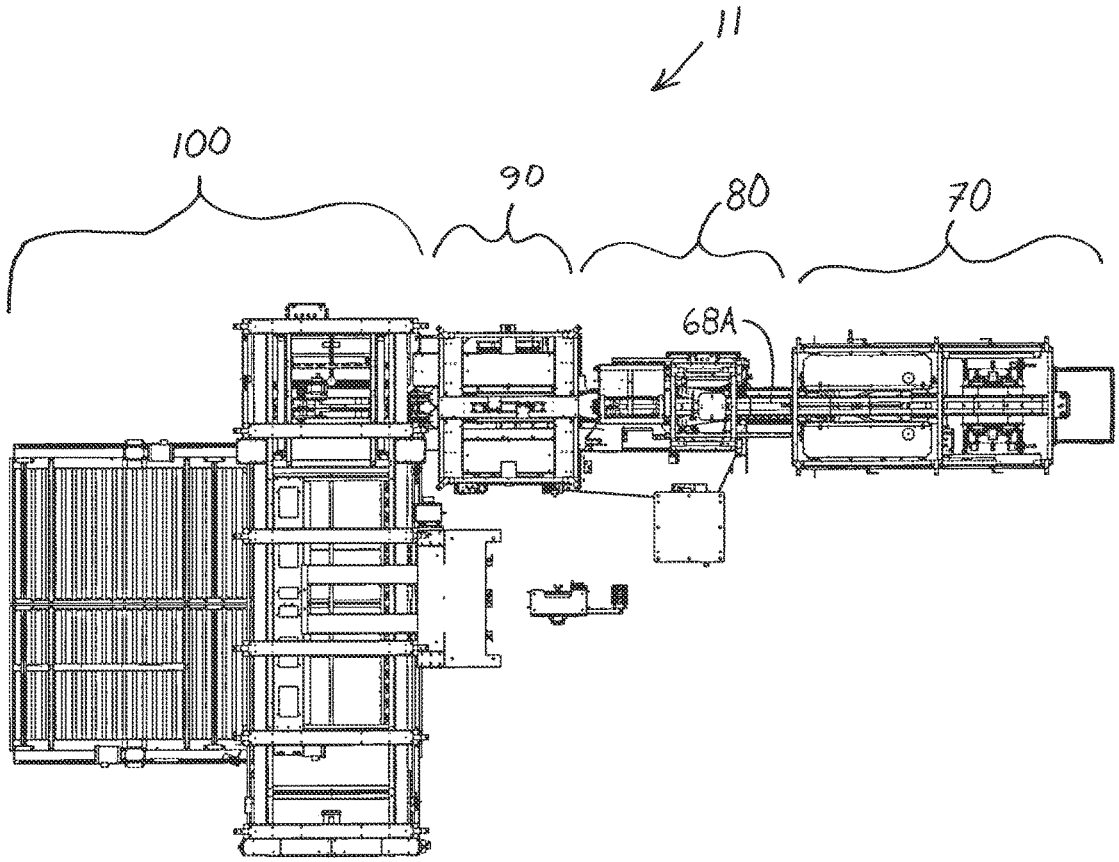
FIG. 15 is a plan view of an exemplary apparatus for forming a shipping unit comprising a plurality of boxes according to the disclosure.
Figure 16:
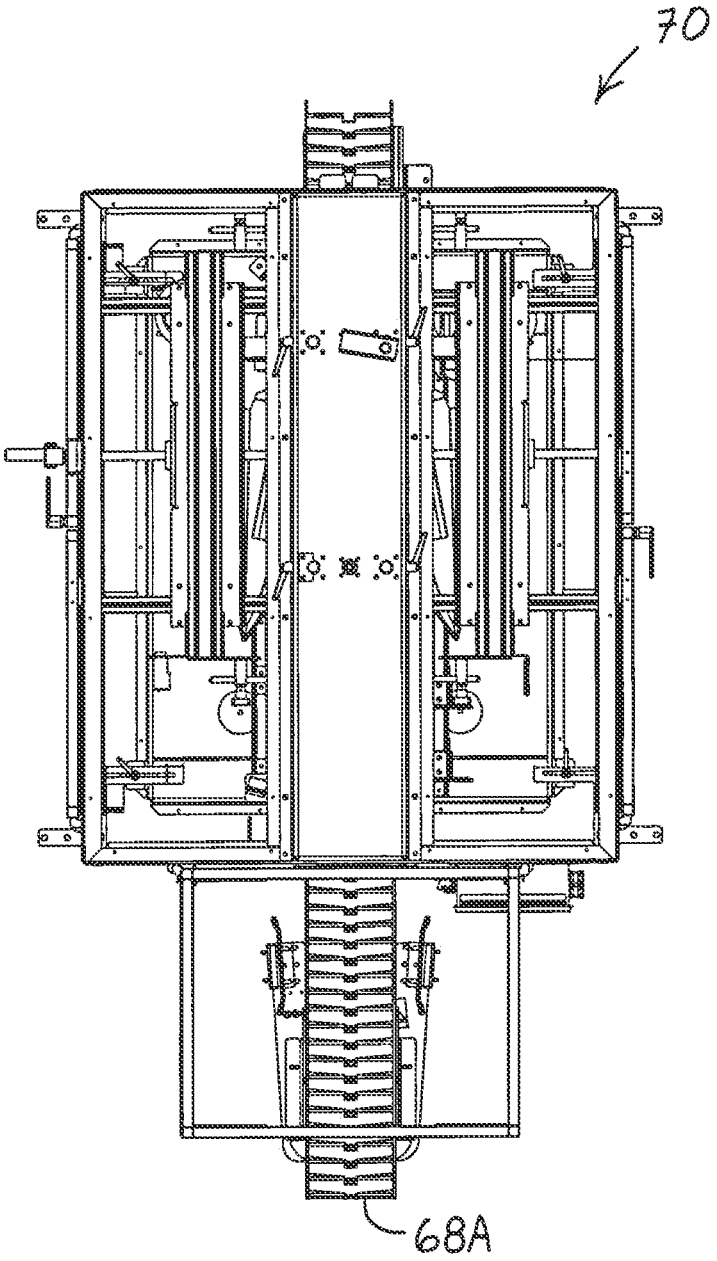
FIG. 16 is a plan view of an exemplary flap conditioner according to the disclosure.
Figure 17:
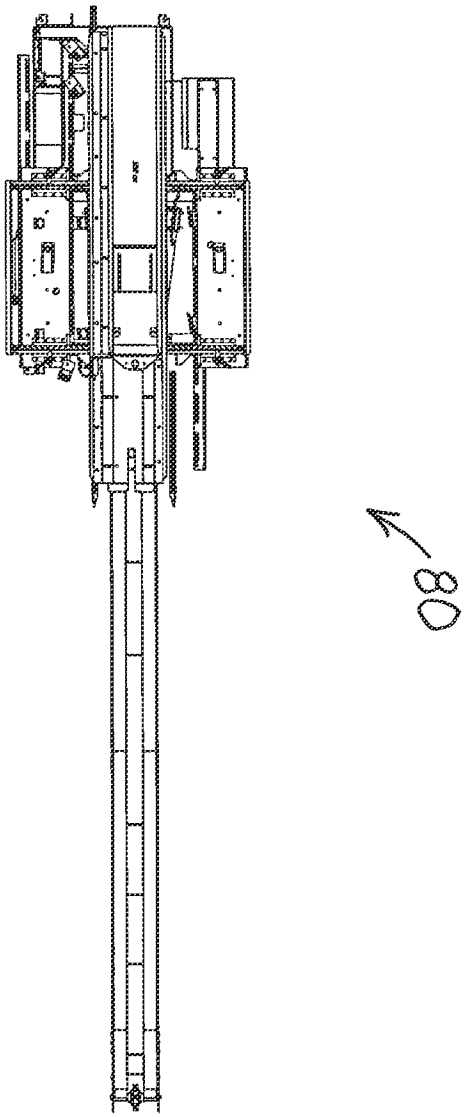
FIG. 17 is a plan view of an exemplary staging area according to the disclosure.
Figure 18:
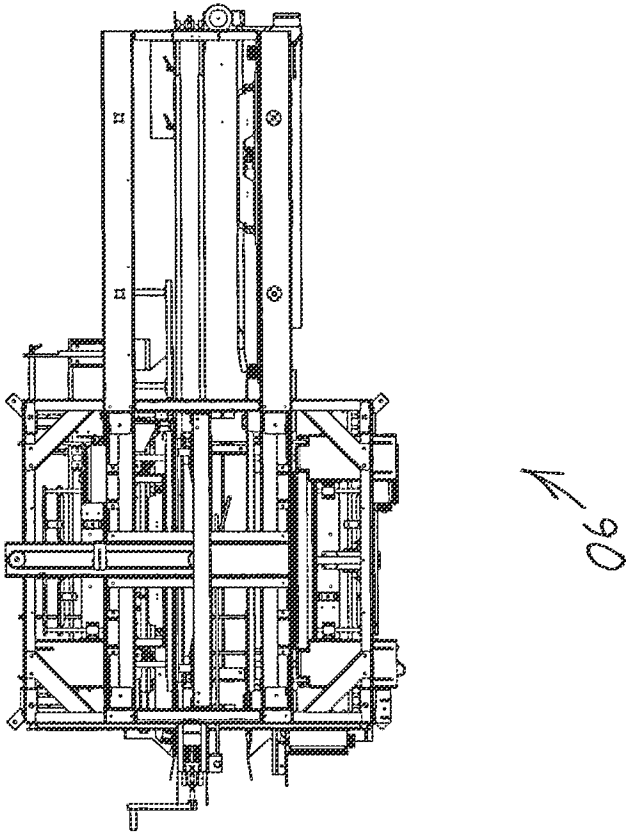
FIG. 18 is a plan view of an exemplary stacking area according to the disclosure.
Figure 19:
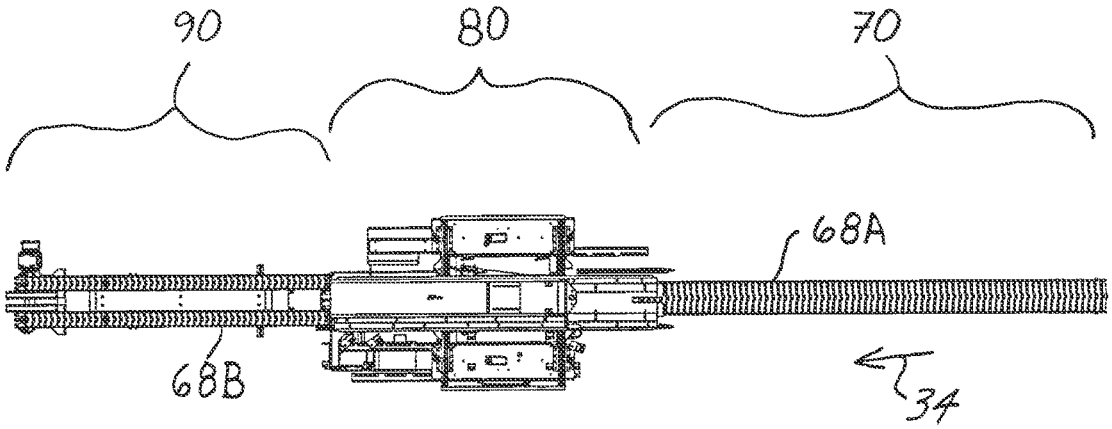
FIG. 19 is a plan view of the flap conditioner of FIG. 16, the staging area of FIG. 17 and conveyors associated with the stacking area of FIG. 18 according to the disclosure.
Figure 20:
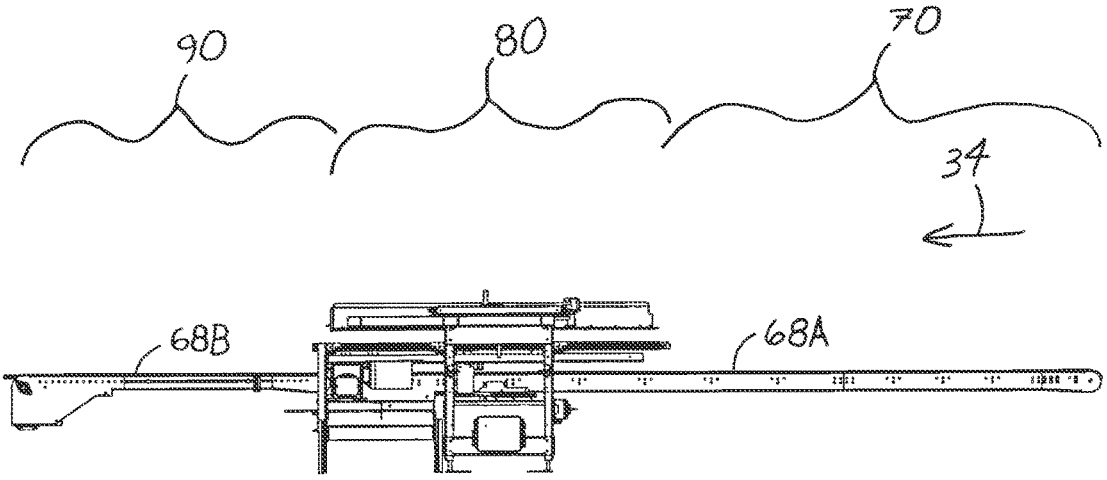
FIG. 20 is an elevation view of FIG. 19 according to the disclosure.
Figure 21:
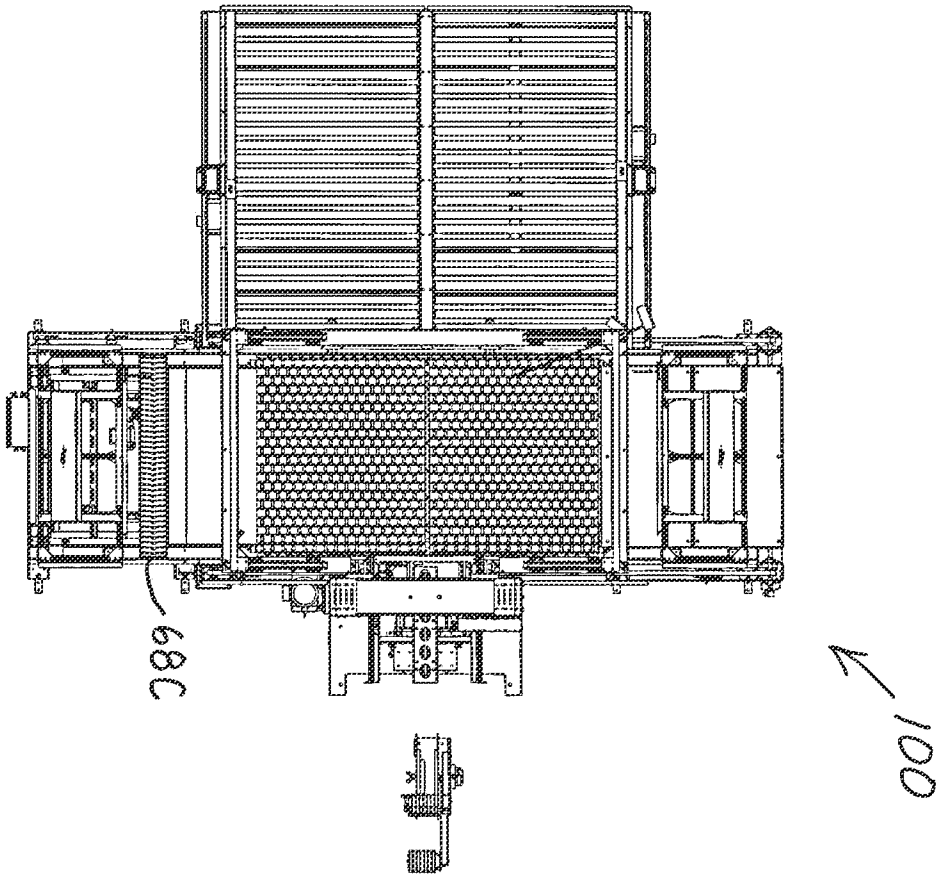
FIG. 21 is a plan view of an exemplary accumulator according to the disclosure.

It is to be understood that for purposes of this disclosure, the term row is used to identify a grouping of boxes provided in another portion of the apparatus 11 (staging area 80, FIG. 15). Although the grouping of box rows are initially provided in staging area 80, for purposes of clarity, different terminology is provided to identify and distinguish the box rows from each other during manipulation of the box rows during operation of apparatus 11. In addition, for purposes of this disclosure, the quantity of boxes associated with a row is three. However, it is to be understood that a row can contain a single box, two boxes, or a quantity of boxes greater than three.

Figure 6:
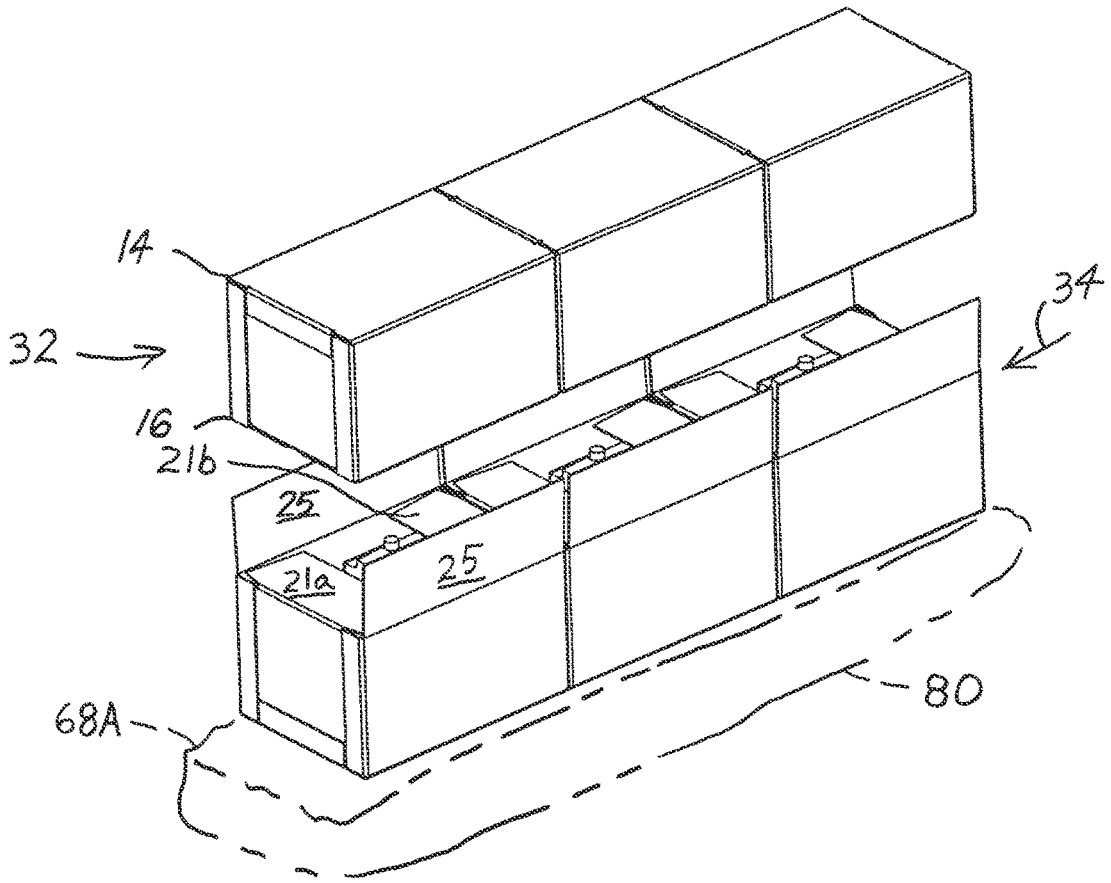
FIG. 6 is an upper perspective view of inverted first fully folded boxes positioned vertically above corresponding partially folded boxes of a first non-inverted row collectively located in a staging area according to the disclosure.
Figure 7:
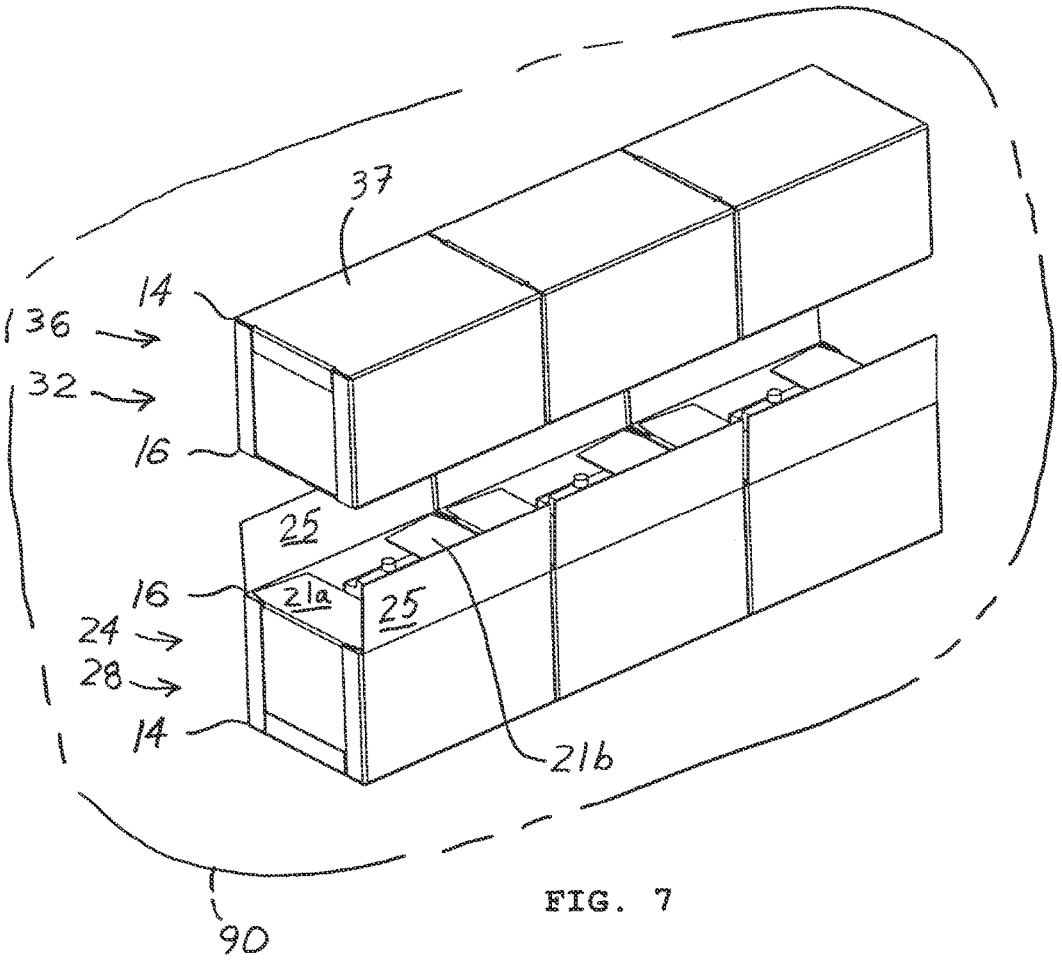
FIG. 7 is an upper perspective view of inverted first fully folded boxes positioned vertically above corresponding partially folded boxes of a first non-inverted row collectively located in a stacking area according to the disclosure.
Figure 27:
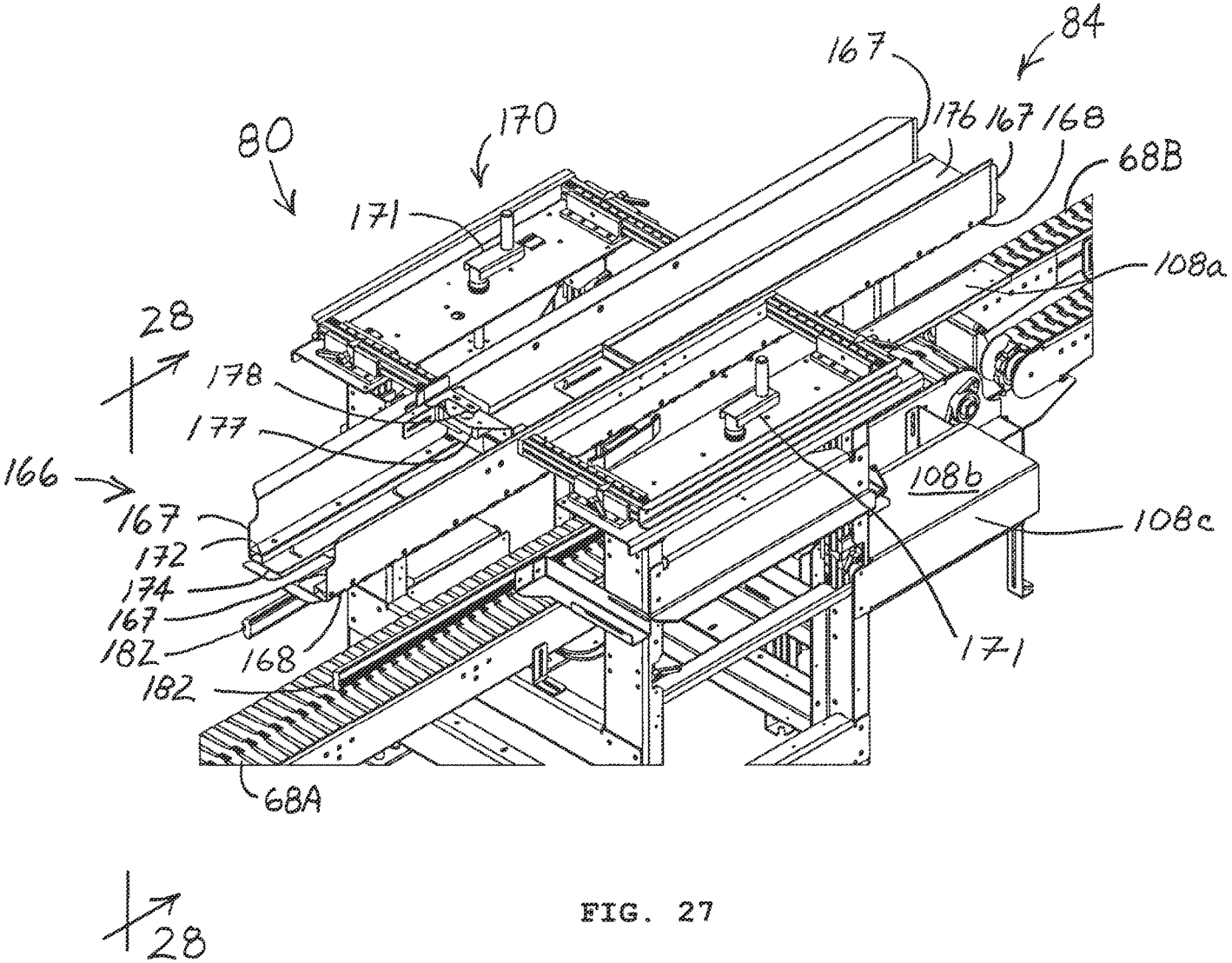
FIG. 27 is an upper perspective view of a staging area according to the disclosure.

Referring back to FIGS. 6-10, the manipulation of boxes is now described with a general reference to the portions of apparatus 11. As shown in FIG. 6, after initial formation in flap conditioner 70 (FIG. 15), a first non-inverted row 28 of partially folded boxes 24 is received in a first portion 82 of staging area 80 (FIG. 27). As further shown in FIG. 6, a row of inverted first fully folded boxes 32 is received in a second portion 84 of staging area 80 (FIG. 27). As yet further shown in FIG. 6, the row of inverted first fully folded boxes 32 is positioned vertically above first non-inverted row 28 of partially folded boxes 24. As shown in FIG. 7, a first inverted top row 36 of inverted first fully folded boxes 32 is positioned vertically above first non-inverted row 28 of partially folded boxes 24 in the stacking area 90 (FIG. 15). As shown in FIG. 8, while still in stacking area 90, first inverted top row 36 of inverted first fully folded boxes 32 is positioned vertically above and supported by ends 16 of first non-inverted row 28 of partially folded boxes 24, forming a first vertically stacked row 38 in which inverted first fully folded boxes 32 are placed between extended pairs of opposed flaps 26 of flaps 25 of corresponding first non-inverted row 28 of partially folded boxes 24. As shown in FIG. 9, while still in stacking area 90, first vertically stacked row 38 is raised in an upward movement direction 86 and positioned vertically above a second non-inverted row 40 of partially folded boxes 24. As shown in FIG. 10, while still in stacking area 90, first vertically stacked row 38 is positioned vertically above and lowered in a downward movement direction 88 until supported by ends 16 of second non-inverted row 40 of partially folded boxes 24, forming a first extended vertically stacked row 42 in which partially folded boxes 24 of first non-inverted row 28 are placed between extended pairs of opposed flaps 26 of flaps 25 of corresponding second non-inverted row 40 of partially folded boxes 24.

Figure 11A:
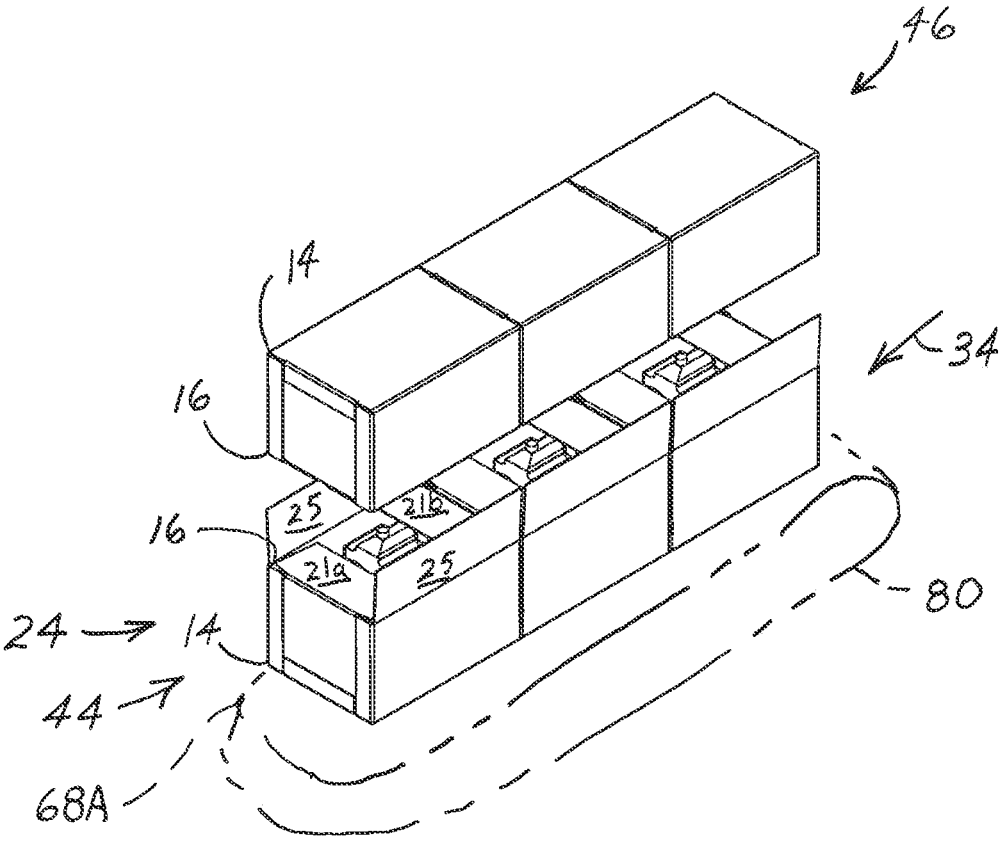
FIGS. 11A-11E are views directed to forming a second vertically stacked row of boxes in a manner similar to forming the first vertically stacked row of boxes of FIGS. 6-10 according to the disclosure.
Figure 11B:
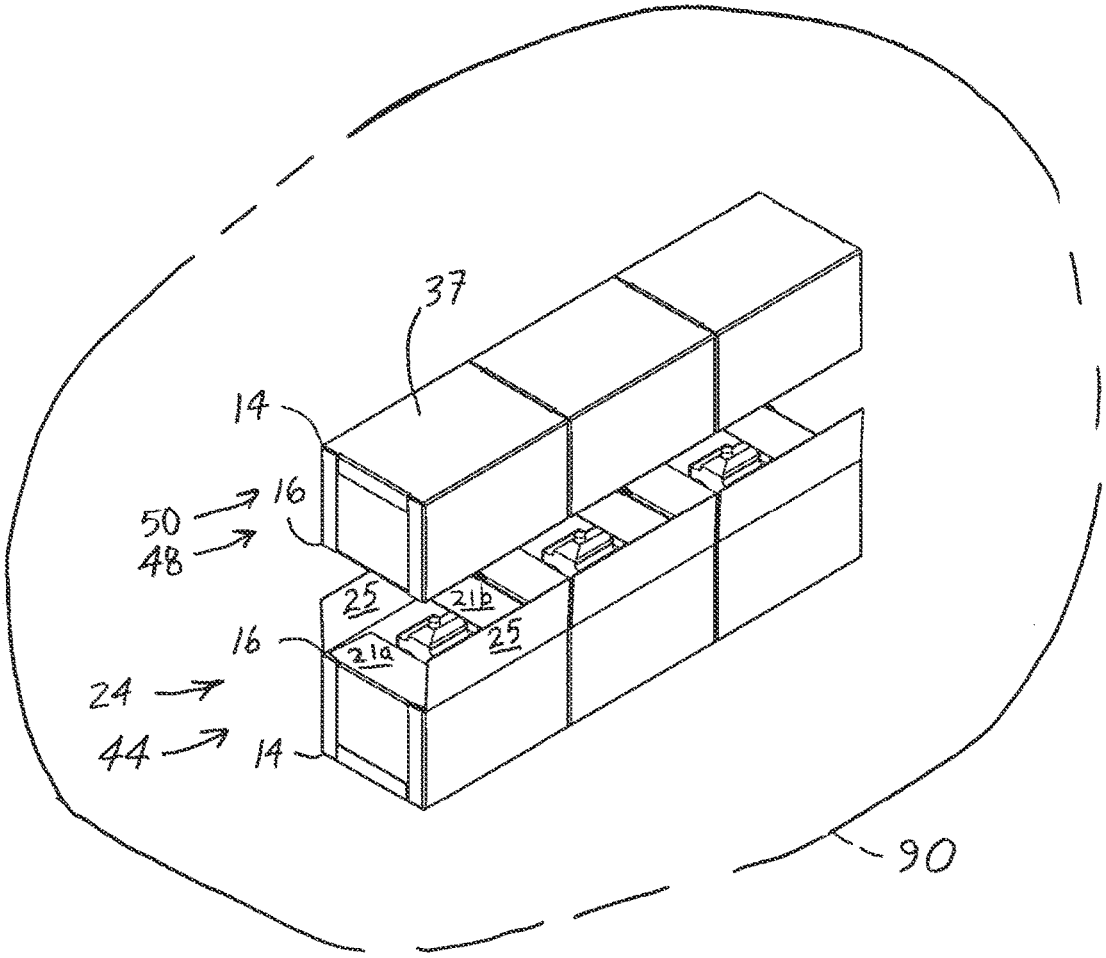
Figure 11C:
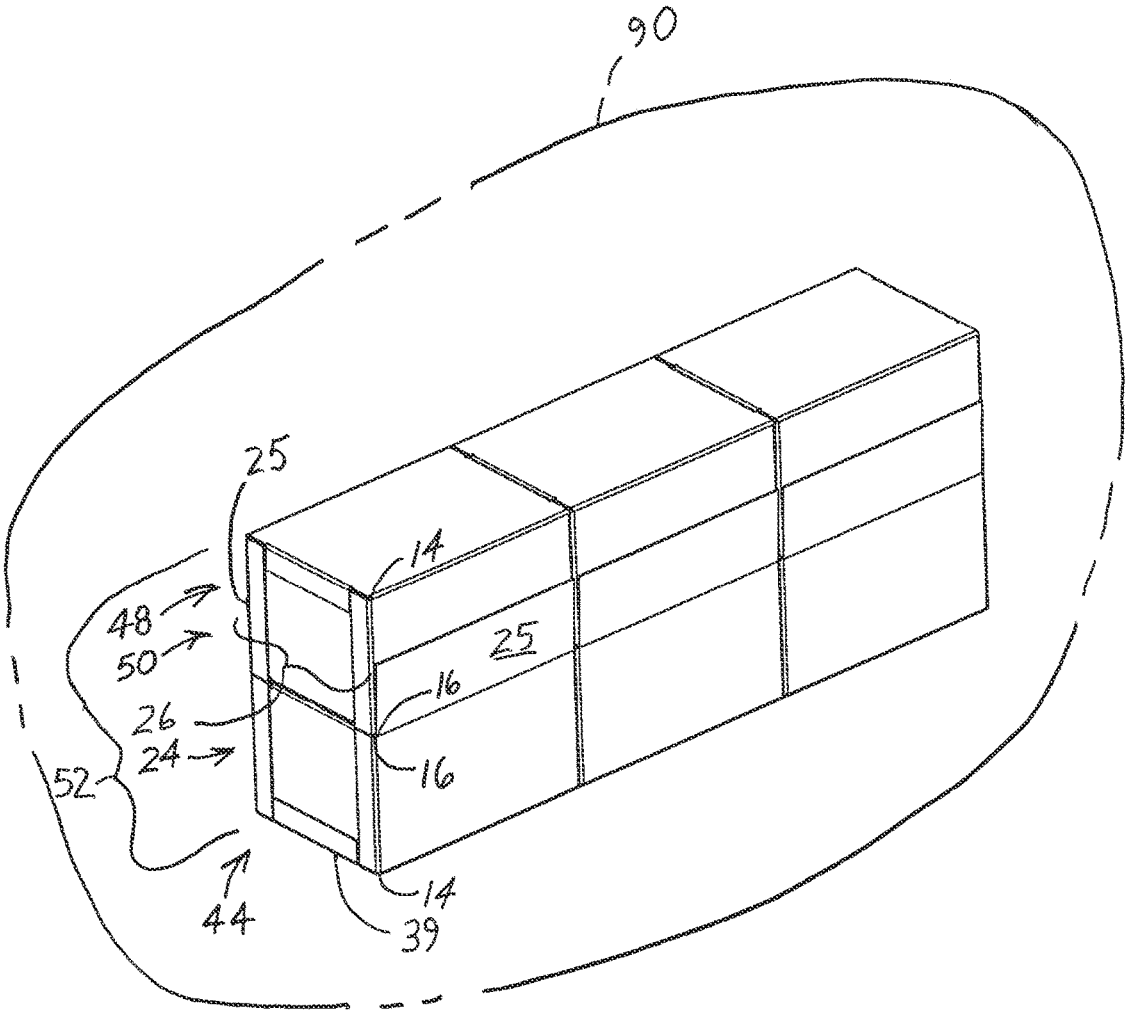
Figure 11D:
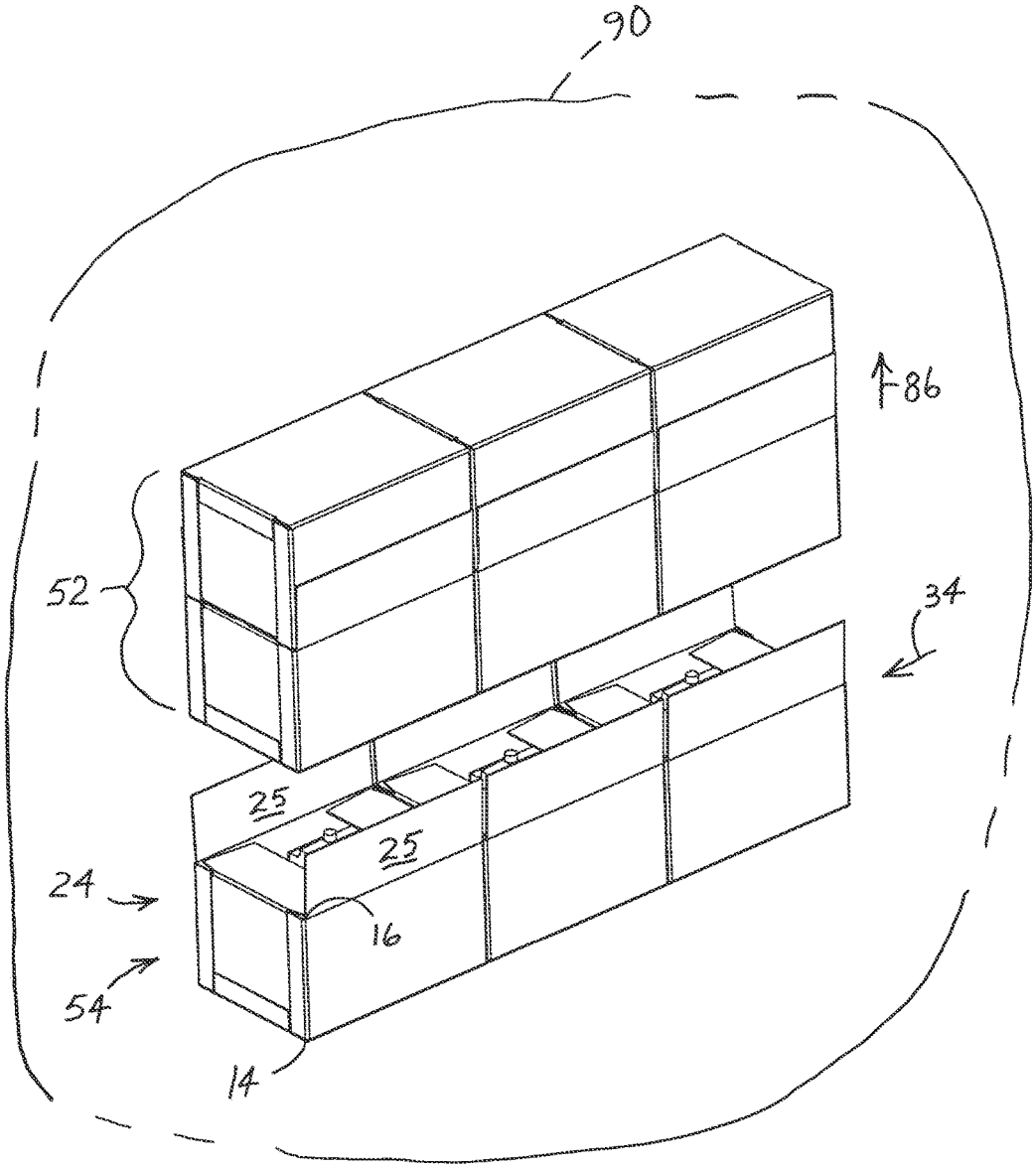
Figure 11E:
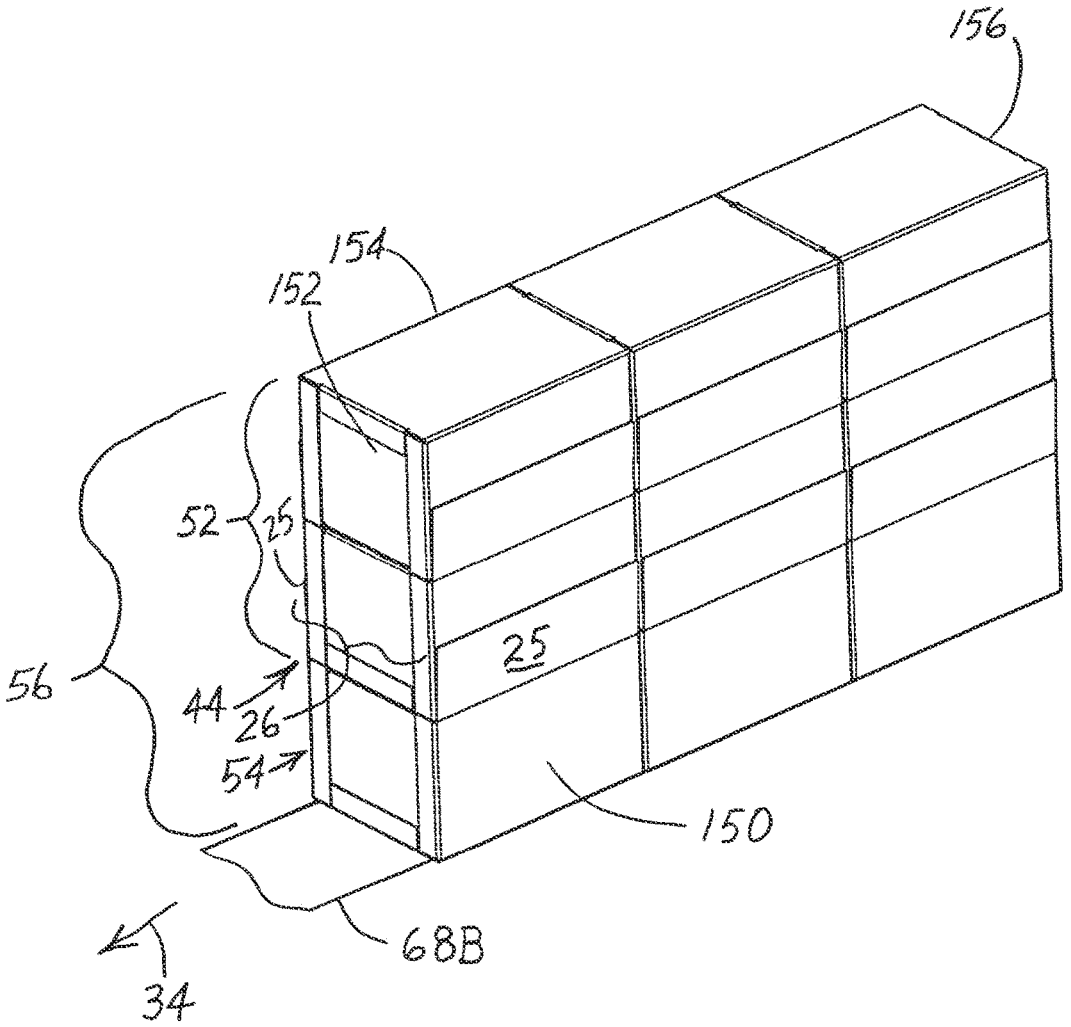

Referring to FIGS. 11A-11E, the manipulation of boxes is now described with a general reference to the portions of apparatus 11. As shown in FIG. 11A, after initial formation in flap conditioner 70 (FIG. 15), a third non-inverted row 44 of partially folded boxes 24 is received in a first portion 82 of staging area 80 (FIG. 27). As further shown in FIG. 11A, a row of inverted second fully folded boxes 46 is received in a second portion 84 of staging area 80 (FIG. 27). As yet further shown in FIG. 11A, the row of inverted second fully folded boxes 46 is positioned vertically above the third non-inverted row 44 of partially folded boxes 24. As shown in FIG. 11B, a second inverted top row 50 of inverted first fully folded boxes 32 is positioned vertically above the third non-inverted row 44 of partially folded boxes 24 in the stacking area 90 (FIG. 15). As shown in FIG. 11C, while still in stacking area 90, second inverted top row 50 of inverted second fully folded boxes 48 is positioned vertically above and supported by ends 16 of third non-inverted row 44 of partially folded boxes 24, forming a second vertically stacked row 52 in which inverted first fully folded boxes 32 are placed between extended pairs of opposed flaps 26 of flaps 25 of corresponding third non-inverted row 44 of partially folded boxes 24. As shown in FIG. 11D, while still in stacking area 90, second vertically stacked row 52 is raised in an upward movement direction 86 and positioned vertically above a fourth non-inverted row 54 of partially folded boxes 24. As shown in FIG. 11E, while still in stacking area 90, second vertically stacked row 52 is positioned vertically above and supported by ends 16 of fourth non-inverted row 54 of partially folded boxes 24, forming a second extended vertically stacked row 56 in which partially folded boxes 24 of third non-inverted row 44 are placed between extended pairs of opposed flaps 26 of flaps 25 of corresponding fourth non-inverted row 54 of partially folded boxes 24.

It is appreciated that additional rows/stacked rows can be used to supplement the above box constructions, if desired.

FIG. 12 shows first extended vertically stacked row 42 and second extended vertically stacked row 56 partially manipulated in accumulator 100 (FIG. 15) of apparatus 11, as discussed in further detail in FIGS. 72-78.

Figure 13:
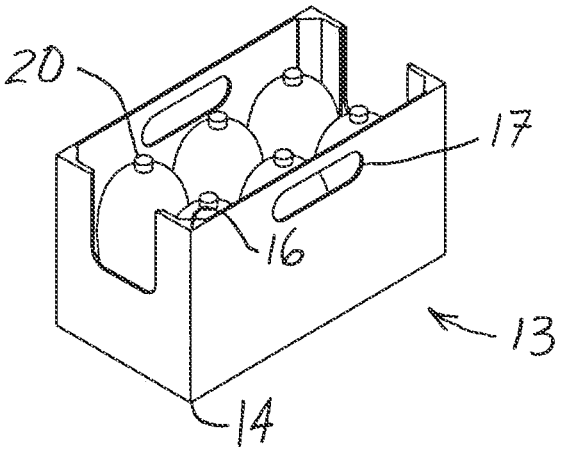
FIG. 13 is an upper perspective view of an alternate embodiment of a box according to the disclosure.
Figure 14:
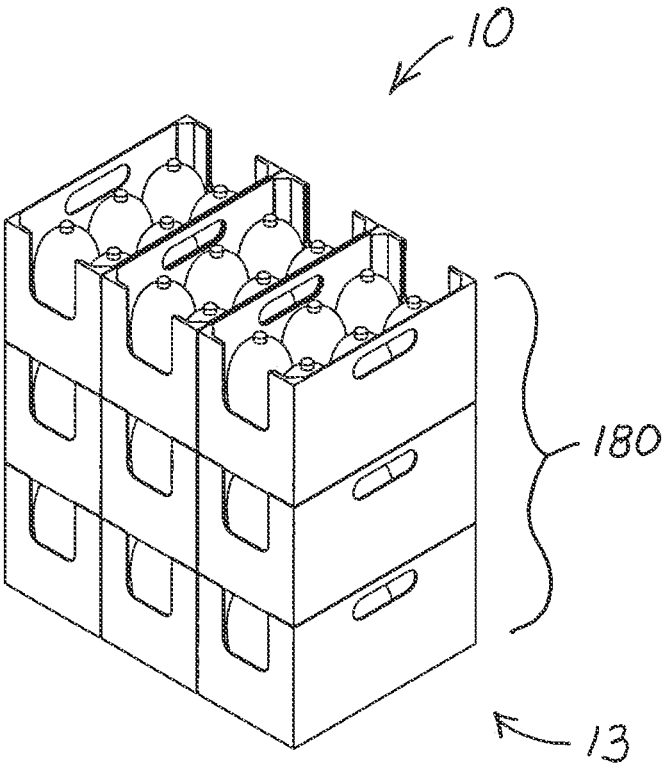
FIG. 14 is an upper perspective view of a first extended vertically stacked row of boxes of FIG. 13 according to the disclosure.

FIG. 13 shows an alternate embodiment of box that can be manipulated by the apparatus of the present disclosure. In this embodiment, box 13 lacks flaps at the end 16 and optionally includes handles 17, such as opposed openings formed in the body of the box between ends 14, 16.

Components 20 are positioned inside of box 13. In a manner similar to that previously discussed, such as to construct first extended vertically stacked row 42 (FIG. 10), a first extended vertically stacked row 180 can be constructed by apparatus 11 (FIG. 15). One having ordinary skill in the art will appreciate that due to box 13 lacking flaps at the end 16, it would be generally undesirable to invert the top row of first extended vertically stacked row 180, and as a result, components/arrangements or features of components/arrangements of apparatus 11 (FIG. 15) utilized to construct inverted rows would not be required to construct shipping units from boxes 13. However, apparatus 11 would otherwise operate in a similar fashion (such as to construct first extended vertically stacked row 42) as will be discussed in further detail below.

FIGS. 15-21 show an apparatus 11 of the present disclosure. Apparatus 11 includes a flap conditioner 70, staging area 80, a stacking area 90 and an accumulator 100 operatively connected to each other by conveyors 68A, 68B and 68C. As shown in the figures, conveyor 68A is associated with flap conditioner 70 and staging area 80, conveyor 68B is associated with stacking area 90, and conveyor 68C is associated with accumulator 100. However, it is to be understood that the conveyors can include numerous conveyor portions and conveyor arrangements, and is not discussed further herein. Apparatus 11 is configured to convey partially closed boxes 18 received by flap conditioner 70, and as a result of sequential processing/manipulation of the boxes at staging area 80, stacking area 90 and accumulator 100, produce a shipping unit 10 of the desired size suitable for transport.

Figure 22:
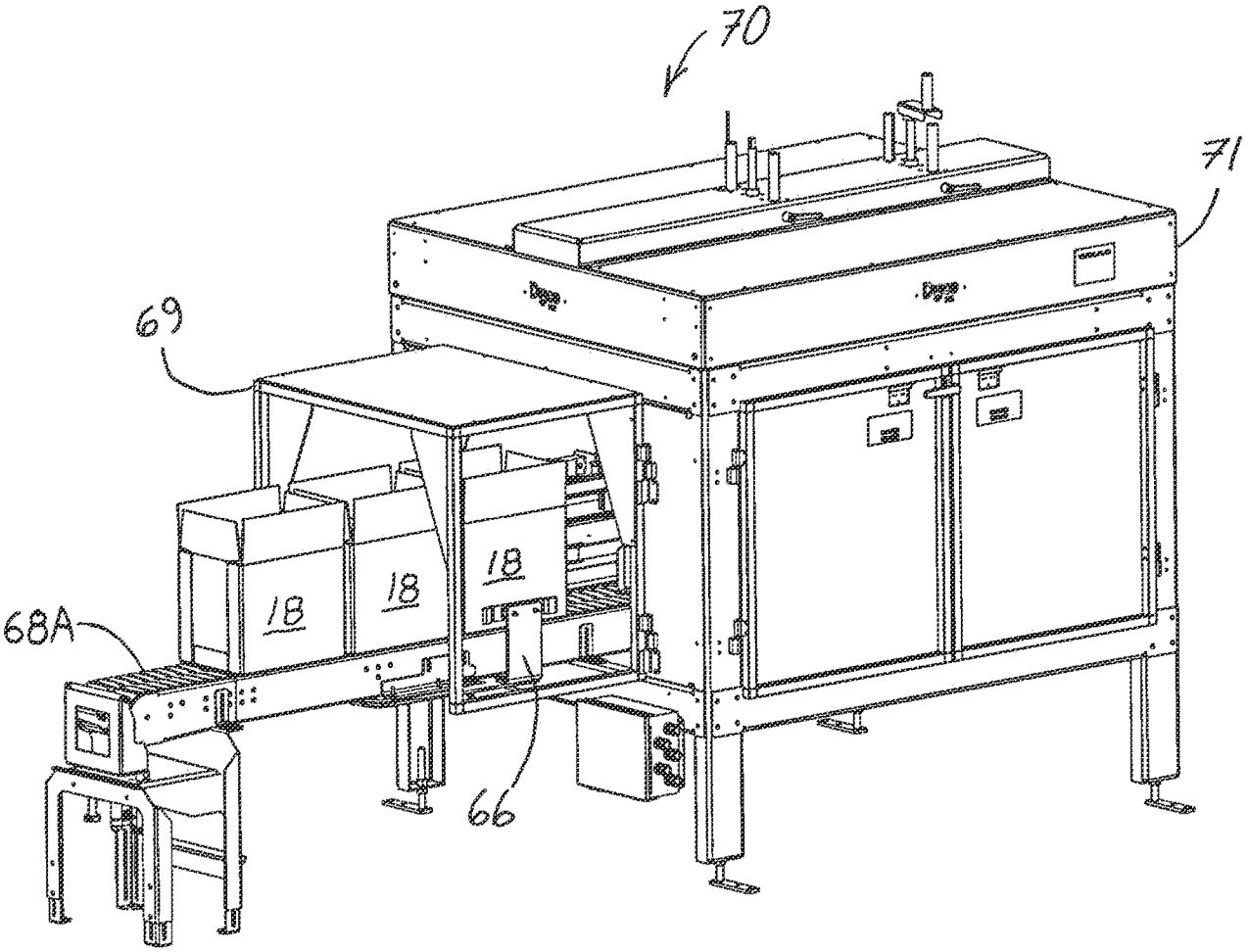
FIG. 22 is an upper perspective view of partially closed boxes being conveyed into the flap conditioner according to the disclosure.
Figure 23:
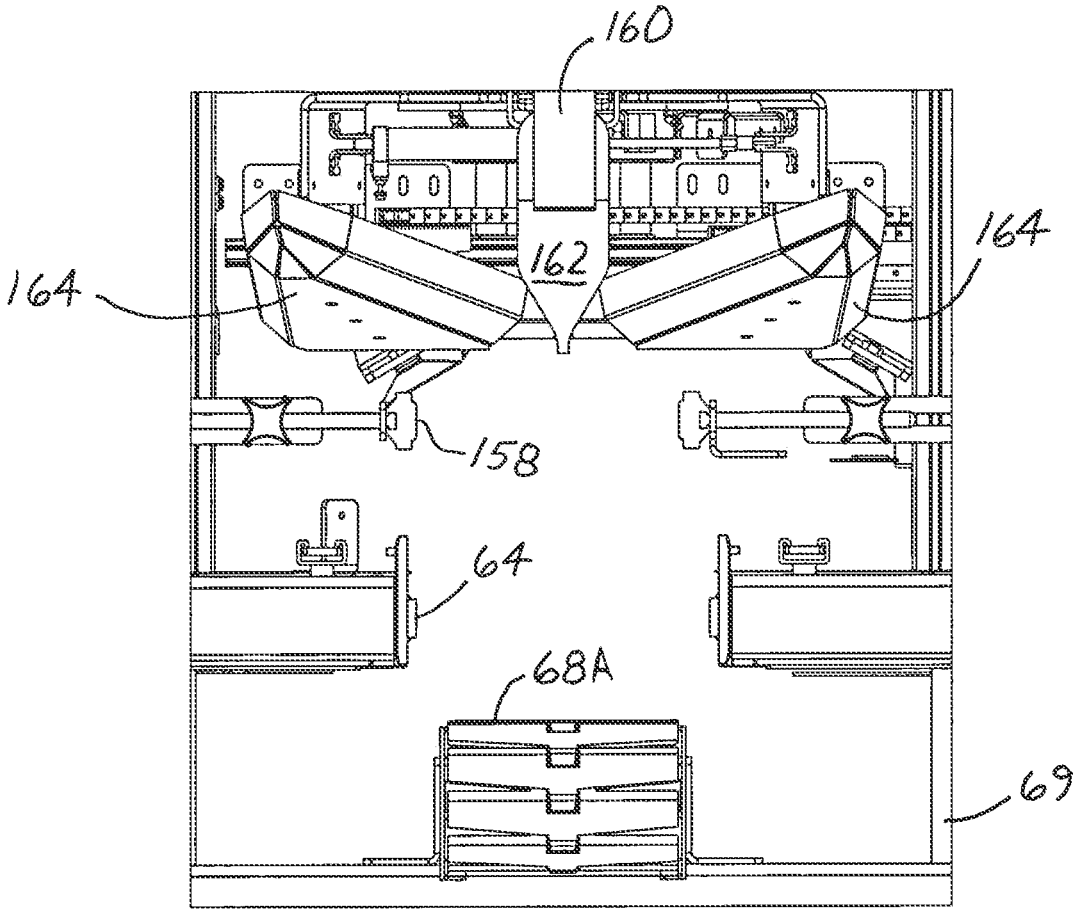
FIG. 23 is a forward-looking perspective elevation view from one end of the flap conditioner of FIG. 22 according to the disclosure.

FIG. 22 shows partially closed boxes 18 being conveyed into the flap conditioner 70 through an inlet 69. And infeed brake 66 is utilized in combination with sensing devices (not shown) positioned throughout flap conditioner 70 to regulate the flow of partially closed boxes into the flap conditioner 70. As shown in FIGS. 23-26, once partially closed box 18 is conveyed into flap conditioner 70, and further guided/supported by side conveyors 64 and guides 158, 159, front flap 21*a* abuts and is inwardly folded about its flap crease 76 and secured in the inwardly folded position by flap folding device 162, resembling a curved profile. Flap folding device 162 extends substantially to outlet 71. Approximately simultaneously, rear flap 21*b* is abutted and inwardly folded about its flap crease 76 by flap folding device 160 which employs a reciprocating rotational movement 161. Once flap folding device 160 has inwardly folded rear flap 21*b*, flap folding device 162 then abuts flap folding device 162 and similarly secures flap 21*b* in its inwardly folded position as partially closed box 18 is conveyed along conveyor 68A.

Figure 24:
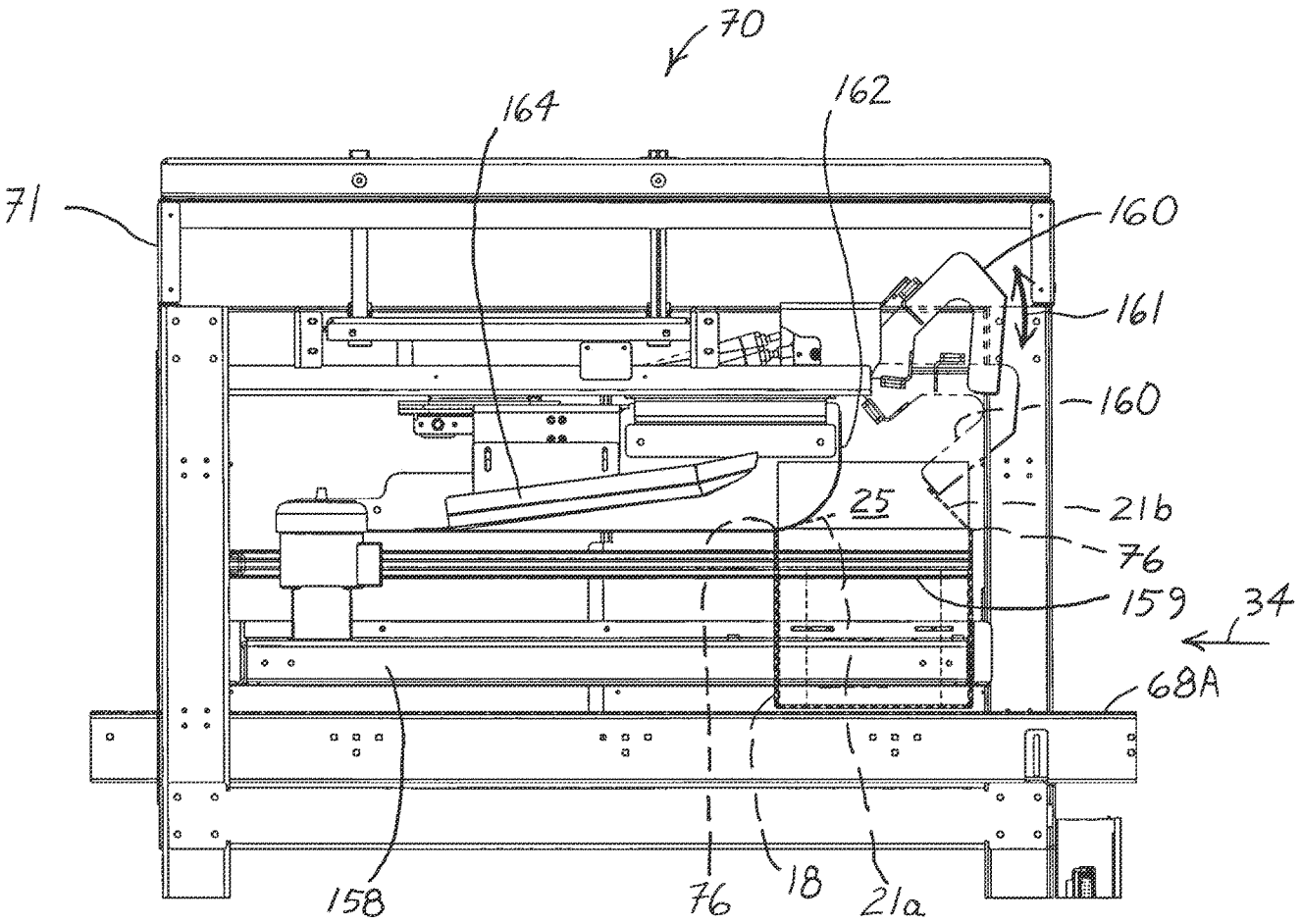
FIG. 24 is an elevation view from one side of the flap conditioner FIG. 22 according to the disclosure.
Figure 25:
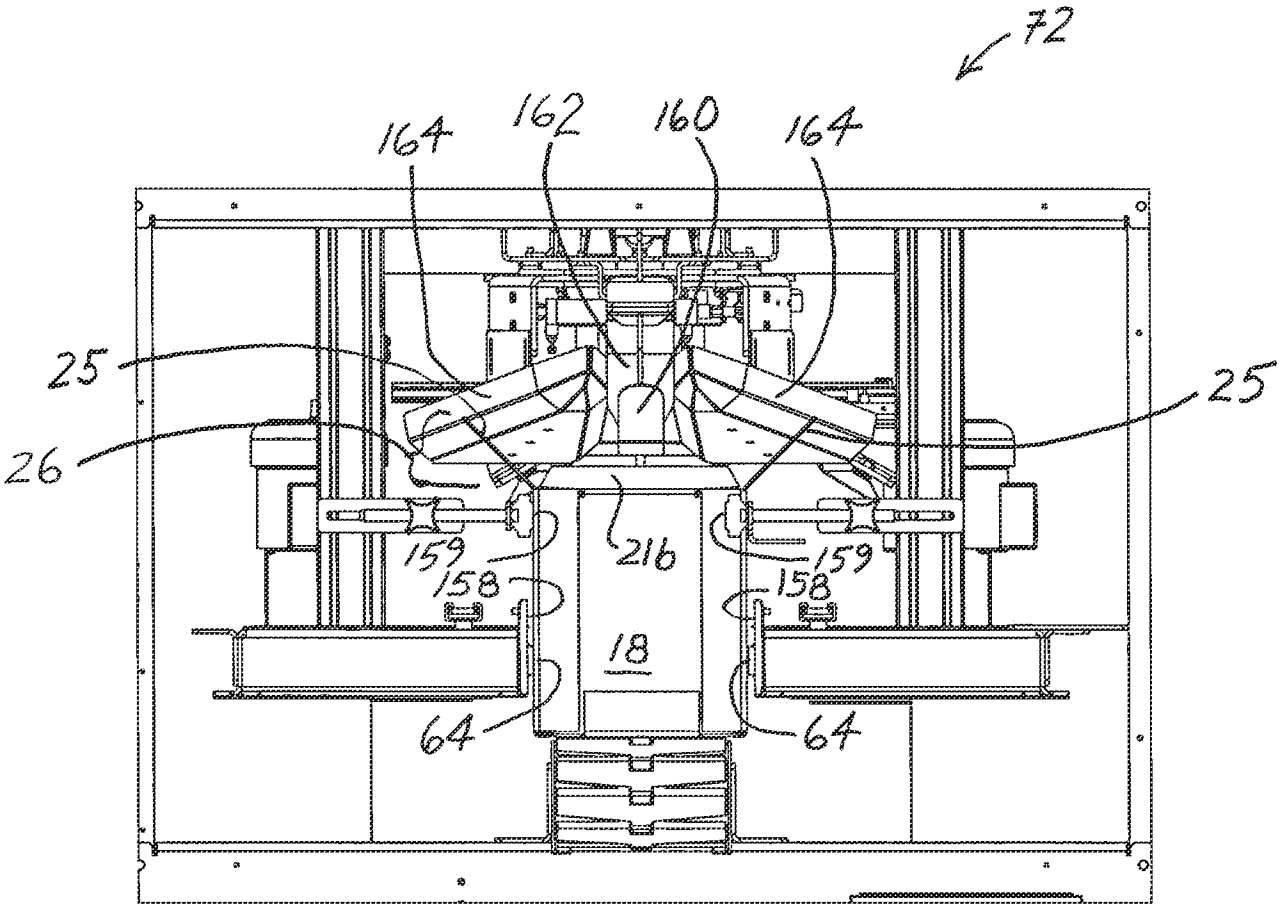
FIG. 25 is a forward-looking elevation view from one end of the flap conditioner of FIG. 22 in a first mode according to the disclosure.
Figure 26:
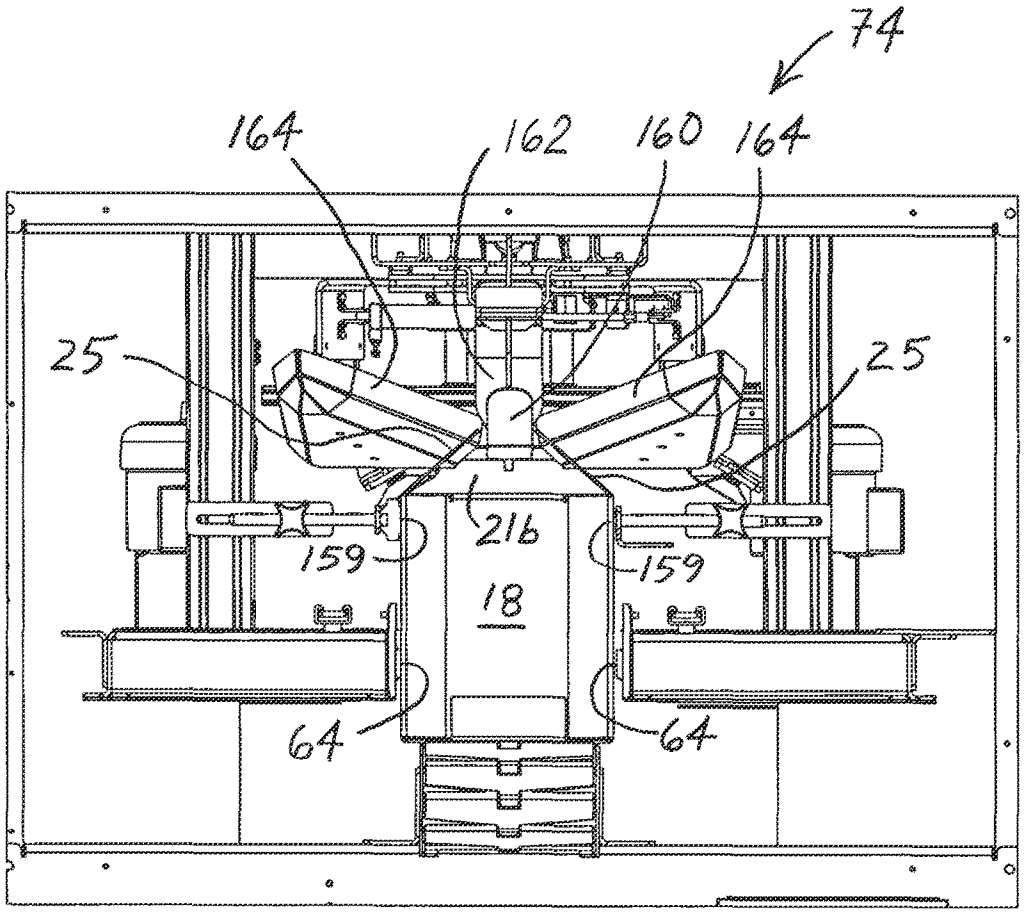
FIG. 26 is a forward-looking elevation view from one end of the flap conditioner of FIG. 22 in a second mode according to the disclosure.

As further shown in FIGS. 24-26, partially closed box 18 is further conveyed along conveyor 68A and the remaining extended opposed flaps 25 of pair of flaps 26 each abuts lateral flap folding device 164. As further shown in FIG. 25, lateral flap folding device 164 is configured to operate in a first mode 72, which outwardly folds flaps 25 of pair of flaps 26 about their respective flap creases relative to an unfolded position. In one embodiment, guide 159 substantially coincides with the flap creases of flaps 25, improving the quality of the resulting fold lines of flaps 25. As further shown in FIG. 26, lateral flap folding device 164 is also configured to operate in a second mode 74, which inwardly folds flaps 25 of pair of flaps 26 about their respective flap creases relative to an unfolded position.

Figure 81:
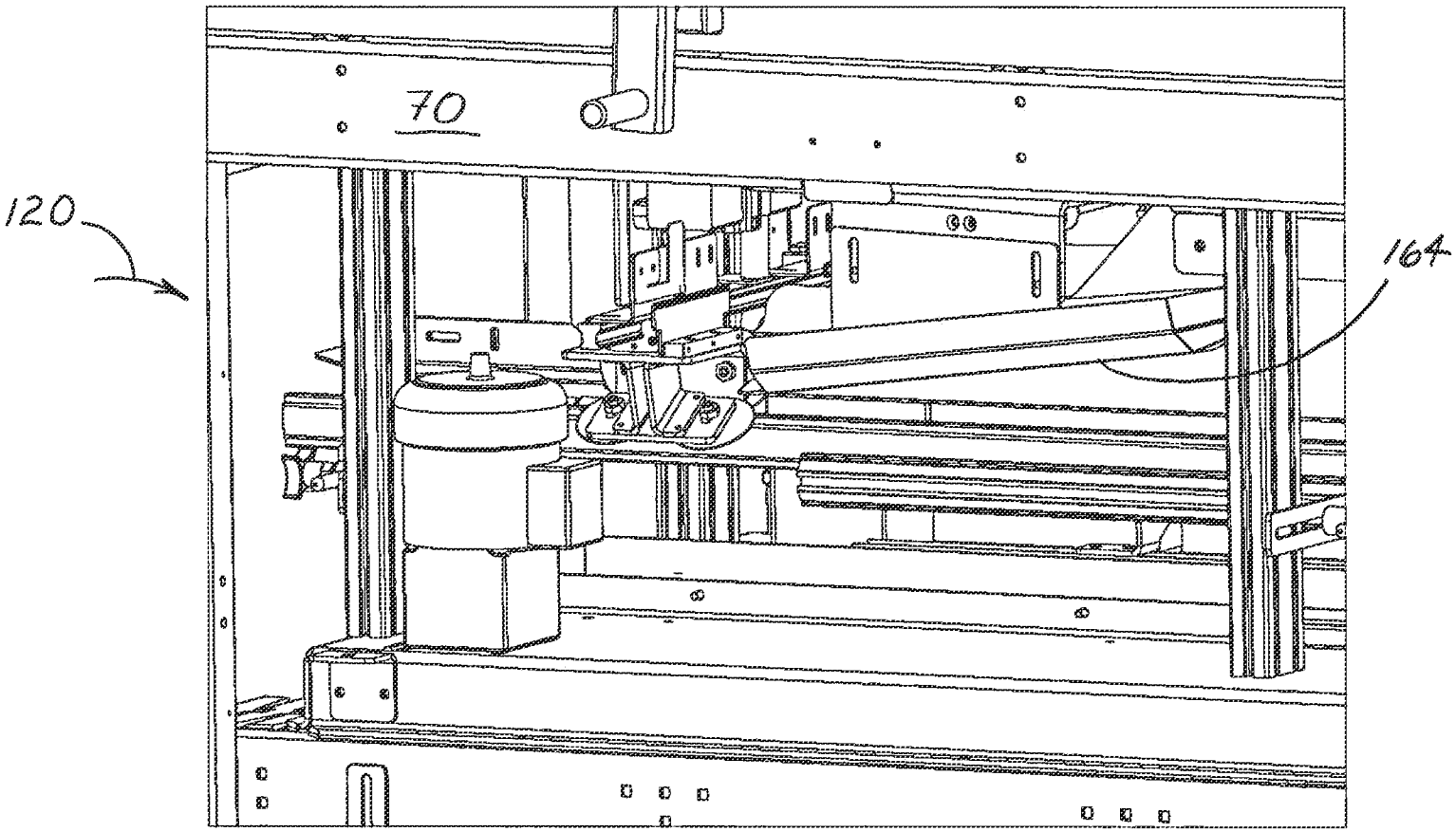
FIG. 81 is an exemplary embodiment of a lateral flap folding device according to the disclosure.
Figure 82:
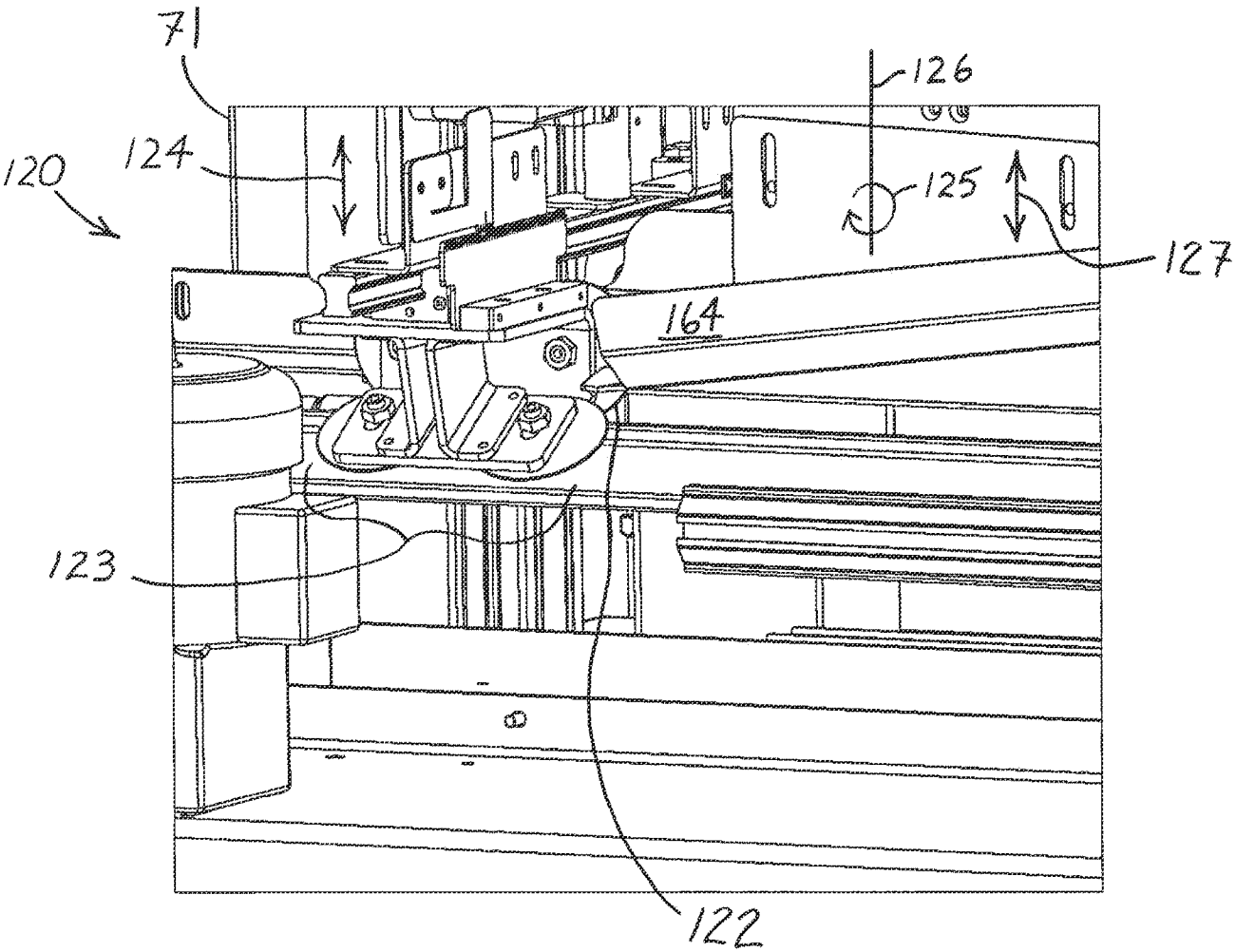
FIG. 82 is an enlarged, partial view of the lateral flap folding device of FIG. 81 according to the disclosure.
Figure 83:
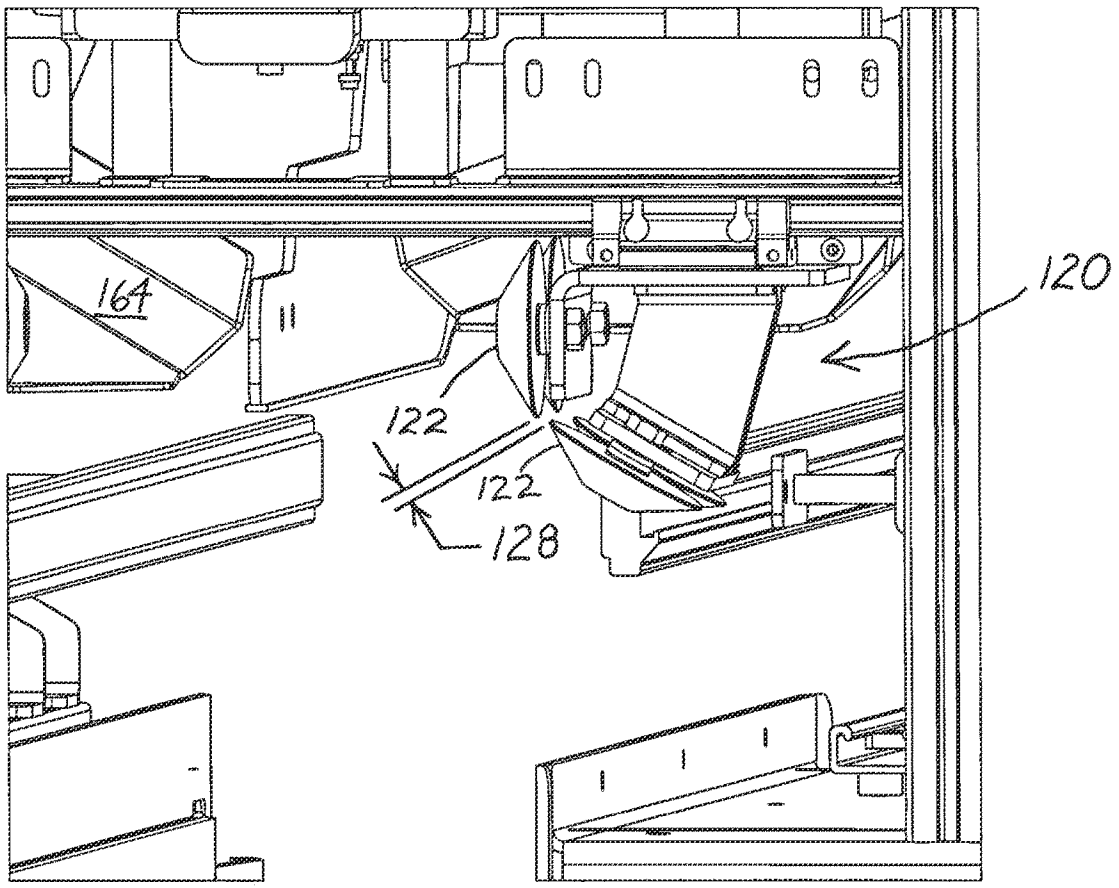
FIG. 83 is a forward-looking elevation view of an exemplary lateral flap folding device of a flap conditioner according to the disclosure.

As yet further shown in FIGS. 81-83, lateral flap folding device 164 includes a roller assembly 120 positioned between lateral flap folding device 164 and outlet 71 of the flap conditioner 70. Roller assembly 120 includes a plurality of rollers 122 positioned at an angle 121 to one another that can be between an acute angle and an obtuse angle, as desired for best results. As further shown in FIG. 82, roller assembly 120 includes a pair of sets of rollers 123, the sets of rollers 123 shown as a pair of rollers were 122 and FIG. 82, although in another embodiment, a set of rollers 123 can comprise more than a pair of rollers 122. As further shown in FIG. 82, roller assembly 120 can be selectively positioned along movement direction 124. That is, in first mode 72 (FIG. 25), roller assembly 120 is in a raised position along movement direction 124 such that roller assembly 120 does not contact the partially folded box 24 as the partially folded box 24 is conveyed past the roller assembly 120. In second mode 74 (FIG. 26), roller assembly 120 is in a lowered position along movement direction 24 such that roller assembly 120 makes contact with partially folded box 24 as the partially folded box 24 is conveyed past the roller assembly 120. That is, roller assembly 120 which maintains a gap 128 between angled rollers 122 "pinches" or results in a deformation along the flap crease of each of flaps 25 of flap pair 26. This deformation or treatment 78 of the flaps 25 is sufficient to at least partially reduce the tendency of the flaps 25 to return to the extended (unfolded) position. However, for purposes of this disclosure, partially folded boxes 24 subjected to either first mode 72 or second mode 74 are still identified as partially folded boxes. Although both first and second modes 72, 74 can be used to produce partially folded boxes 24, second mode 74 can be especially advantageously used with stiff, multi-wall boxes.

As further shown in FIG. 82, lateral flap folding device 164 is positioned differently in first mode 72 relative to second mode 74. That is, in first mode 72, lateral flap folding device 164 is urged in at least one of rotational movement 125 about an axis 126 and/or in movement direction 127 such that flaps 25 of flap pair 26 are folded outwardly relative to an unfolded position. In contrast, in second mode 74, lateral flap folding device 164 is urged in at least one of rotational movement 125 about an axis 126 and/or in movement direction 127 such that flaps 25 of flap pair 26 are folded inwardly relative to an unfolded position. Additionally, in second mode 74, roller assembly 120 provides an additional treatment along the flap crease of each of flaps 25 of flap pair 26 as previously discussed.

Figure 28A:
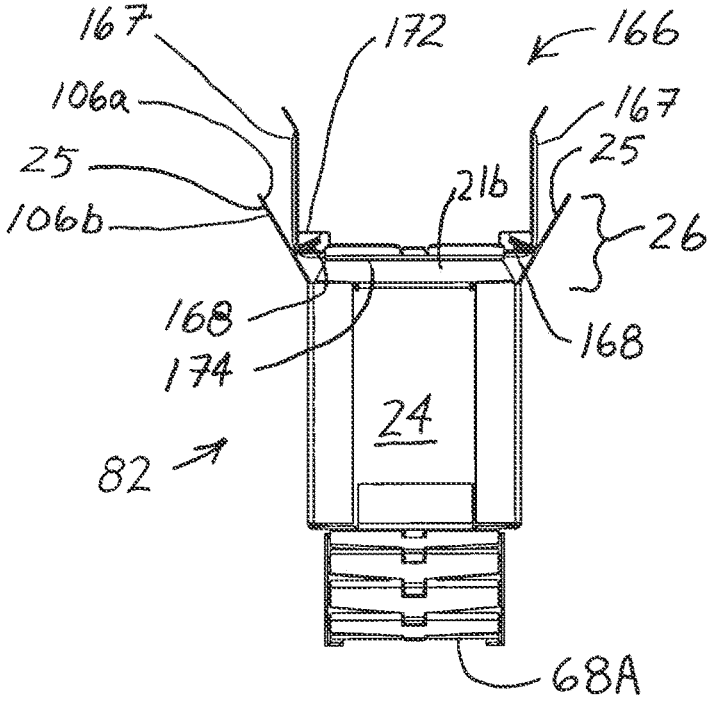
FIGS. 28A and 28B are elevation views taken along line 28-28 of FIG. 27 of partially folded boxes received from a first mode and a second mode, respectively, from a flap conditioner according to the disclosure.

FIG. 27 shows staging area 80 having a first portion 82 for receiving partially folded boxes 24 from flap conditioner 70, and a second portion 84 associated with receiving inverted first fully folded boxes 32 as previously discussed in FIGS. 6-10. Staging area 80 includes a guide/support 166 having generally L-shaped guide/support portions 167 including a substantially laterally extending flange 174 and an enclosure or corner fitting 172. Extending outwardly opposite corner fitting 172 are angled rollers 168. FIG. 28A, which is a forward looking elevation view taken along line 28-28 of FIG. 27, shows partially folded box 24 positioned in first portion 82 of staging area 80. In FIG. 28A, partially folded box 24 has been discharged from flap conditioner 70 operating in first mode 72, as flaps 25 of flap pair 26 are outwardly folded relative to an unfolded position. Opposed surfaces 106*a* of flaps 25 are rollably supported and maintained in a slightly outwardly folded position by rollers 168 extending from guide/support portions 167. As further shown in FIGS. 29-30, a vertical positioning assembly 170 includes a crank 171 that can be used to adjust vertical position of each guide/support portion 167 of guide support 166.

Figure 28B:
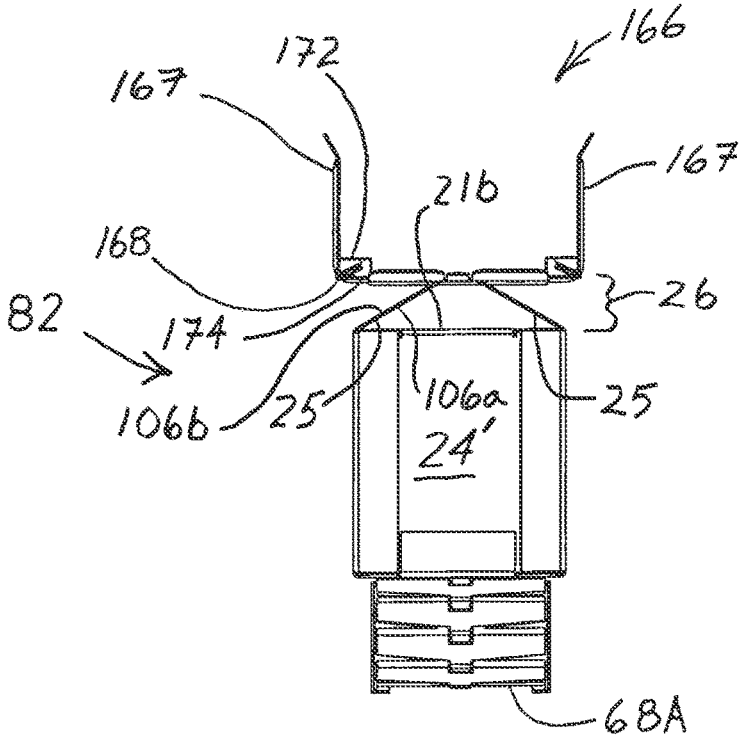

FIG. 28B, which is also a forward-looking elevation view taken along line 28-28 of FIG. 27, shows partially folded box 24 positioned in first portion 82 of staging area 80. In FIG. 28A, partially folded box 24 has been discharged from flap conditioner 70 operating in second mode 74, as flaps 25 of flap pair 26 are inwardly folded relative to an unfolded position. Opposed surfaces 106*b* of flaps 25 are slidably supported and maintained in a slightly inwardly folded position by flanges 174 extending toward each other from opposed guide/support portions 167. Partially folded boxes 24 that are positioned in first portion 82 of staging area 80 will be maintained in first portion 82 until reaching and access opening 83 (FIG. 29) formed near the junction with stacking area 90. A number of partially folded boxes 24, are preferably, but not necessarily limited to partially folded boxes 24' (discharged from flap conditioner 70 operating in second mode 74) as shown in FIG. 28B. Partially folded boxes 24 will be extracted via access opening 83 by device 102, such as a robotic arm that subsequently manipulates and otherwise transforms partially folded box 24 into inverted first fully folded box 32 that is placed by device 102 onto a transport platform 176. An infeed brake 184 (FIG. 30) is positioned upstream of (relative to conveyance direction 34 of conveyor 68A) in close proximity to access opening 83 (guide rail 182 terminating prior to access opening 83) to prevent inadvertent movement of partially folded boxes 24 into access opening 83. Transport platform 176 is positioned in second portion 84 of staging area 80 and supported by opposed guide/support portions 167. As further shown in FIG. 29, transport platform 176 includes a base 177 that includes an opening 178 configured to receive a mating feature of device 102 for delivering inverted first fully folded boxes 32 into stacking area 90. The number of partially folded boxes 24 (discharged from flap conditioner 70 operating in first mode 72) as shown in FIG. 28A are conveyed the length of first portion 82 of staging area 80 along conveyor 68A, and then selectively urged into stacking area 90. A "pop-up" stop 232, when actuated to an extended position 233 prevents inadvertent movement of partially folded boxes 24 from first portion 82 of staging area 80 to stacking area 90.

Figure 29:
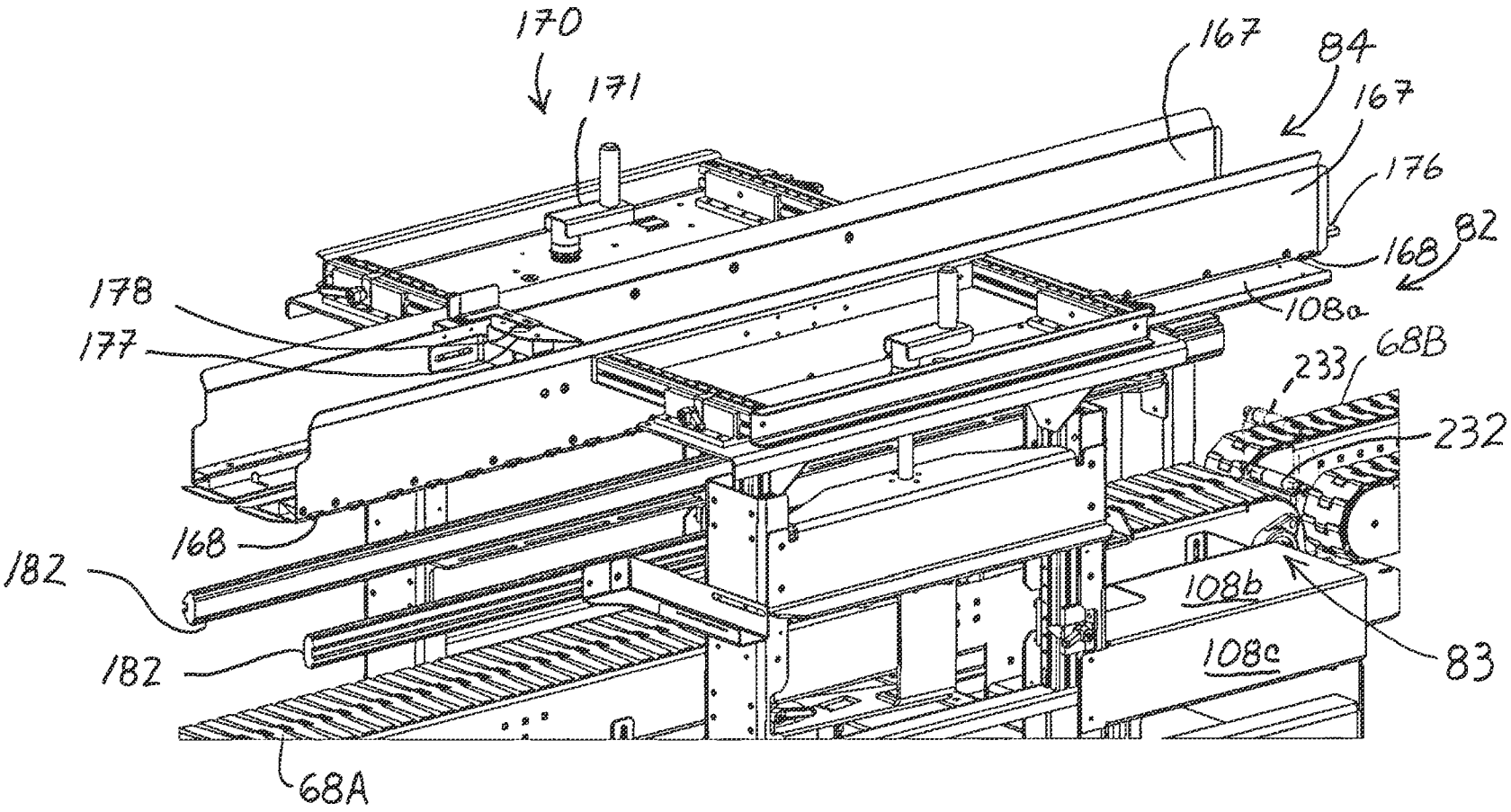
FIG. 29 is an upper perspective view of an exemplary staging area according to the disclosure.
Figure 30:
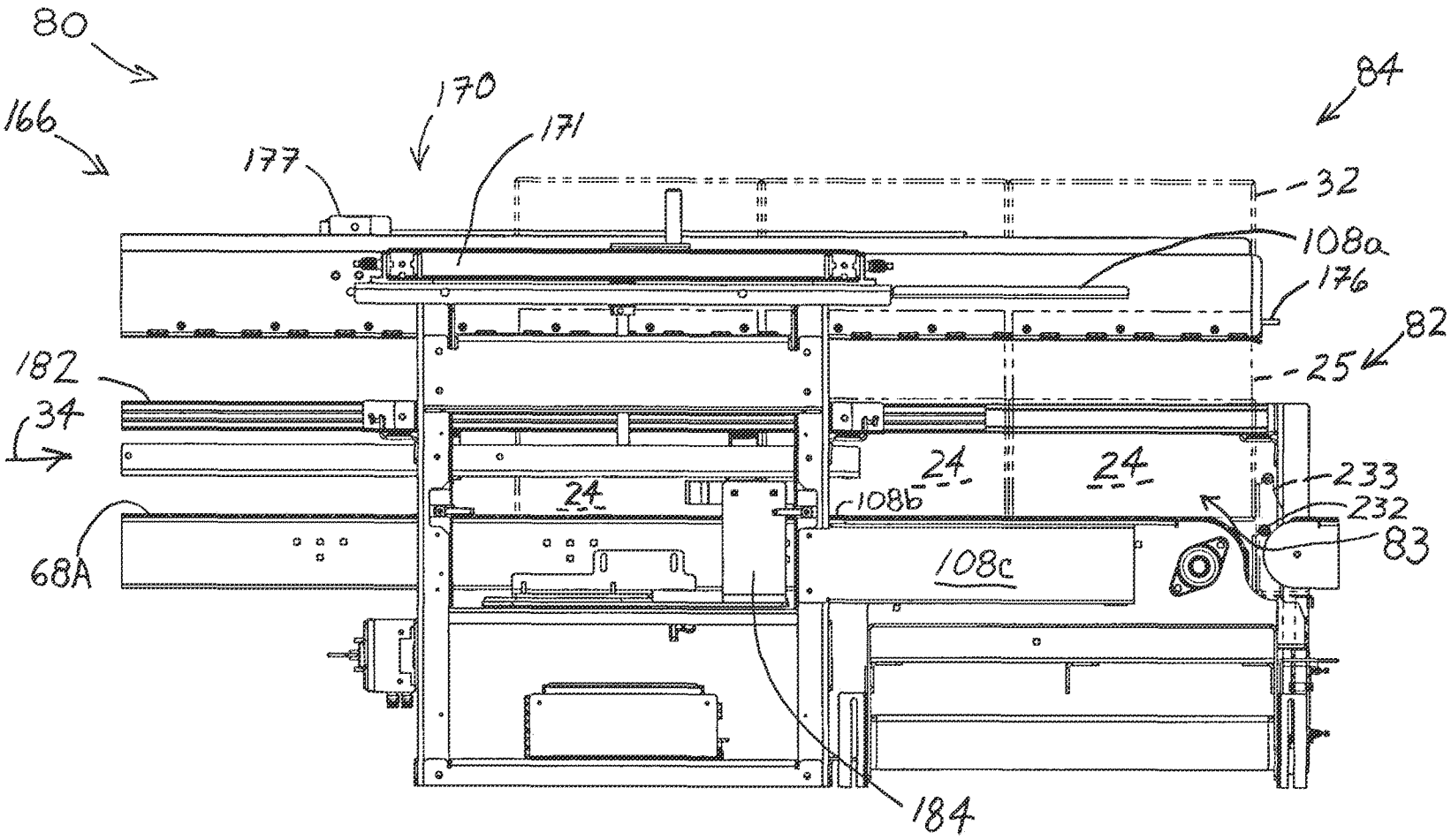
FIG. 30 is an elevation view of an exemplary staging area according to the disclosure.
Figure 31:
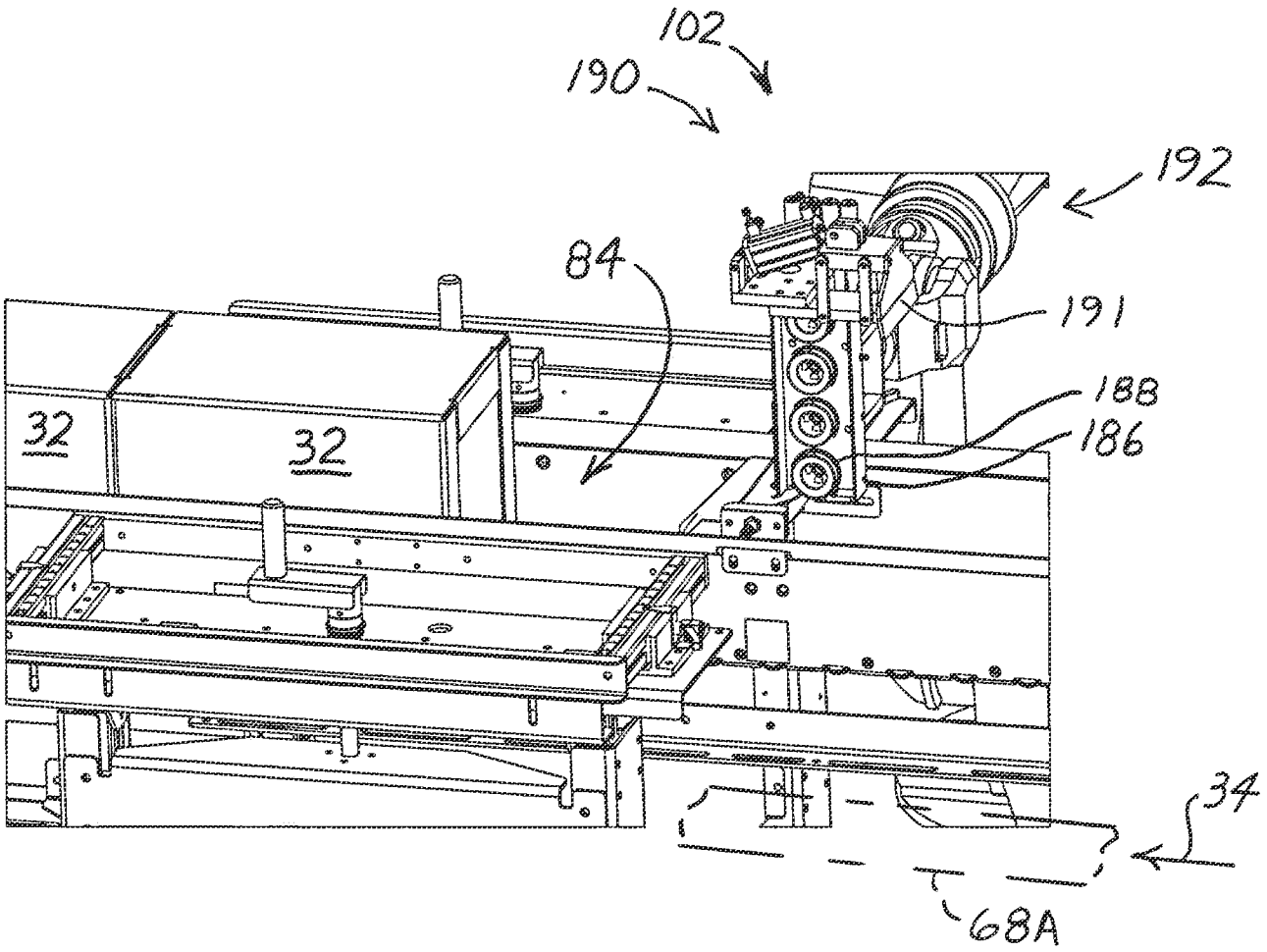
FIG. 31 is an upper perspective view of an exemplary second portion of the staging area and a device and a retracted position for interacting therewith according to the disclosure.
Figure 32:
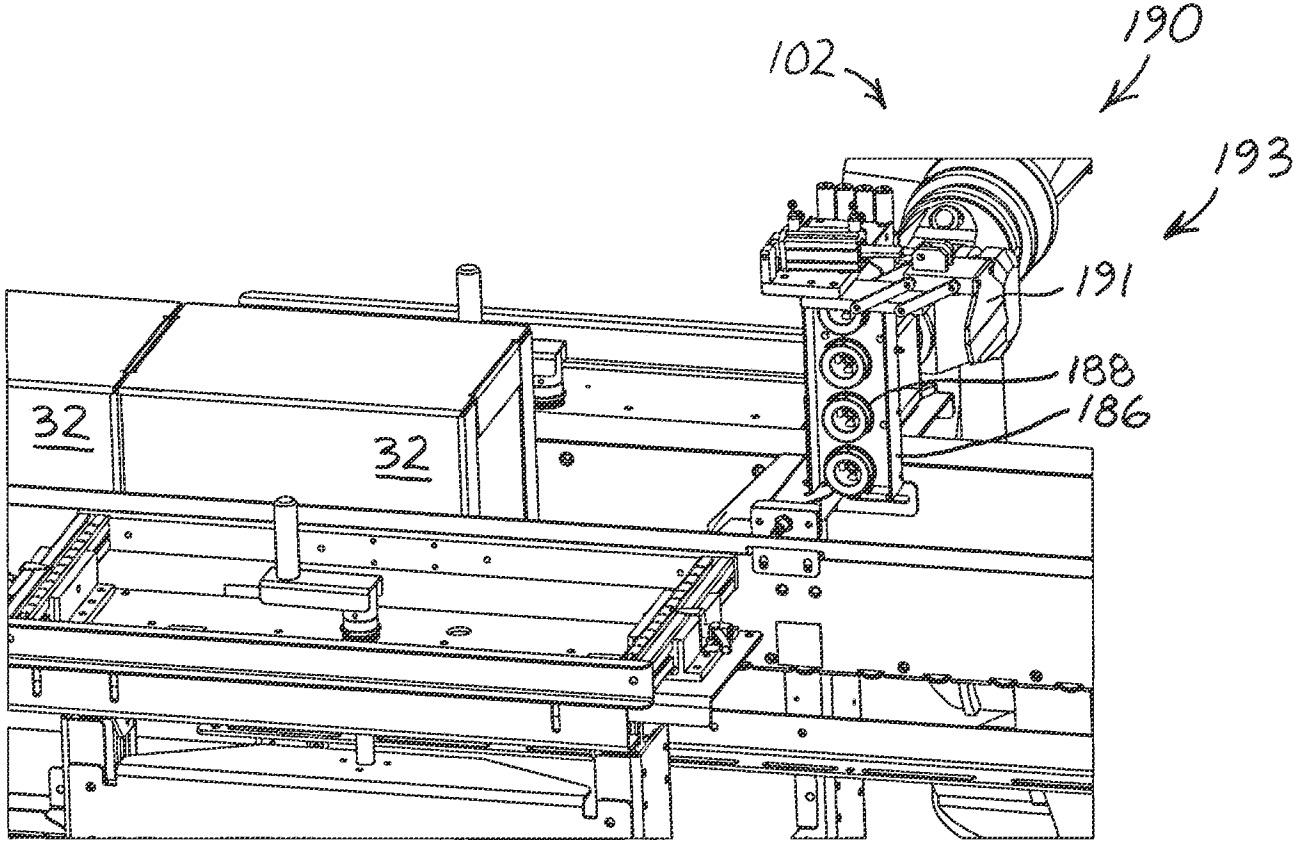
FIG. 32 is an upper perspective view of an exemplary second portion of the staging area and a device and an extended position for interacting therewith according to the disclosure.
Figure 33:
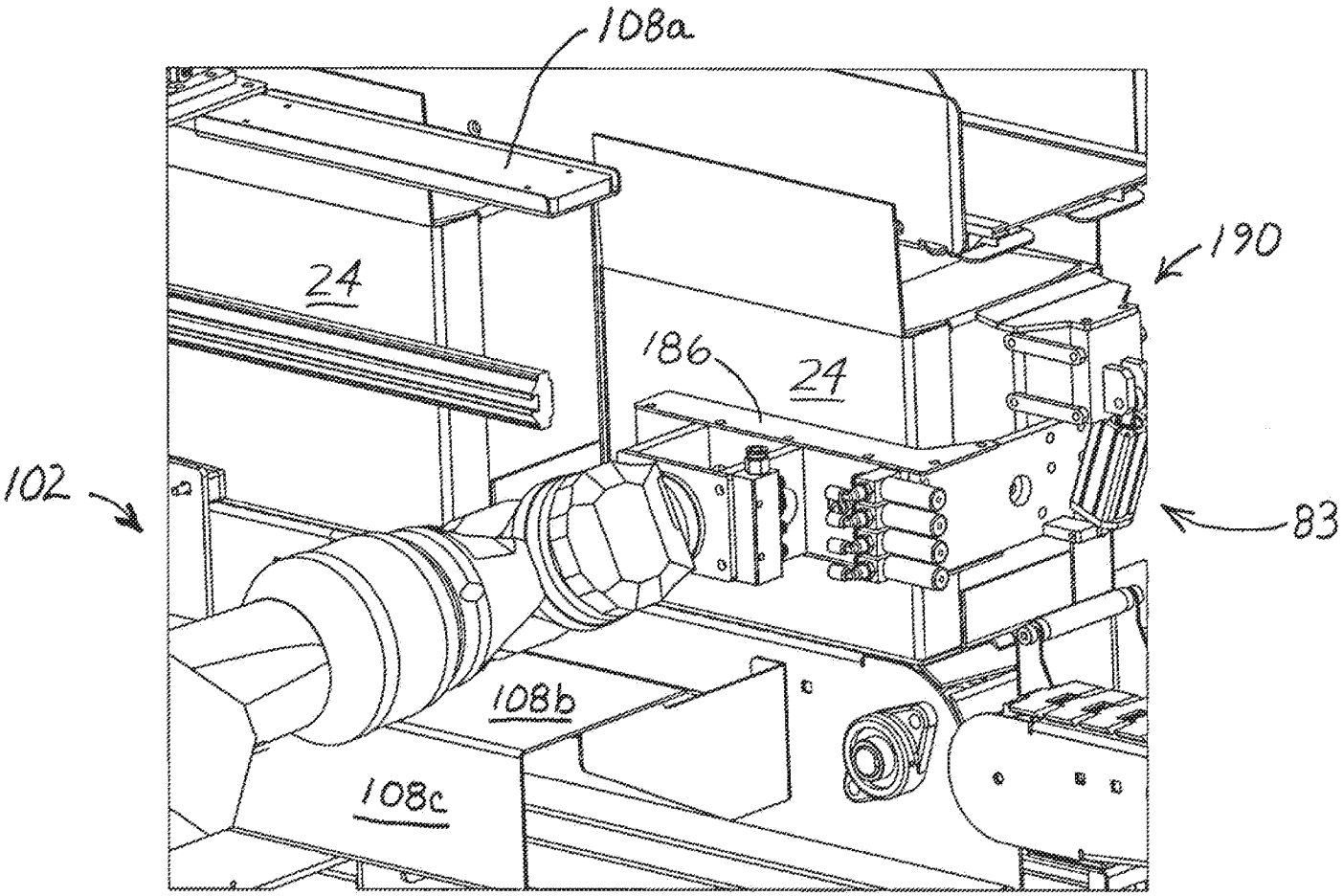
FIG. 33 is an upper perspective view of an exemplary device engaging a partially folded box 24 according to the disclosure.
Figure 34:
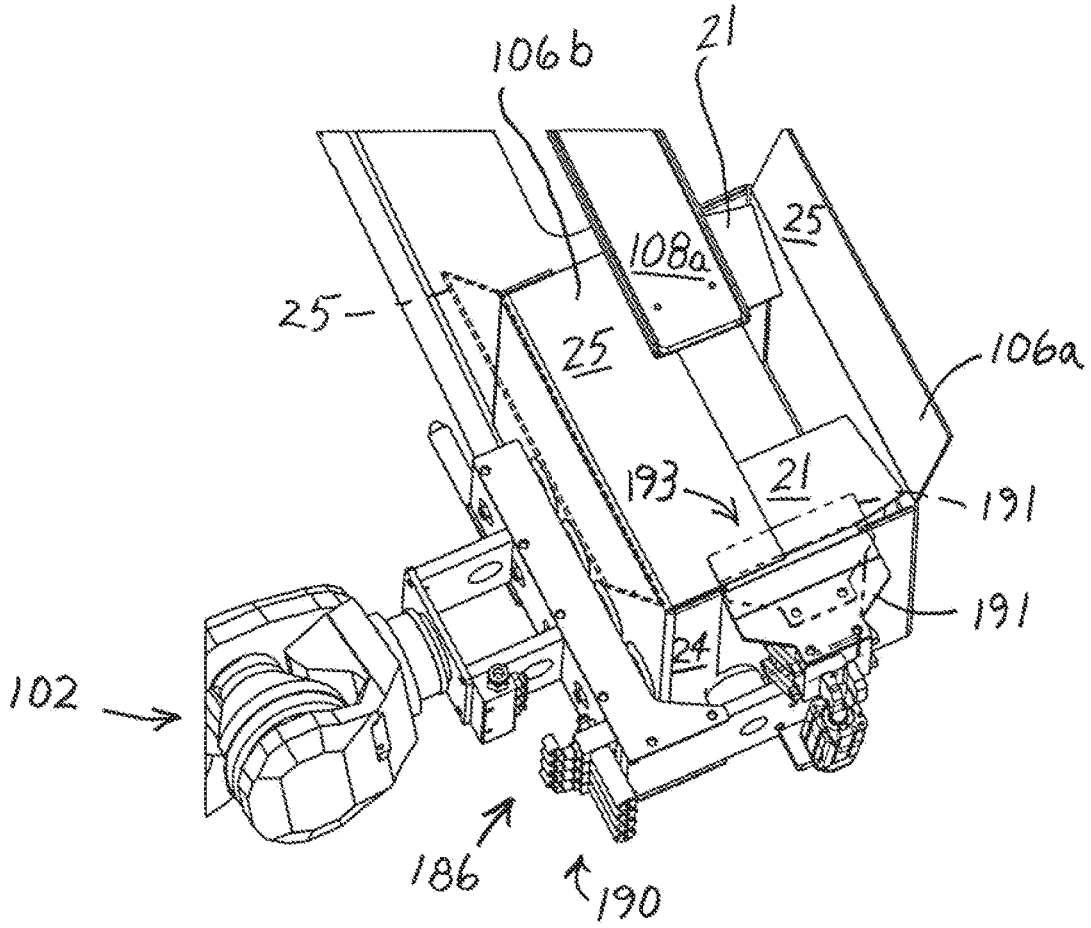
FIGS. 34 and 35 are sequential upper perspective views of the device of FIG. 33 folding flaps of a partially folded box according to the disclosure.
Figure 35:
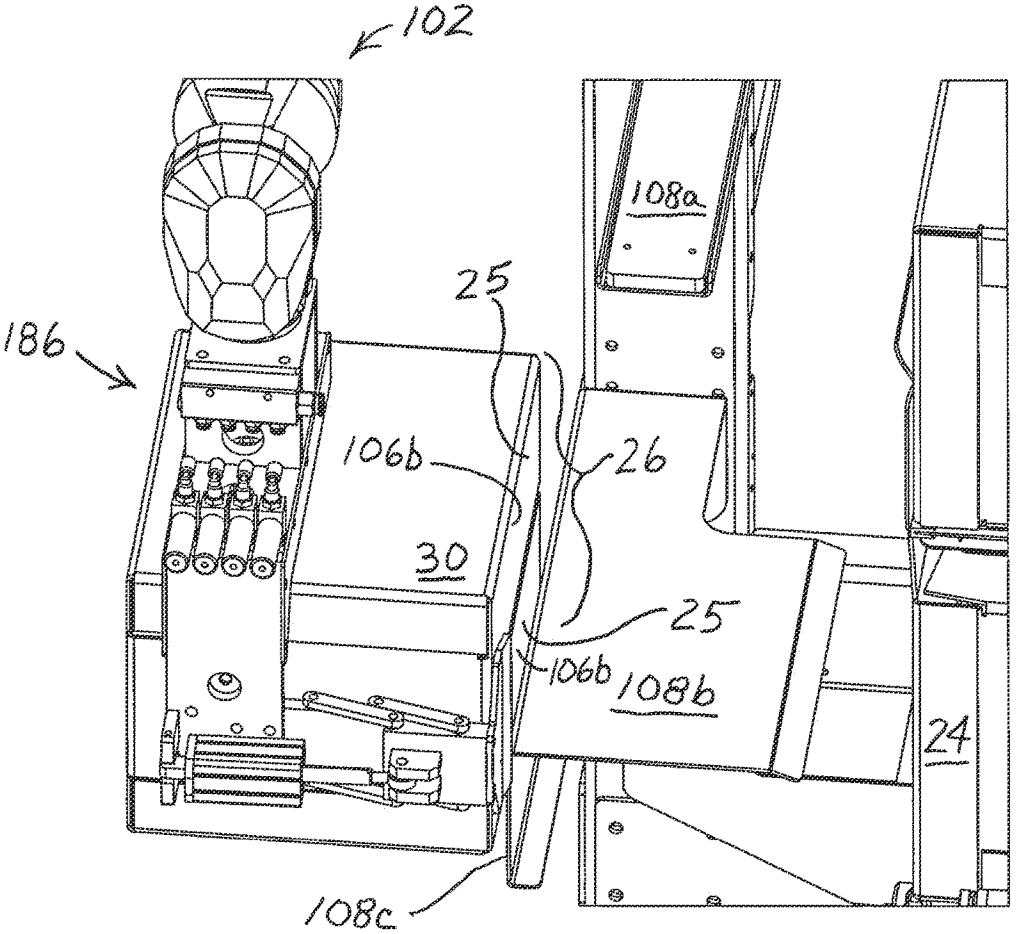

FIGS. 29-38 show movement/transformation of partially folded boxes 24 from first portion 82 of staging area 80 to second portion 84 of staging area 80. FIGS. 31-32 show device 102 (robot arm) including a head 186 having engagement devices 188, such as resilient fittings, such as cupped flanges through which to draw a vacuum for lifting partially folded boxes 24. As further shown in FIG. 31, head 186 further includes a movable retention member 190 including a paddle 191 and shown in a retracted position 192. As further shown in FIG. 32, head 186 shows paddle 191 in an extended position 193, and head 186 further includes opposite retention member 190 a mating feature 189 to be received by opening 178 of transport platform 176 (FIG. 29). FIG. 33 shows head 186 extending into access opening 83 of first portion 82 of staging area 80 and engaging a partially folded box 24. FIGS. 34-35 show device 102 manipulating the partially folded box 24 such that flap 25 is inwardly folded, such as by bringing surface 106*b* of flap 25 into contact with surface 108*a*. After such contact, paddle 191 is urged into extended position 193 to secure flap 25 in a closed position. Next, device 102 is further manipulated such that surface 106*b* of remaining flap 25 is inwardly folded such as by bringing about contact with one or more of surfaces 108*b* 108*c*; during which time paddle 191 is selectably urged between extended position 193 and retracted position 192 provide clearance for the inwardly folded remaining flap 25 and then to capture both flaps 25 in the inwardly folded closed position over already inwardly folded flaps 21, thereby defining a first fully folded box 30.

Figure 36:
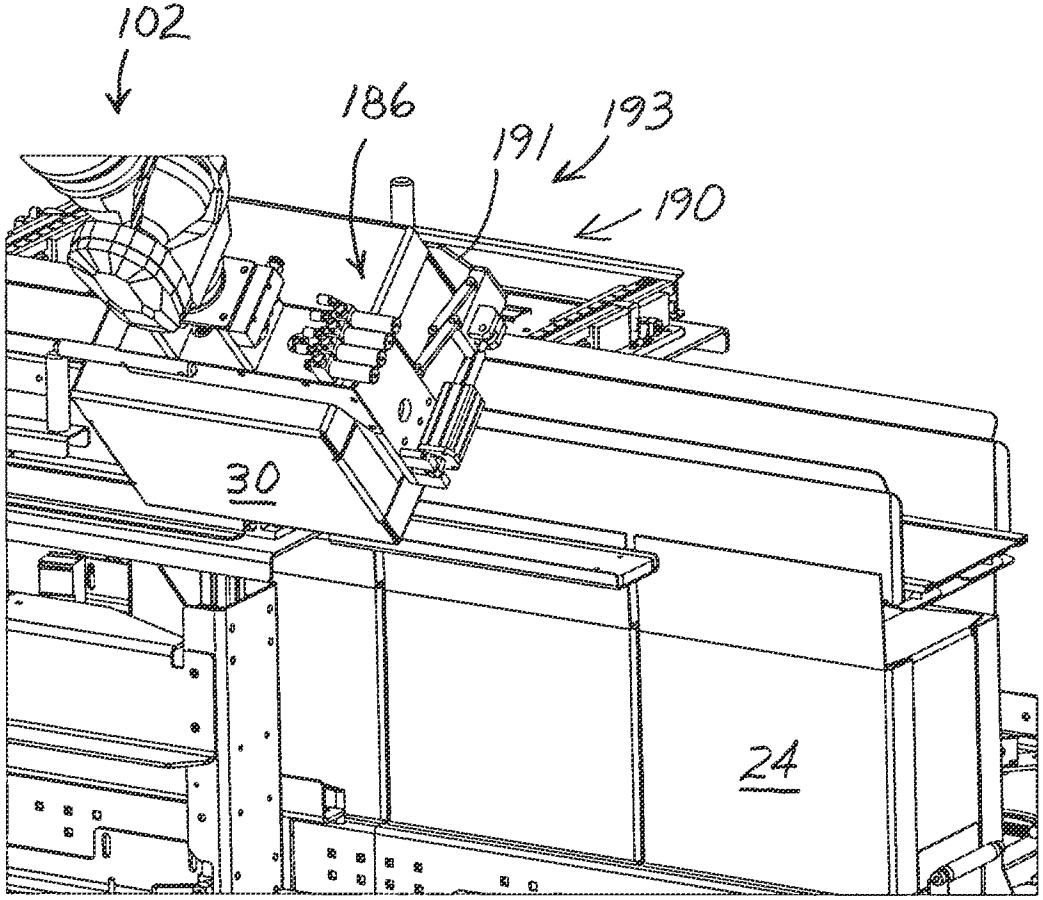
FIGS. 36 and 37 are sequential views of the device of FIG. 33 moving and rotating a fully folded box according to the disclosure.
Figure 37:
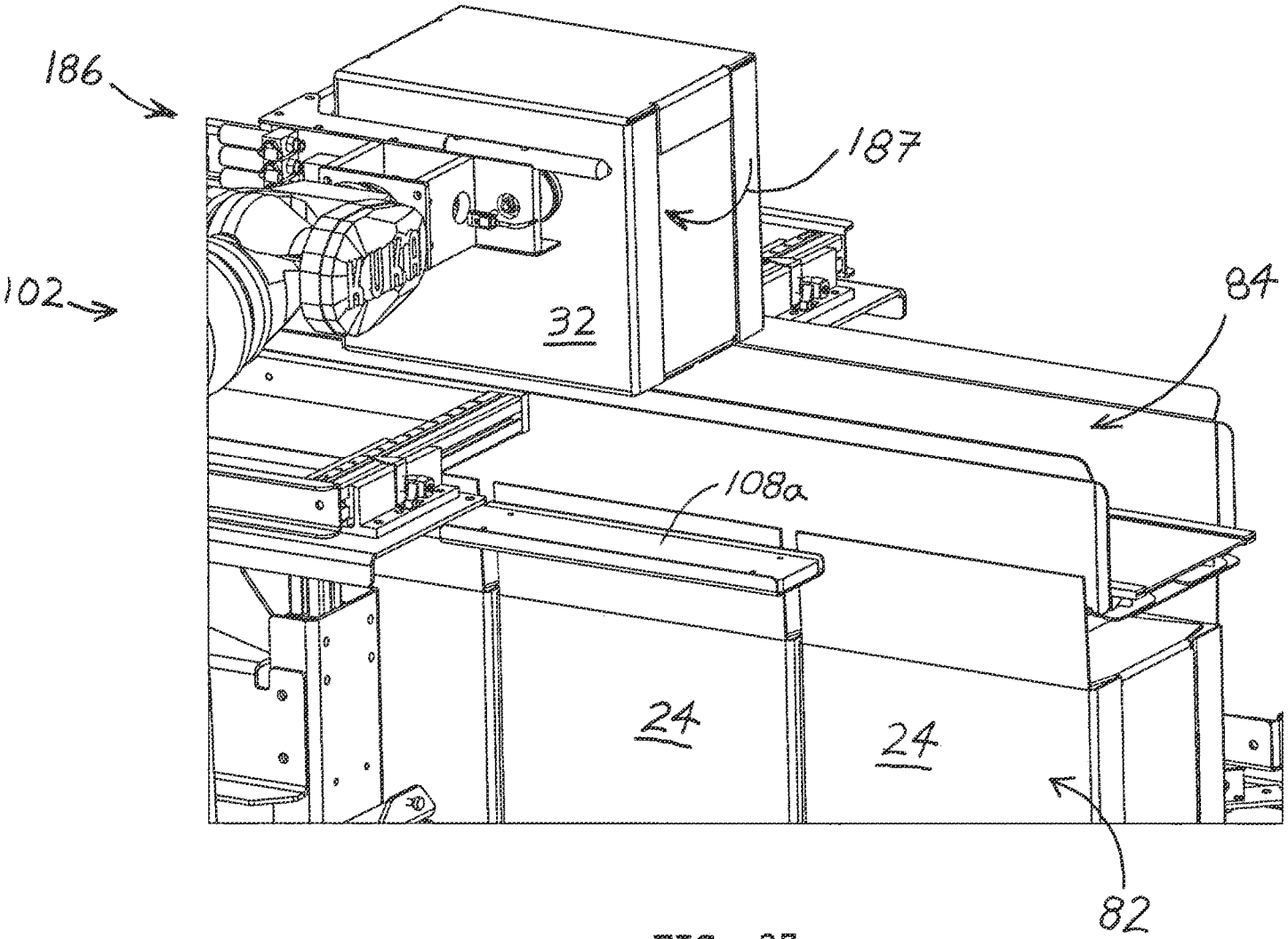
Figure 38:
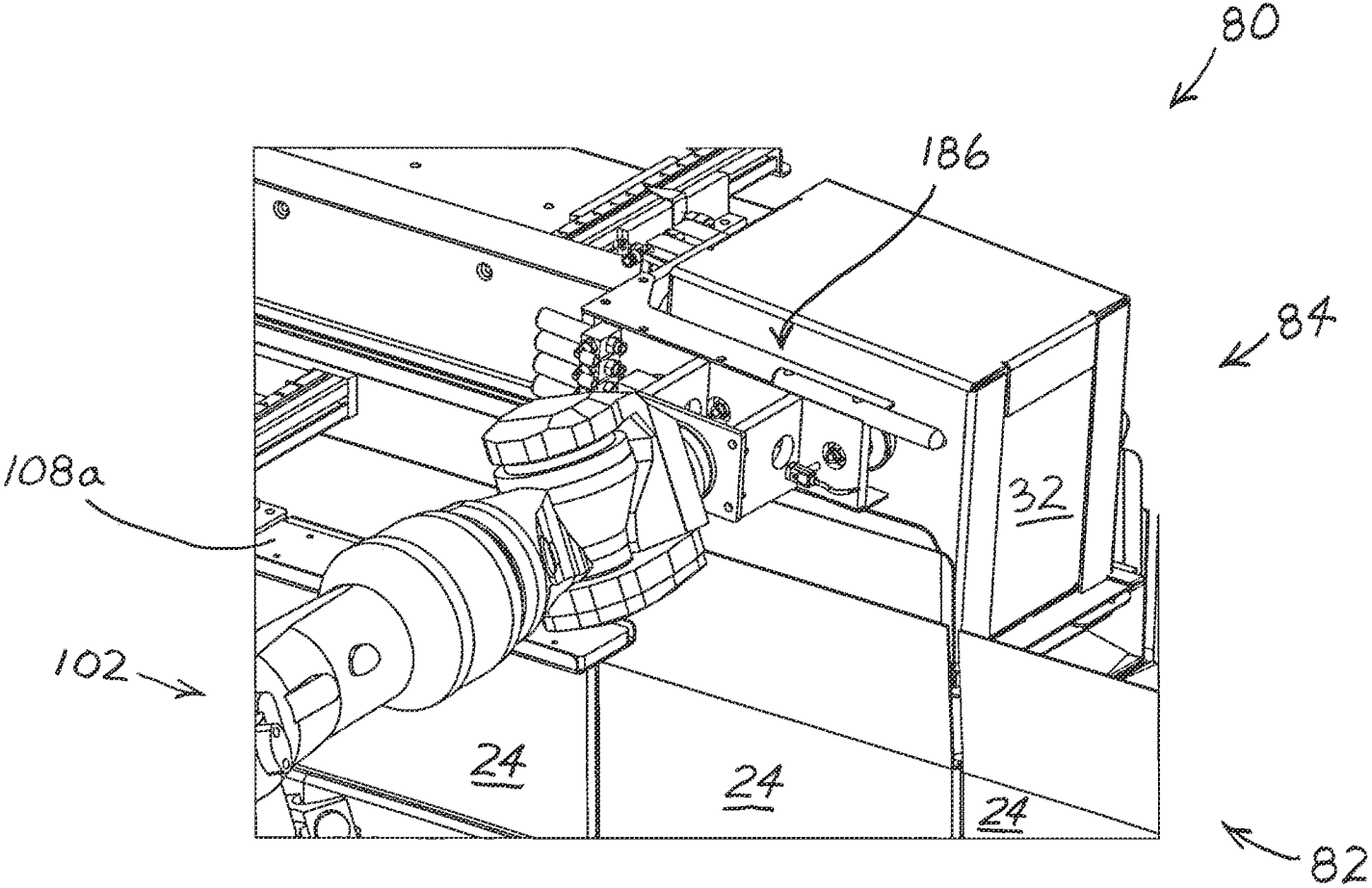
FIG. 38 is an upper perspective view of the device of FIG. 33 placing the inverted fully folded box and the second portion of the staging area according to the disclosure.

FIGS. 36-38 show head 186 of device 102 moving away from folding or contacting surfaces 108*a*, 108*b*, 108*c*, with head 186 imparting a rotational movement 187 on first fully folded box 30, and defining an inverted first fully folded box 32. As further shown in FIG. 38, head 186 places inverted first fully folded box 32 onto second portion 84 of staging area 80.

Figure 39:
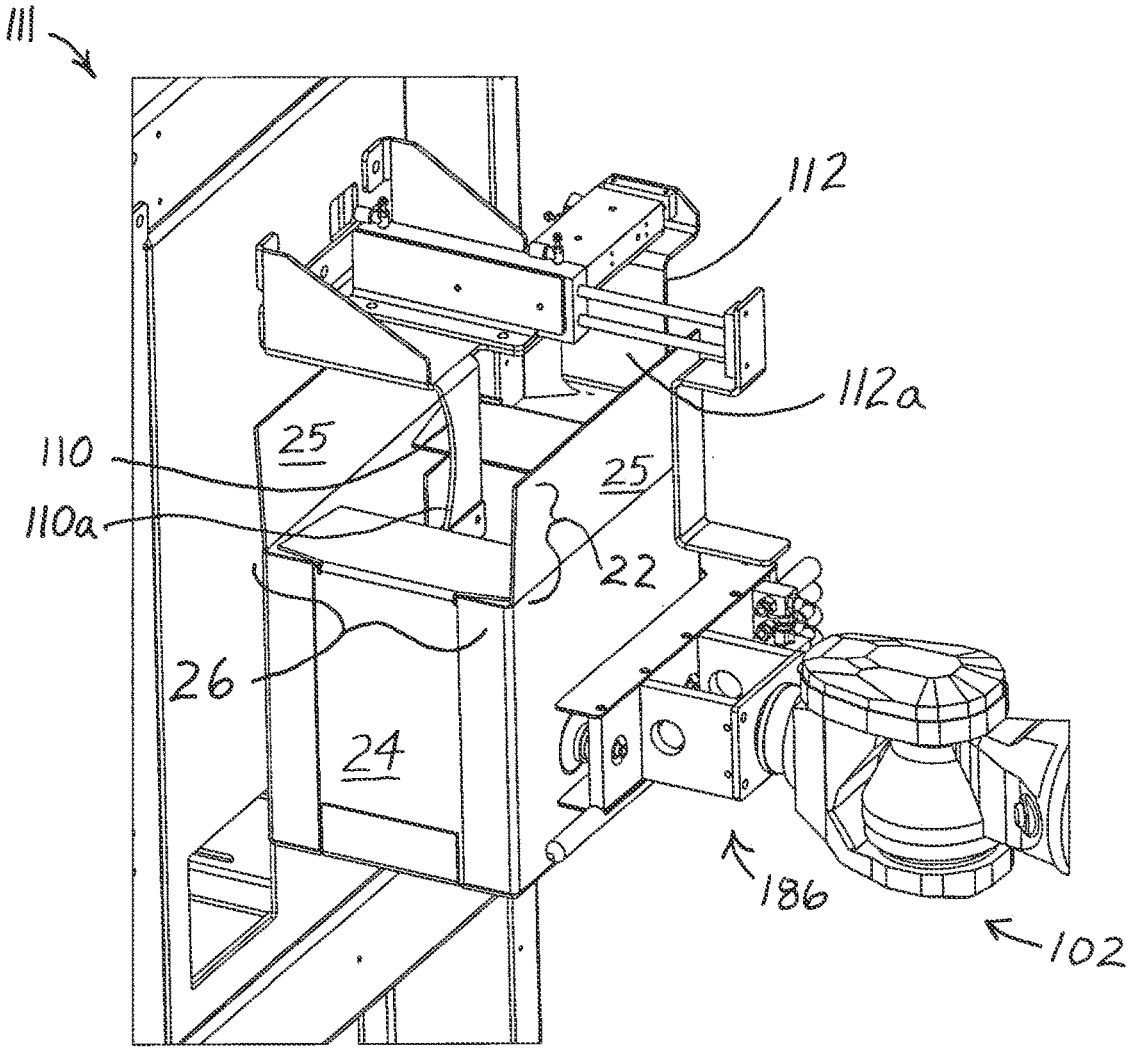
FIGS. 39-43 are sequential upper perspective views of an exemplary flap folding assembly according to the disclosure.
Figure 40:
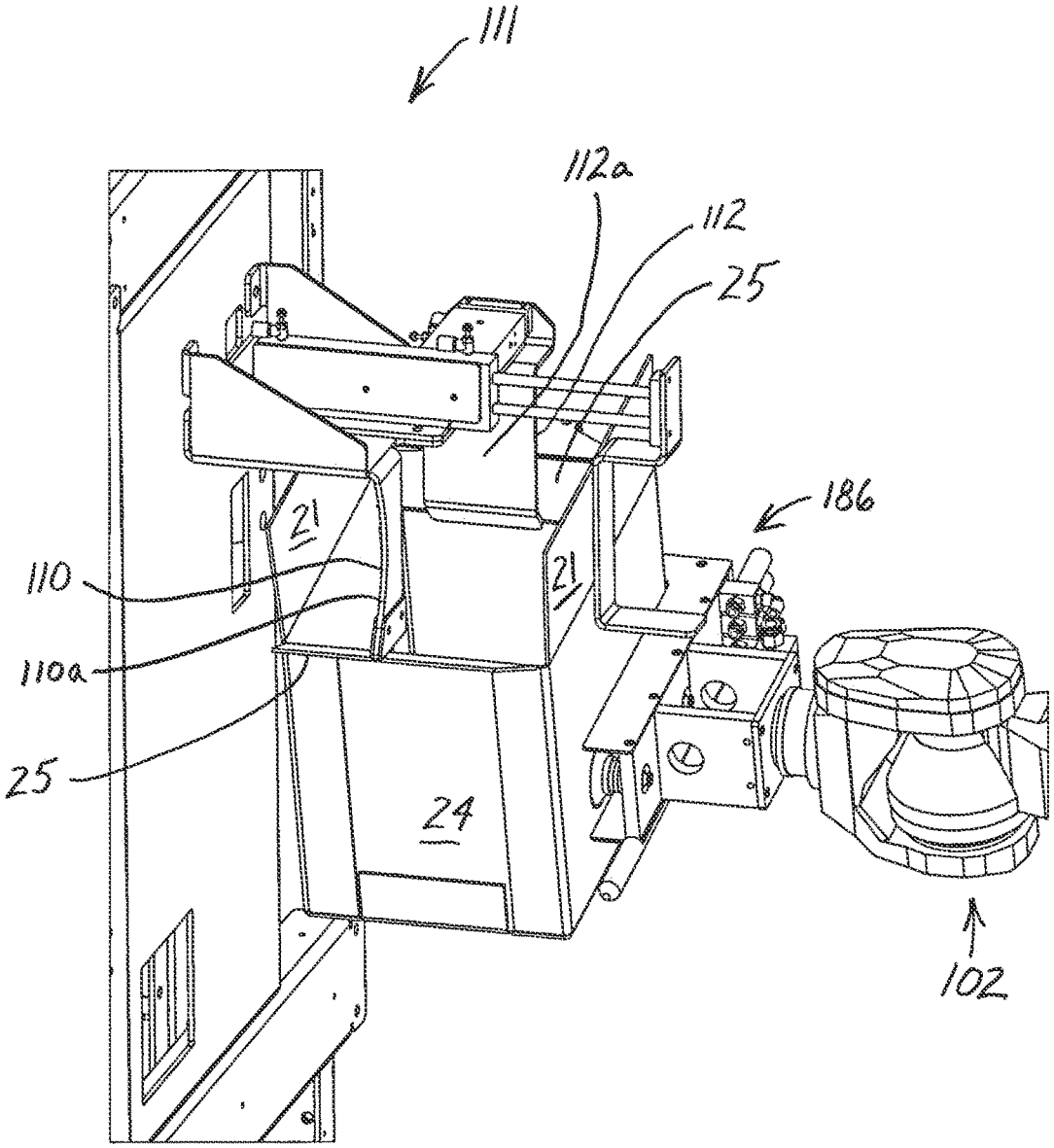
Figure 41:
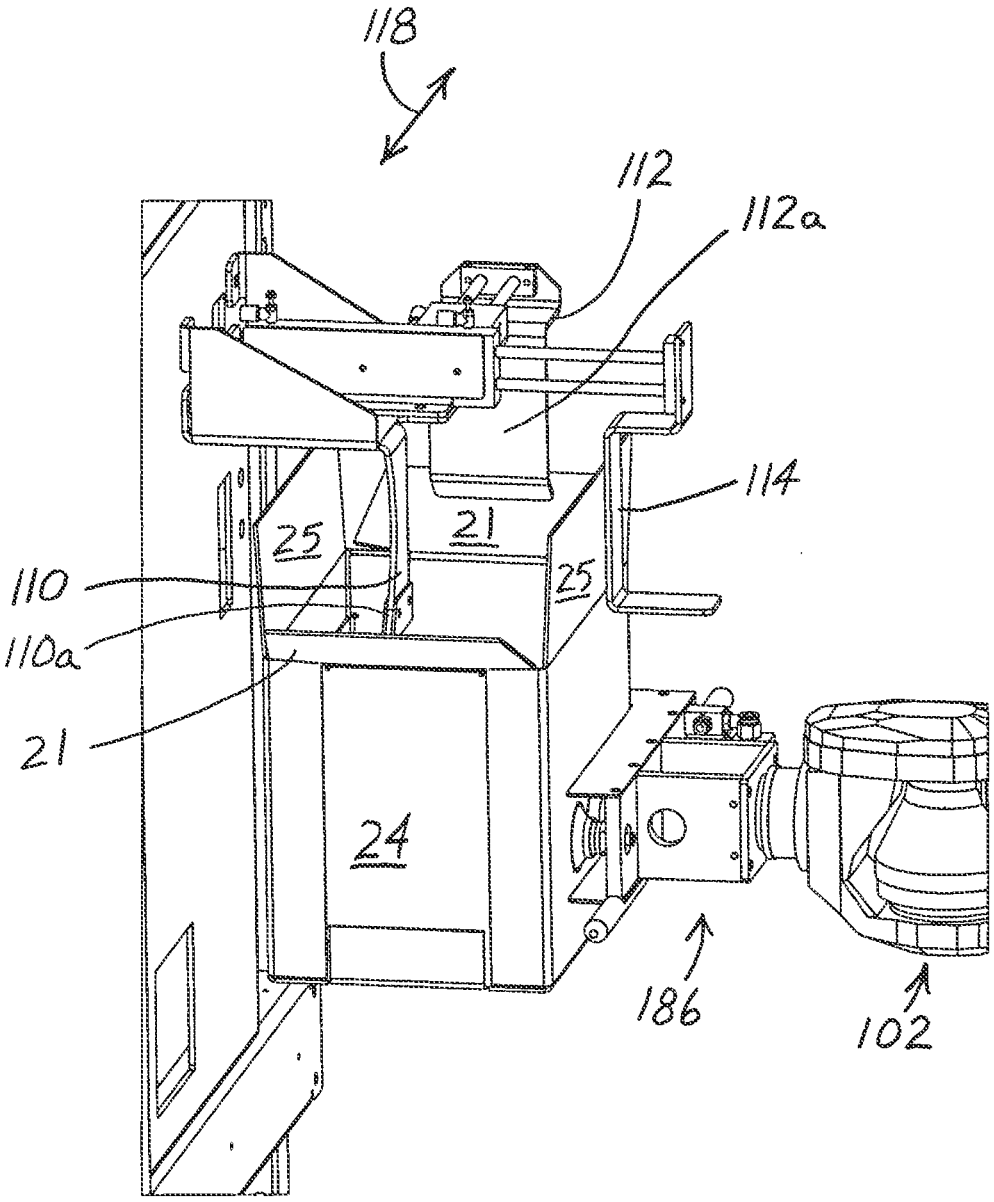
Figure 42:
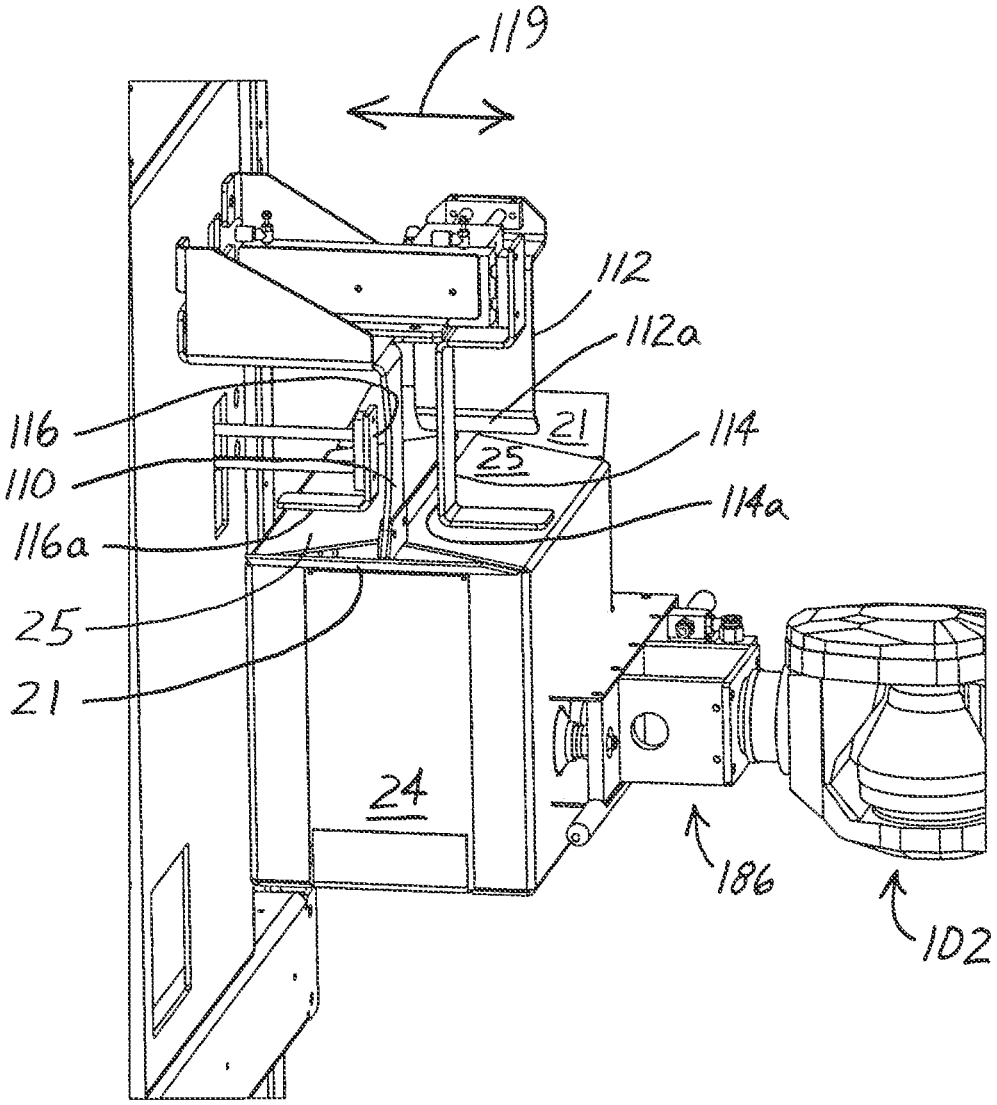
Figure 43:
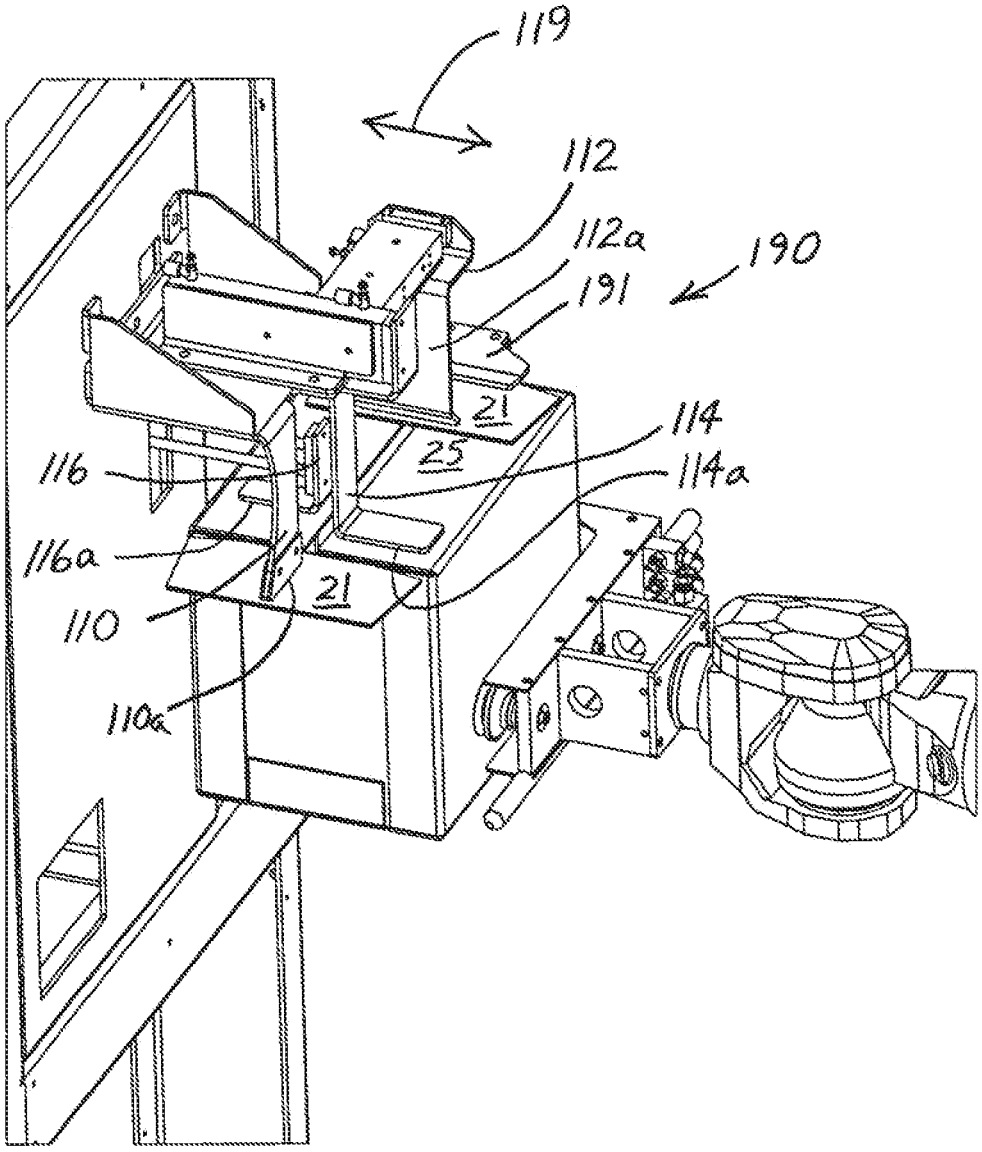
Figure 44:
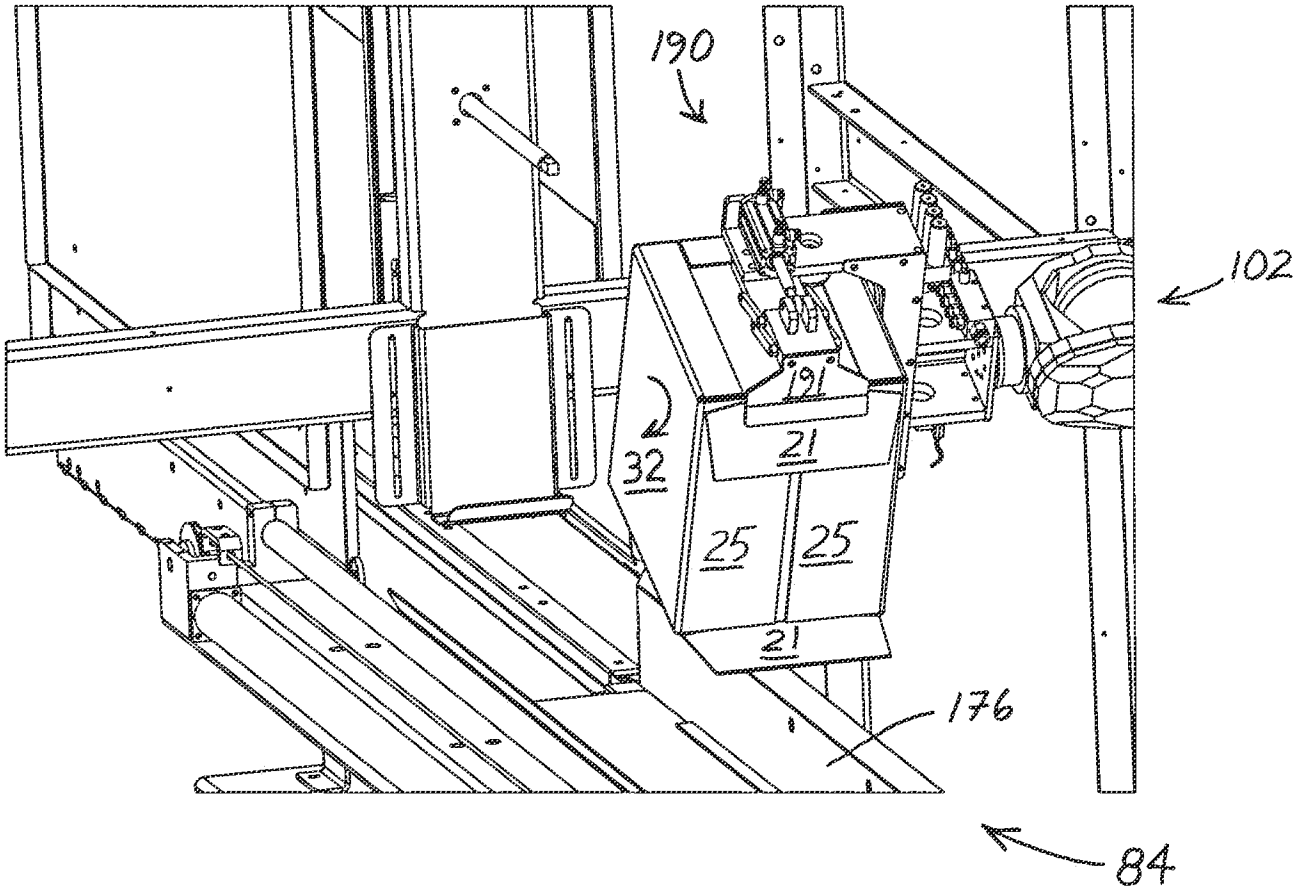
FIGS. 44-45 are upper perspective views of the device of FIG. 33 placing an inverted fully folded box onto the second portion of the staging area according to the disclosure.
Figure 45:
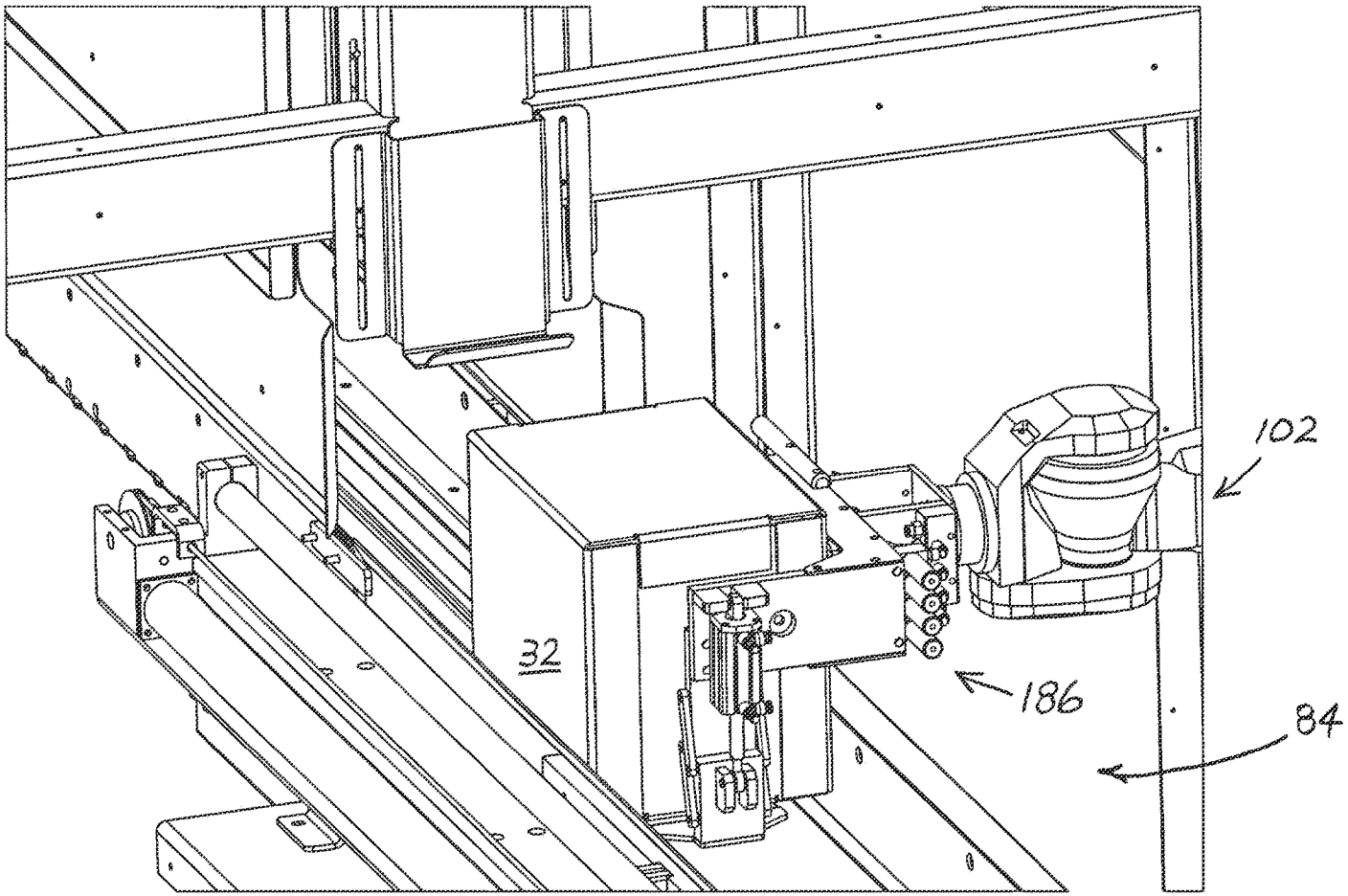
Figure 46:
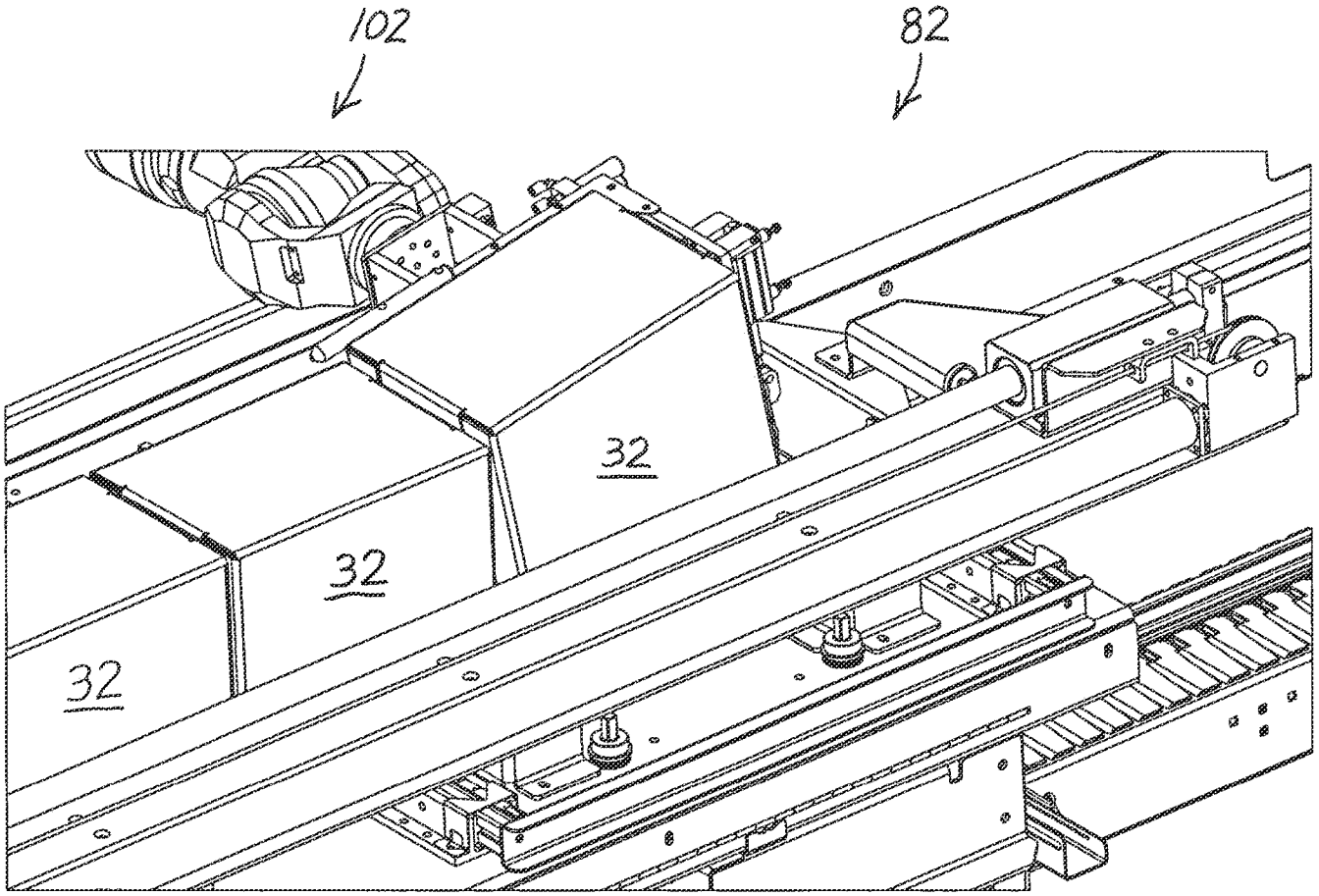
FIGS. 46-51 are sequential upper perspective views of the device of FIG. 33 placing a last inverted fully folded box of a row of inverted fully folded boxes onto the second portion of the staging area, then conveying the row of inverted fully folded boxes into the stacking area according to the disclosure.
Figure 47:
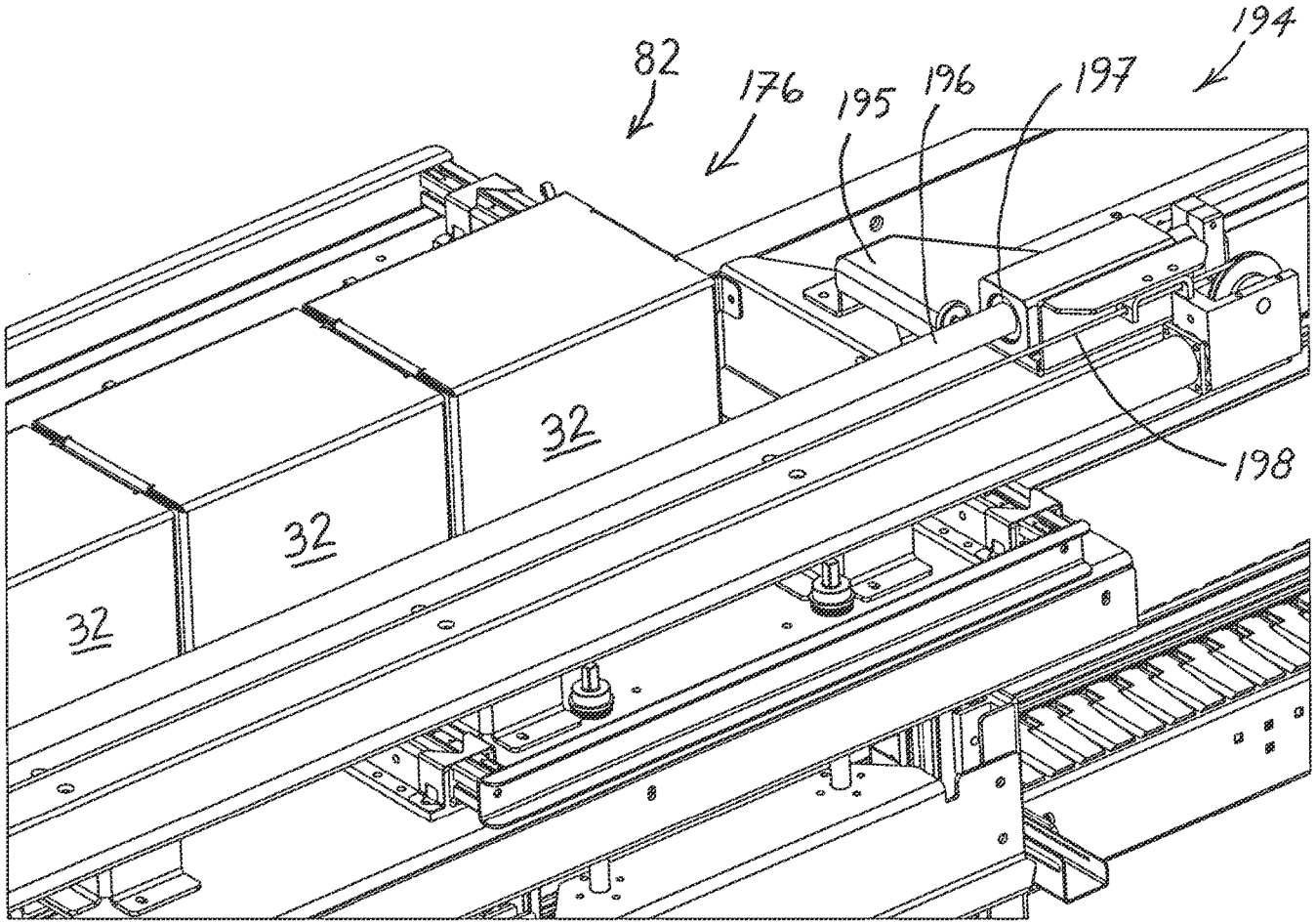
Figure 48:
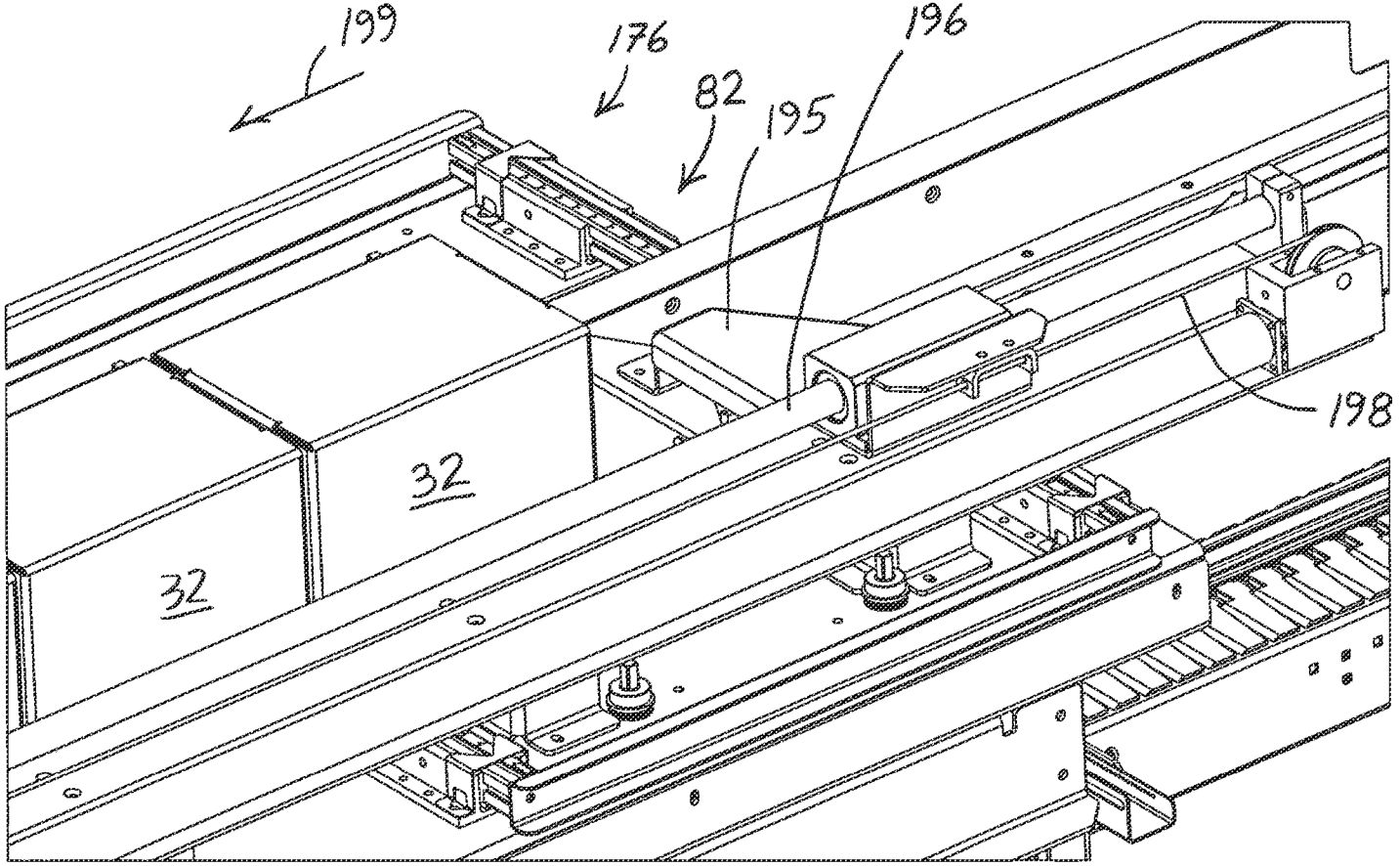
Figure 49:
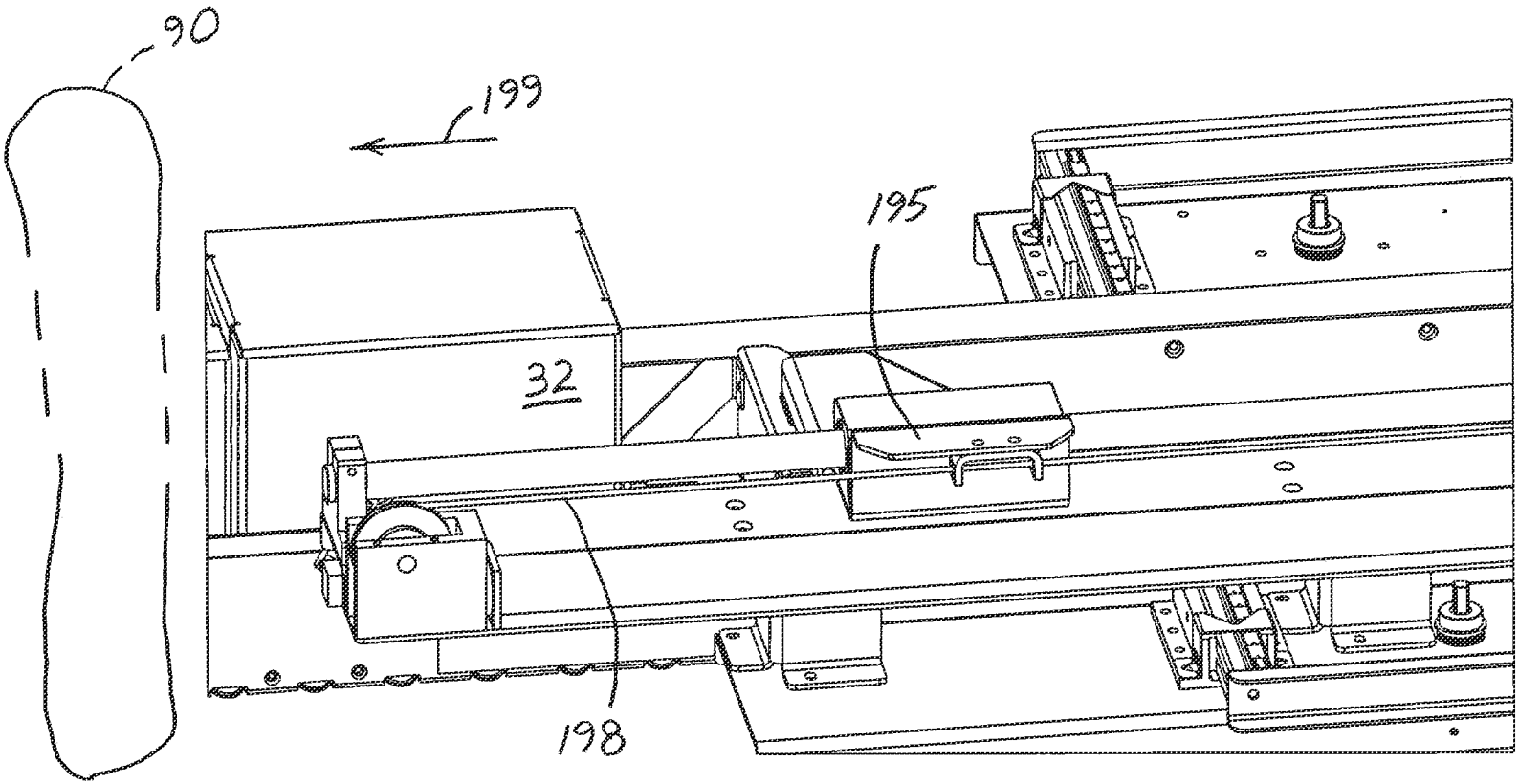

FIGS. 39-45 shows a method of manipulating the partially folded box 24 to form a first fully folded box 30 and then an inverted first fully folded box 32 by inwardly folding opposed flaps 21 over inwardly folded opposed flaps 25 (which is opposite the flap folding order discussed immediately above). As shown in FIG. 39, a flap folding assembly 111 includes a member 110 having a surface 110*a*, an opposed member 112 having a surface 112*a*, and additionally has a member 114 having a surface 114*a* (FIG. 42), and an opposed member 116 having a surface 116*a* (FIG. 42). As shown, member 110 is stationary, and the remaining members 112, 114, 116 are selectably movable. Head 186 of device 102 manipulates partially folded box 24 such that member 110 engages flap 21 and member 112 engages the opposed flap 21. Member 112 is then urged into movement direction 118 away from partially folded box 24, accompanied by some movement of head 186 such that opposed flaps 21 are folded outwardly by virtue of contact with respective surfaces 110*a*, 112*a*. Upon sufficient movement of opposed flaps 21, members 114, 116 with respective surfaces 114*a*, 116*a* contact and are urged to move toward each other in movement direction 119, thereby inwardly folding the opposed flaps 25 to a substantially closed position. Upon opposed flaps 25 achieving a substantially closed position, paddle 191 of retention member 190 is urged toward an extended position 193 thereby inwardly folding flap 21 over already inwardly folded opposed flaps 25. Head 186 device 102 manipulates and rotates the box such that flap 21 opposite panel 191 of retention member 190 is brought into contact with transport platform 176, the weight of the box inwardly folding the remaining flap 21 over already inwardly folded opposed flaps 25 such that upon contact with transport platform 176, the box defines an inverted first fully folded box 32.

Figure 50:
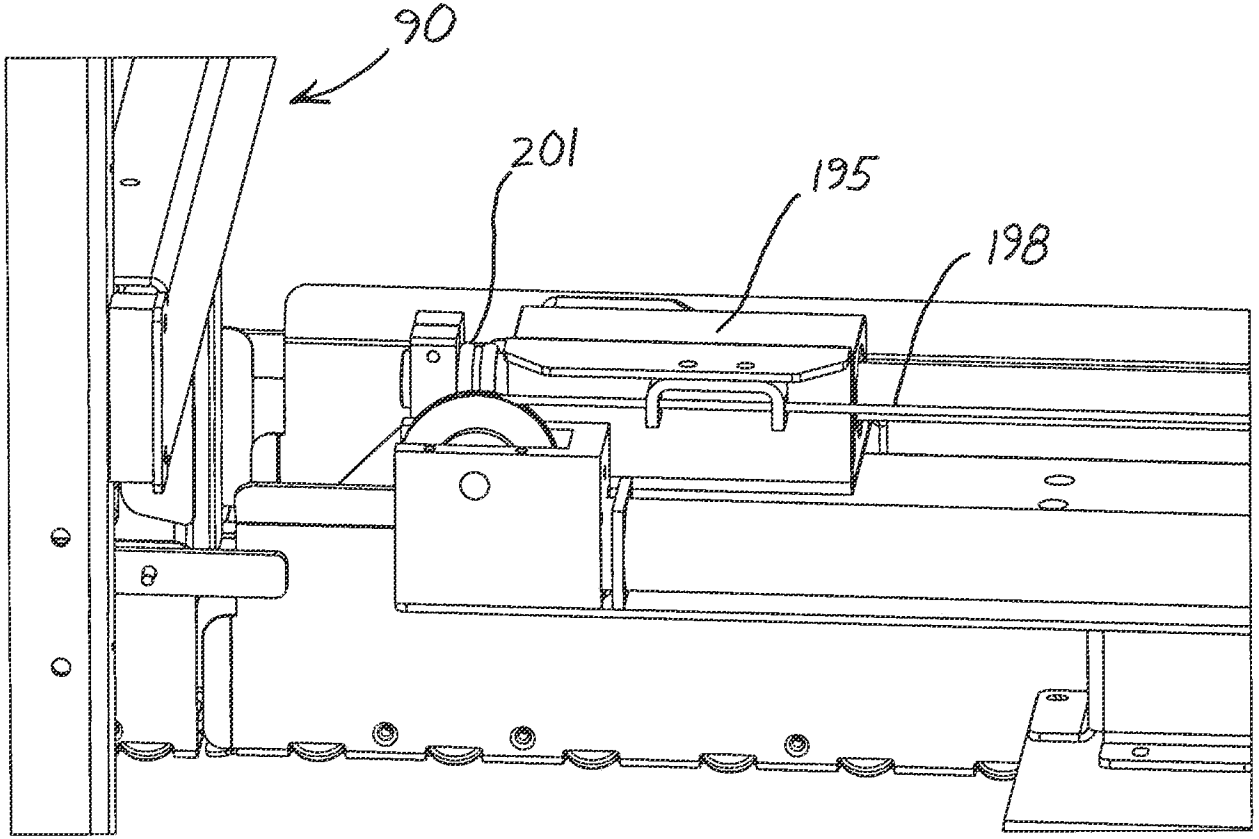
Figure 51:
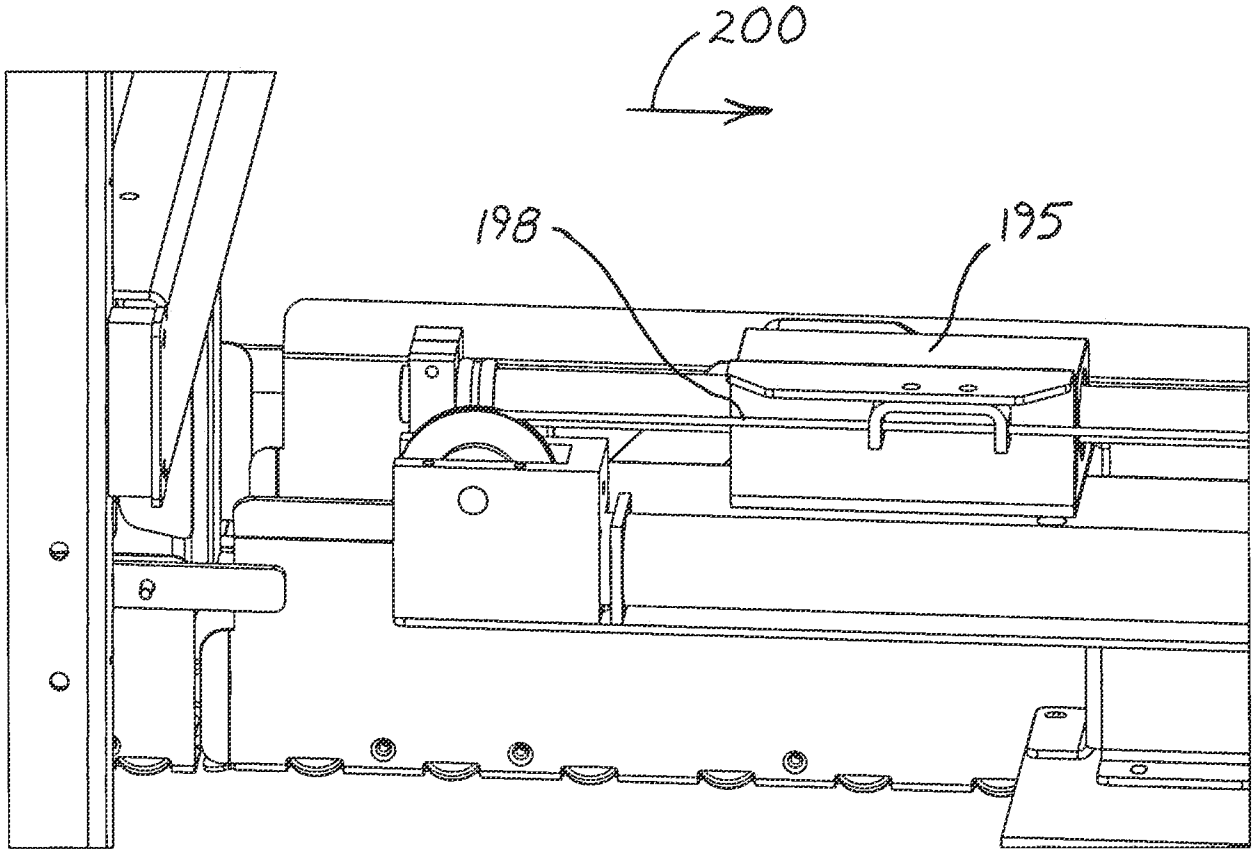
Figure 52:
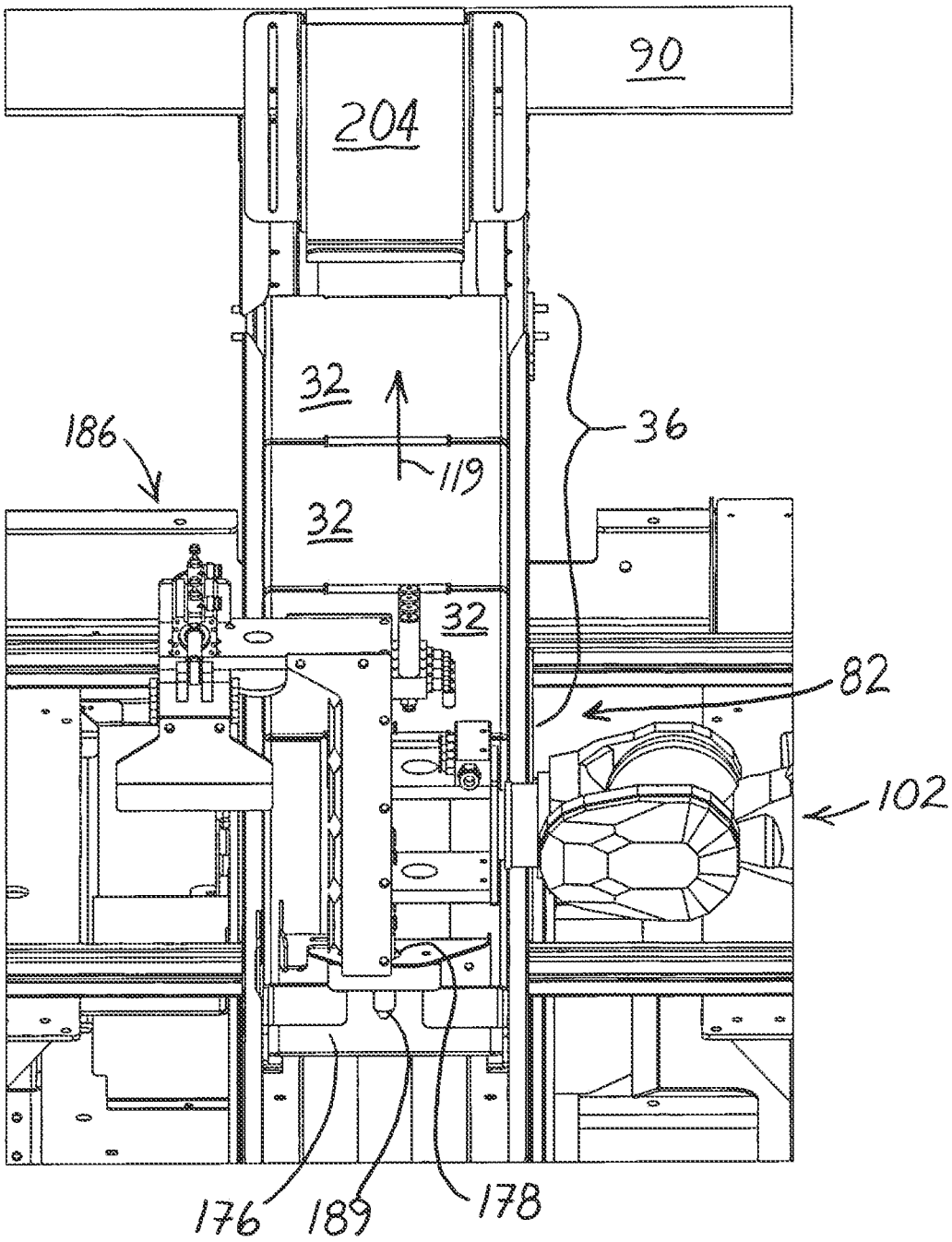
FIGS. 52-55 are sequential upper perspective views of an exemplary embodiment conveying an inverted row of fully folded boxes to the stacking area according to the disclosure.
Figure 53:
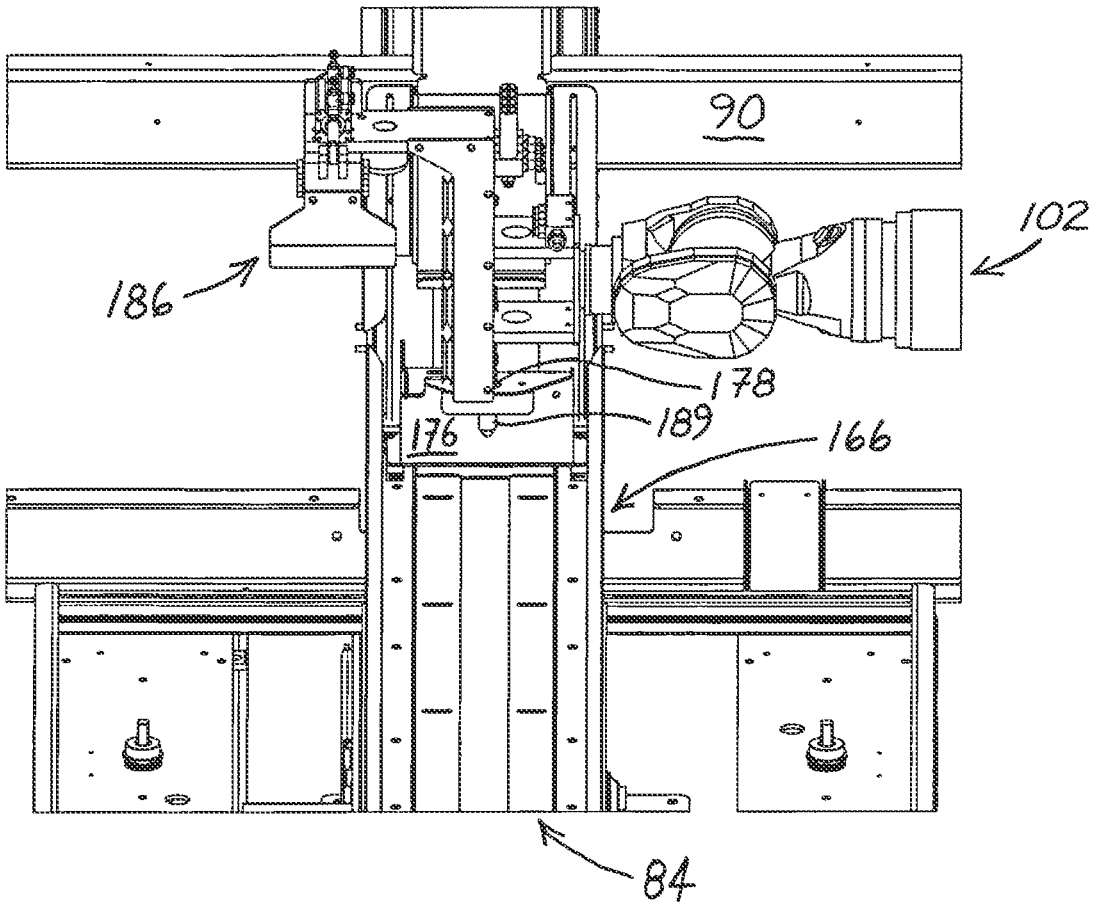
Figure 54:
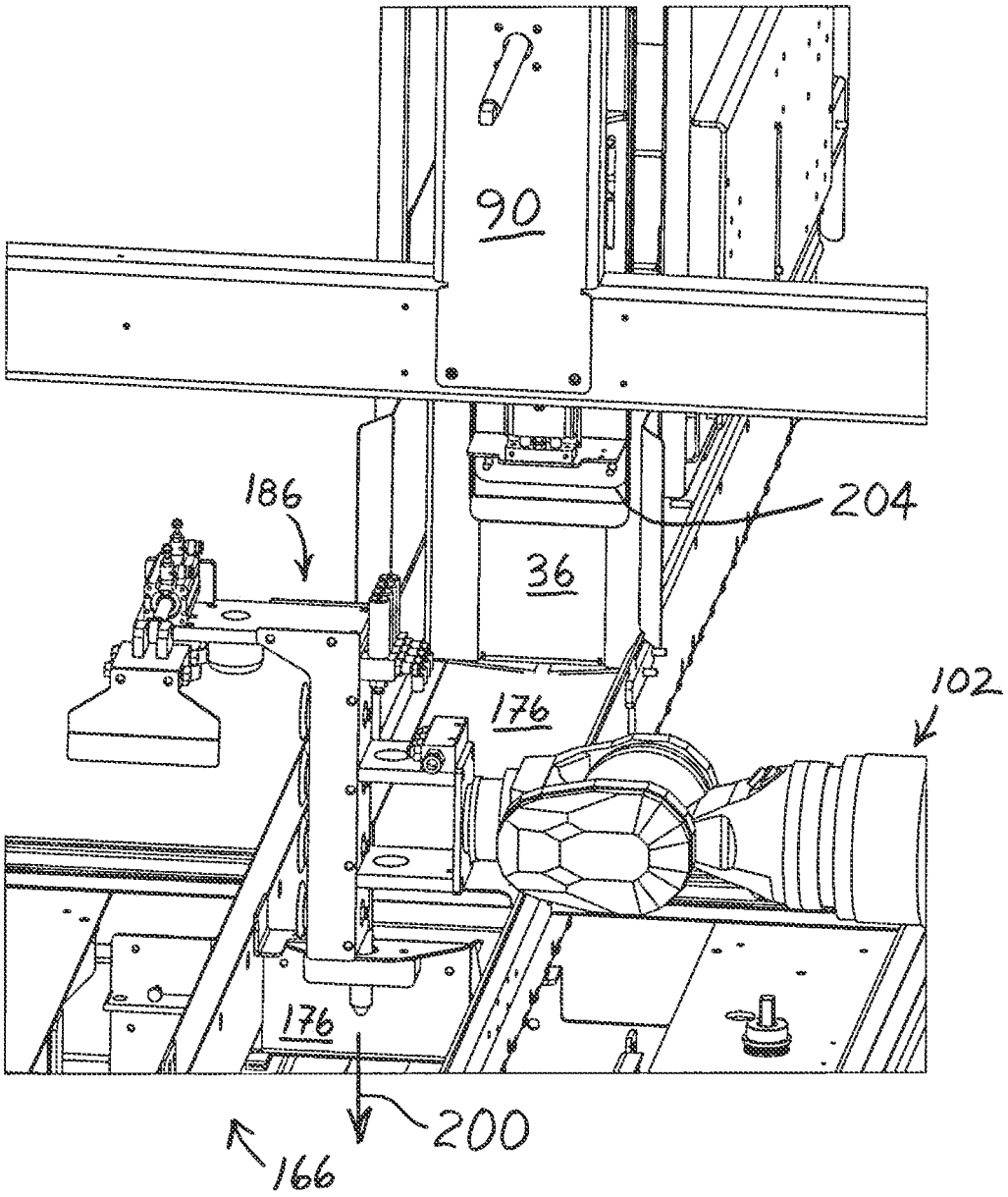
Figure 55:
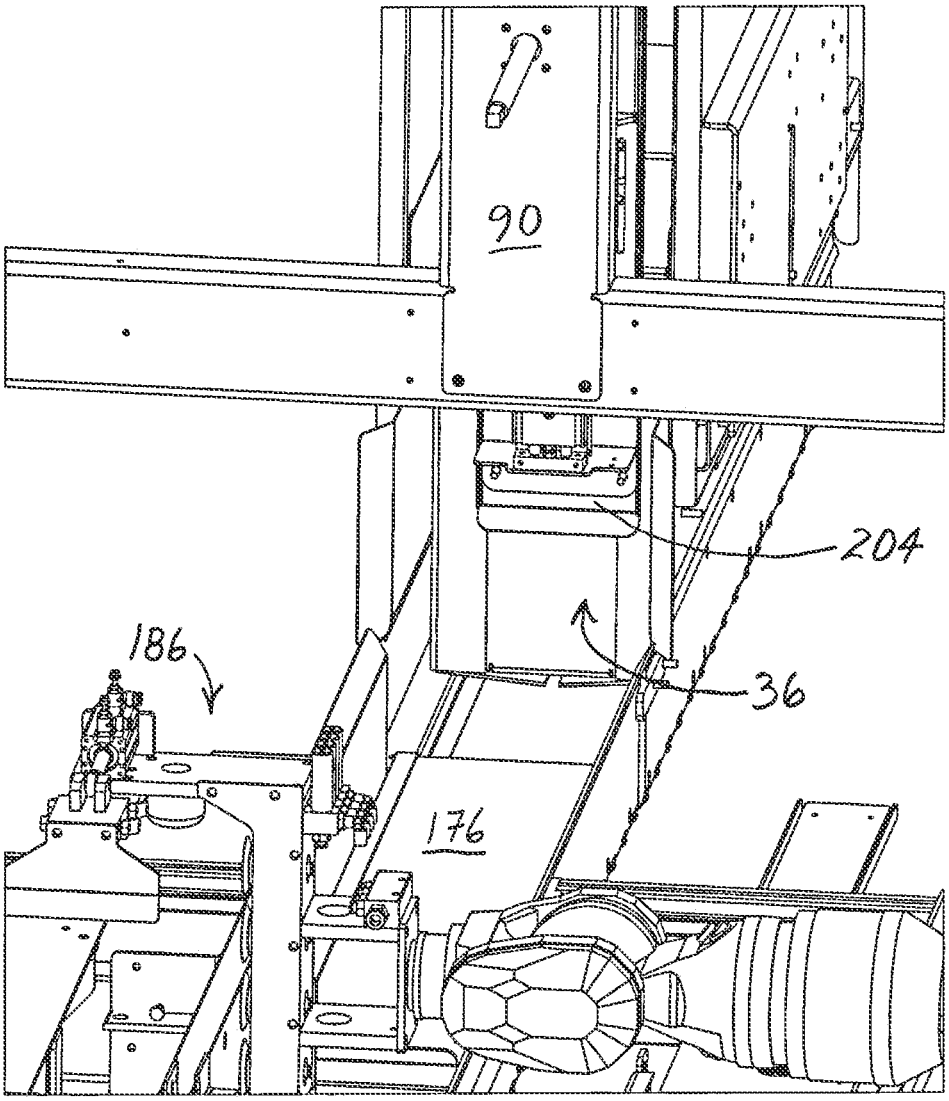

FIGS. 46-51 show a method of conveying inverted first fully folded boxes 32 from second portion 84 of staging area 80 into stacking area 90. As further shown in FIGS. 46-47, upon placement of a row of inverted first fully folded boxes 32 onto transport platform 176 (FIG. 29), a platform conveyance assembly 194 having a drive member 195 operatively connected to transport platform 176 and having an opening 197 configured to receive a guide 196 is urged by a motor (not shown) via cable loop 198 in movement direction 199 toward stacking area 90 (FIG. 50). As shown in FIGS. 50-51, upon drive member 195 contacting stop 201, drive member 195 is urged in movement direction 200 until drive member 195 is returned to its initial retracted position.

FIGS. 52-55 show another method of conveying inverted first fully folded boxes 32 from second portion 84 of staging area 80 into stacking area 90. As further shown in FIGS. 52-53, upon placement of a row of inverted first fully folded boxes 32 onto transport platform 176, a mating feature 189 of head 186 of device 102 is inserted into an opening 178 formed in transport platform 176. Device 102 then urges transport platform 176 in movement direction 199 toward stacking area 90. Upon sufficient insertion of transport platform 176 inside of stacking area 90 such that inverted first fully folded boxes 32 are positioned inside of stacking area 90, a stop 204 (FIG. 55) is actuated to an extended position. As a result of the actuation of stop 204 to an extended position, upon retraction of transport platform 176 in movement direction 200 away from stacking area 90, stop 204 prevents the return of inverted first fully folded boxes 32 (which will become first inverted top row 36) from stacking area 90.

Figure 56:
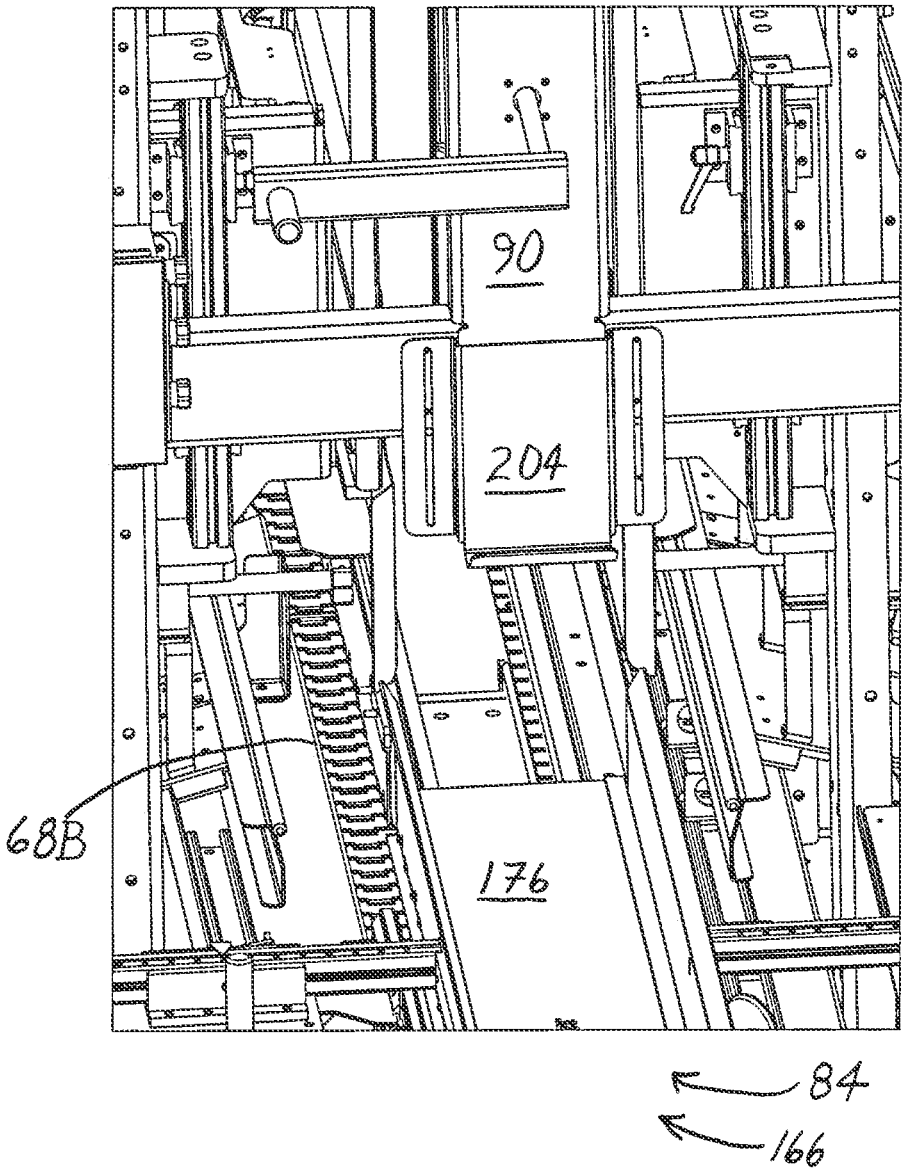
FIGS. 56-57 are opposed upper perspective views of an exemplary stacking area according to the disclosure.
Figure 57:
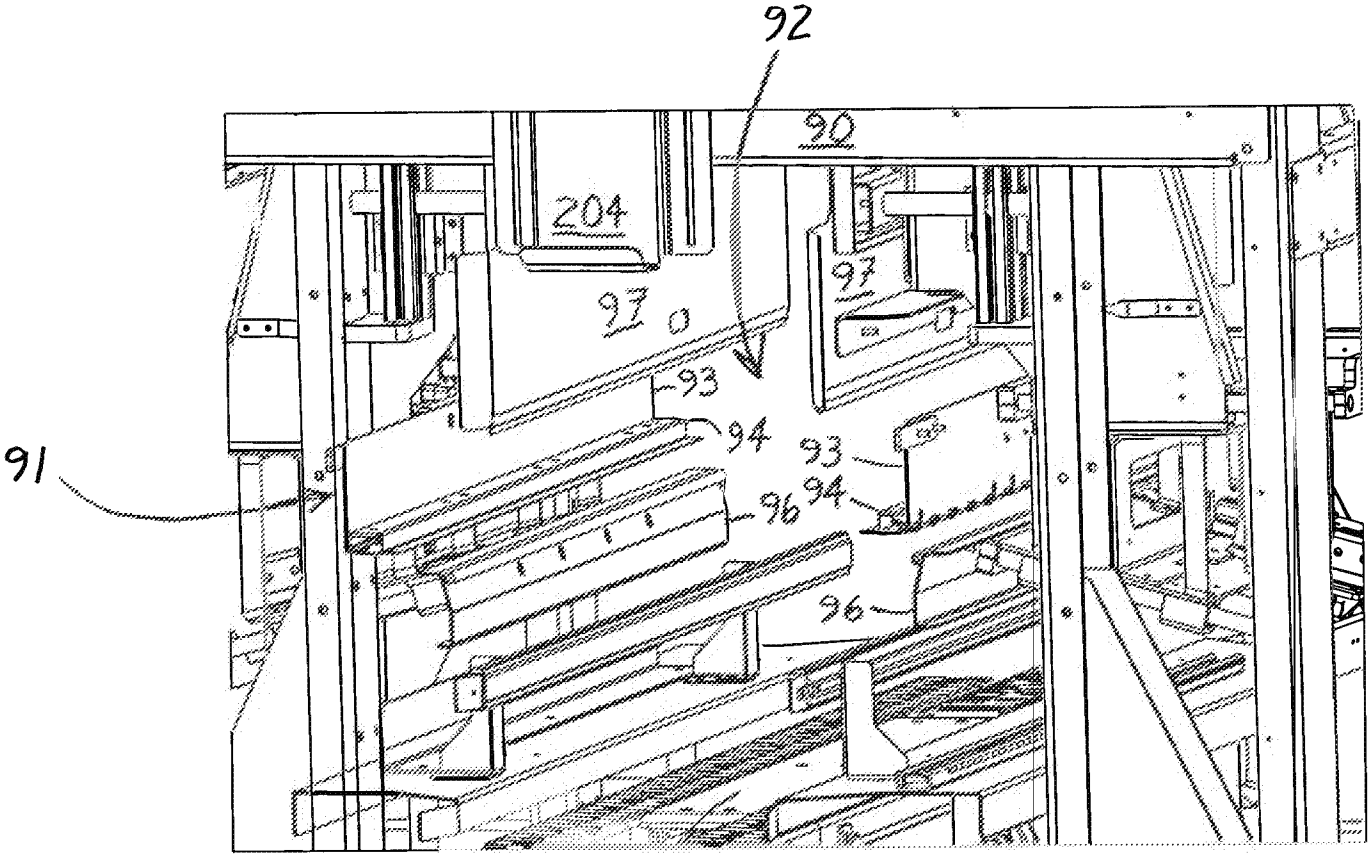

FIGS. 56-57 show major components of stacking area 90, including a box support 91 having opposed box support portions 93 each having a guide/support member 94, as well as movable flap conditioning devices 92. Flap conditioning devices 92 includes opposed flap folding mechanisms 96, opposed vertical guide sheets 97 and a lifting device 98 and extends upwardly from a retracted position vertically below conveyor 68B.

Figure 58:
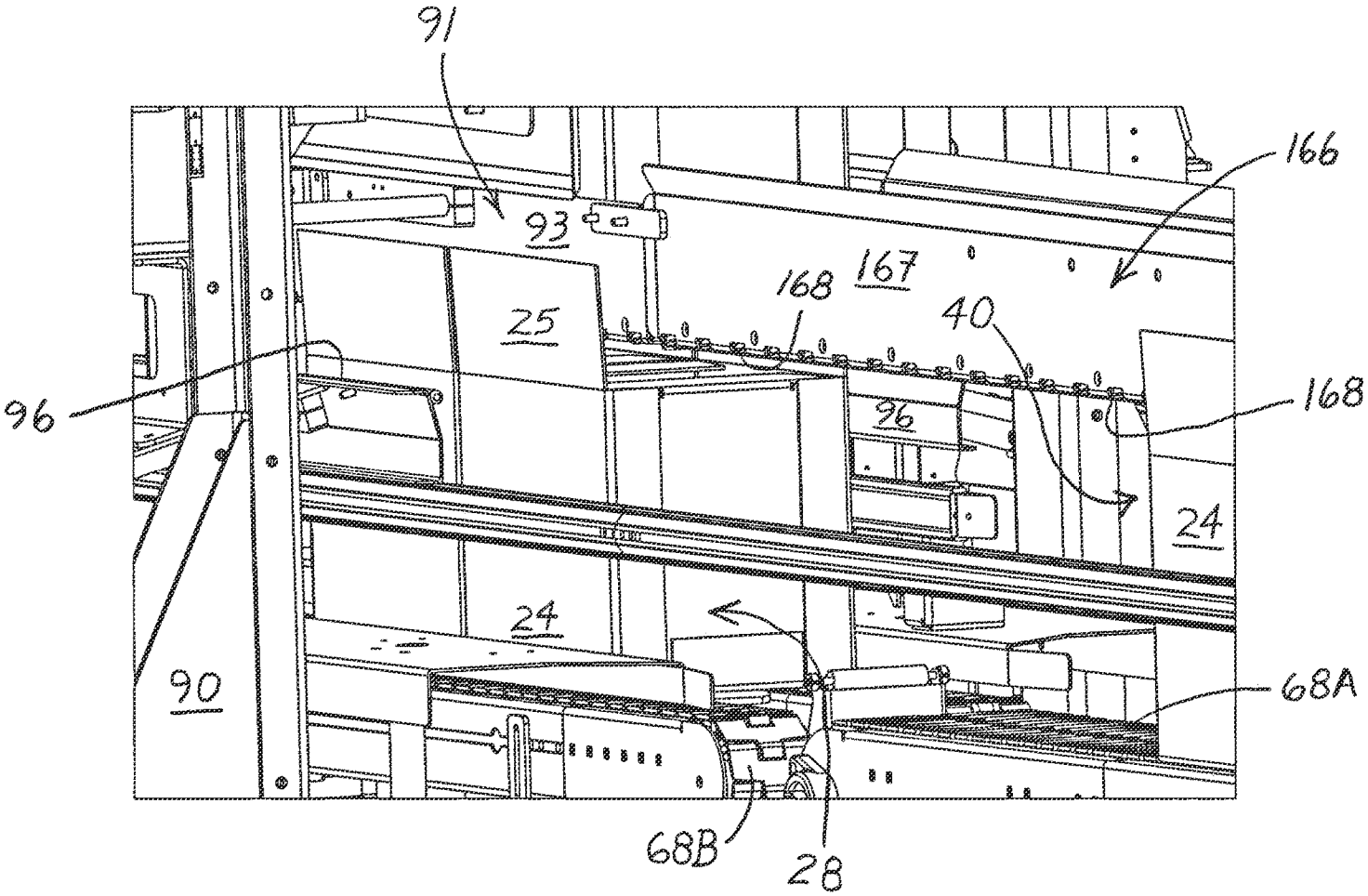
FIGS. 58-67 are sequential views illustrating operation of an exemplary stacking area according to the disclosure.

In operation, as shown in FIG. 58, first non-inverted row 28 of boxes is conveyed from first portion 82 of staging area 80 to stacking area 90. During conveyance of first non-inverted row 28, opposed flaps 25 that have been maintained in a slightly outwardly folded position (see e.g., FIG. 28A) by outwardly extending angled rollers 168 from guide/support portions 167 of staging area 80 continue to be maintained in the slightly outwardly folded position by outwardly extending angled rollers 168 from box support portions 93 of box support 91. Box support 91 provides a smooth supported transition from guide/support 166 of staging area 80.

In one embodiment, FIGS. 59-67 occur in rapid fashion.

Figure 59:
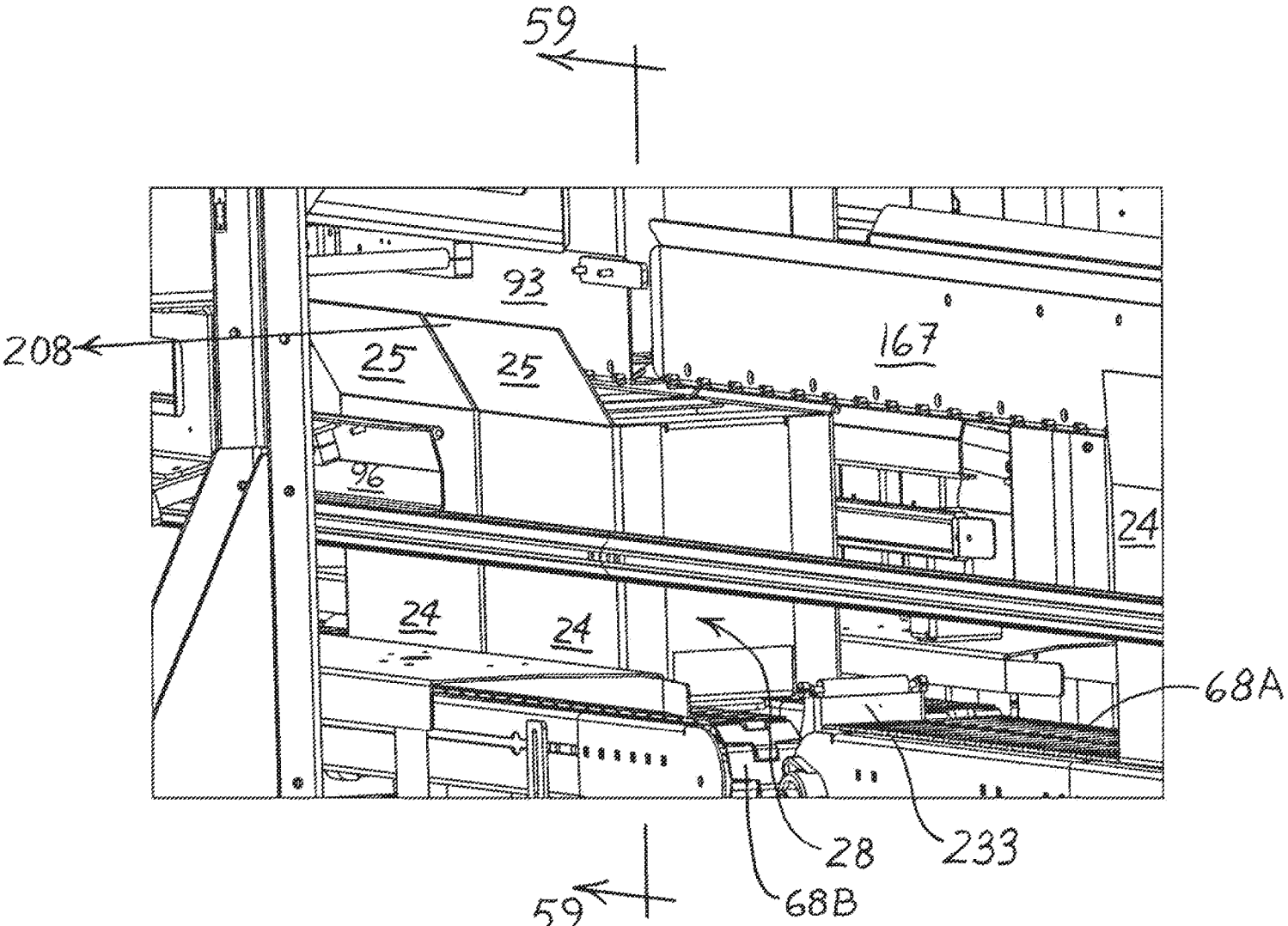
Figure 60:
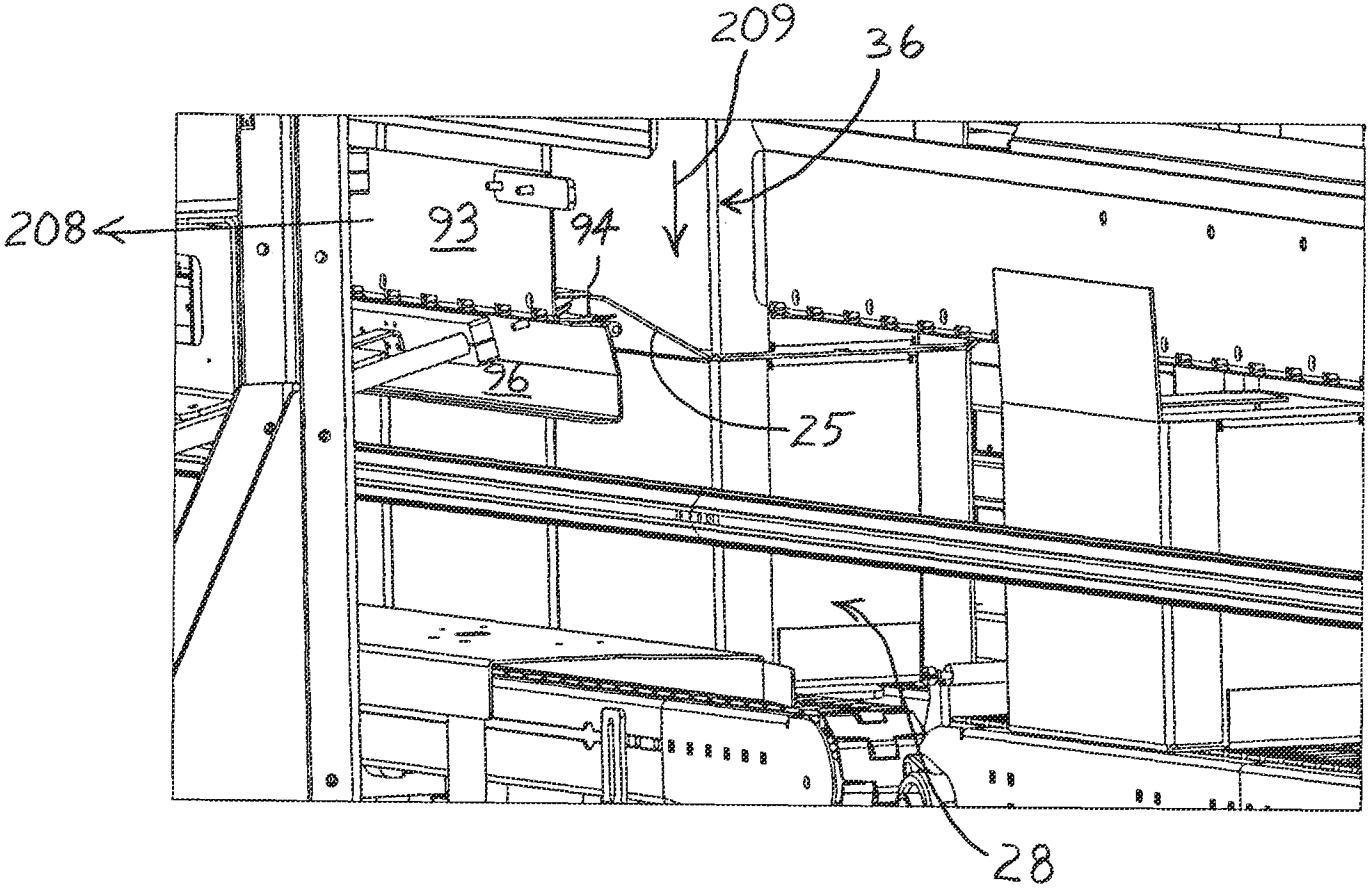

As shown in FIG. 59, each of opposed box support portions 93 are urged into movement direction 208 substantially laterally away from each other, resulting in increased outward folding of opposed flaps 25 about their respective flap creases. As shown in FIG. 60, upon sufficient movement of box support portions 93 away from each other, inverted first fully folded boxes 32 formerly supported by guide/support members 94 of corresponding box support portions 93 are urged to fall in movement direction 209 by force of gravity. As a result, inverted first fully folded boxes 32 are re-identified as first inverted top row 36 that is supported by first non-inverted row 28.

Figure 61:
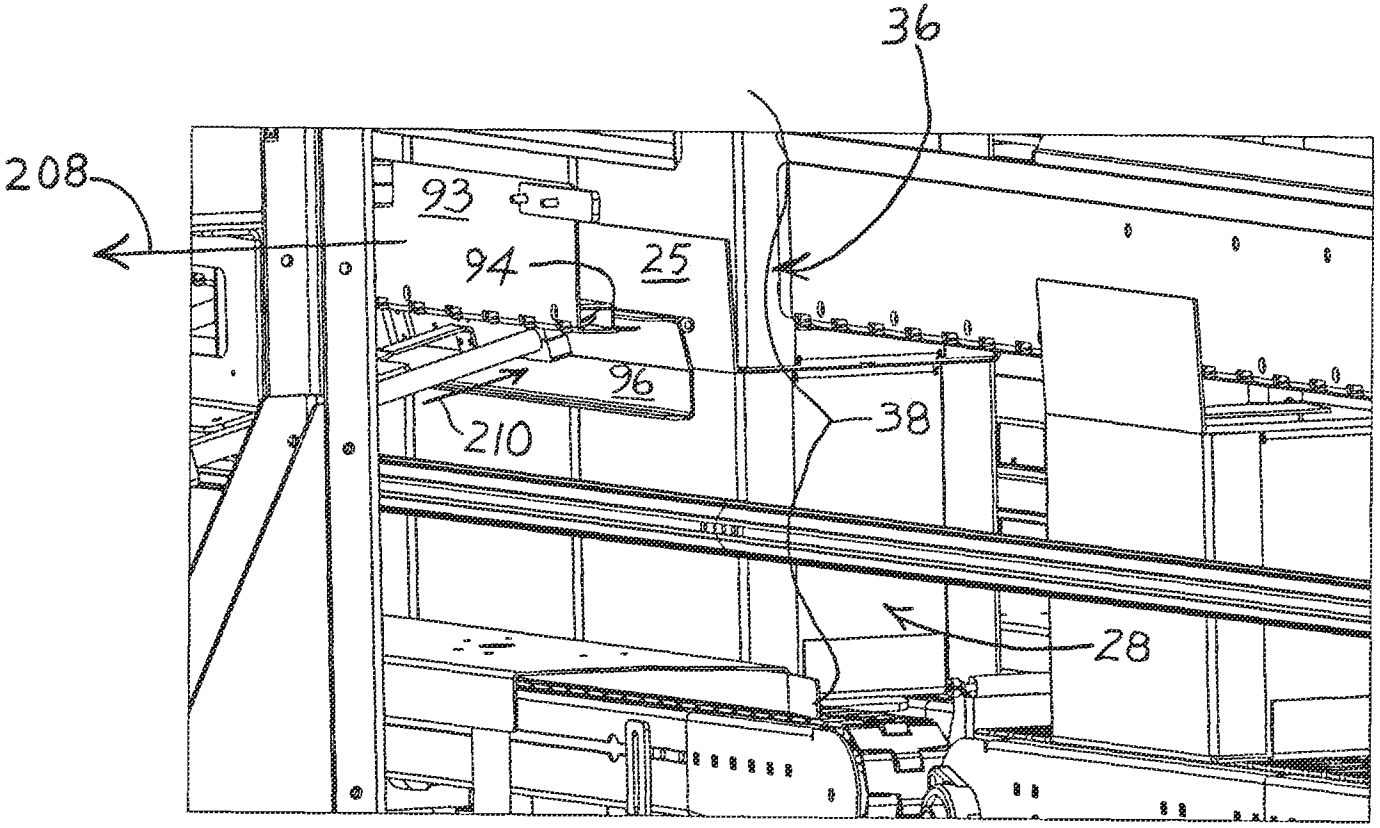

As shown in FIG. 61, substantially simultaneously or immediately after guide/support members 94 of the opposed box support portions 93 moving substantially laterally away from each other "clear" the flaps 25 from the first non-inverted row 28 of boxes, opposed flap folding mechanisms 96 are urged in a slightly upward movement direction 210 toward each other. As a result, folding flaps 25 are urged to inwardly fold about their respective flap creases until flaps 25 abut or are in close proximity to corresponding facing surfaces of the first inverted top row 36, forming first vertically stacked row 38.

Figure 62:
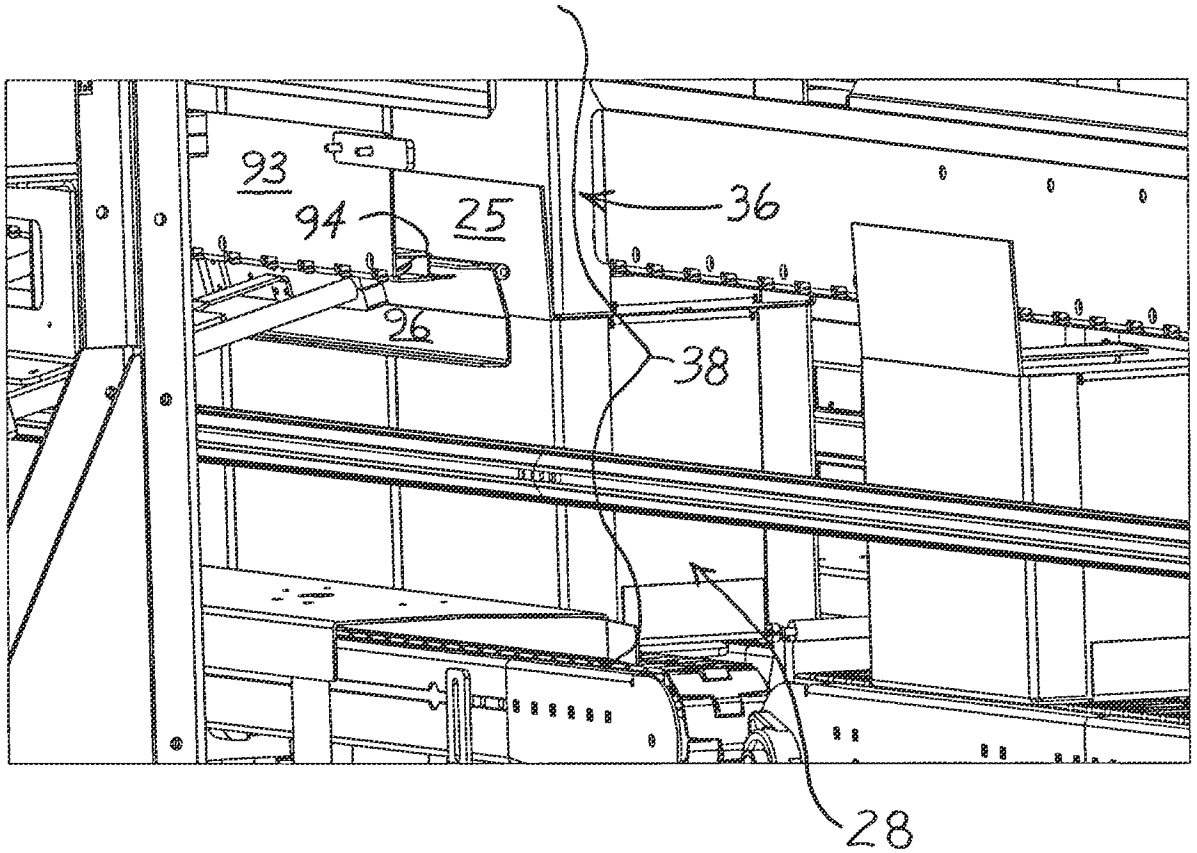
Figure 63:
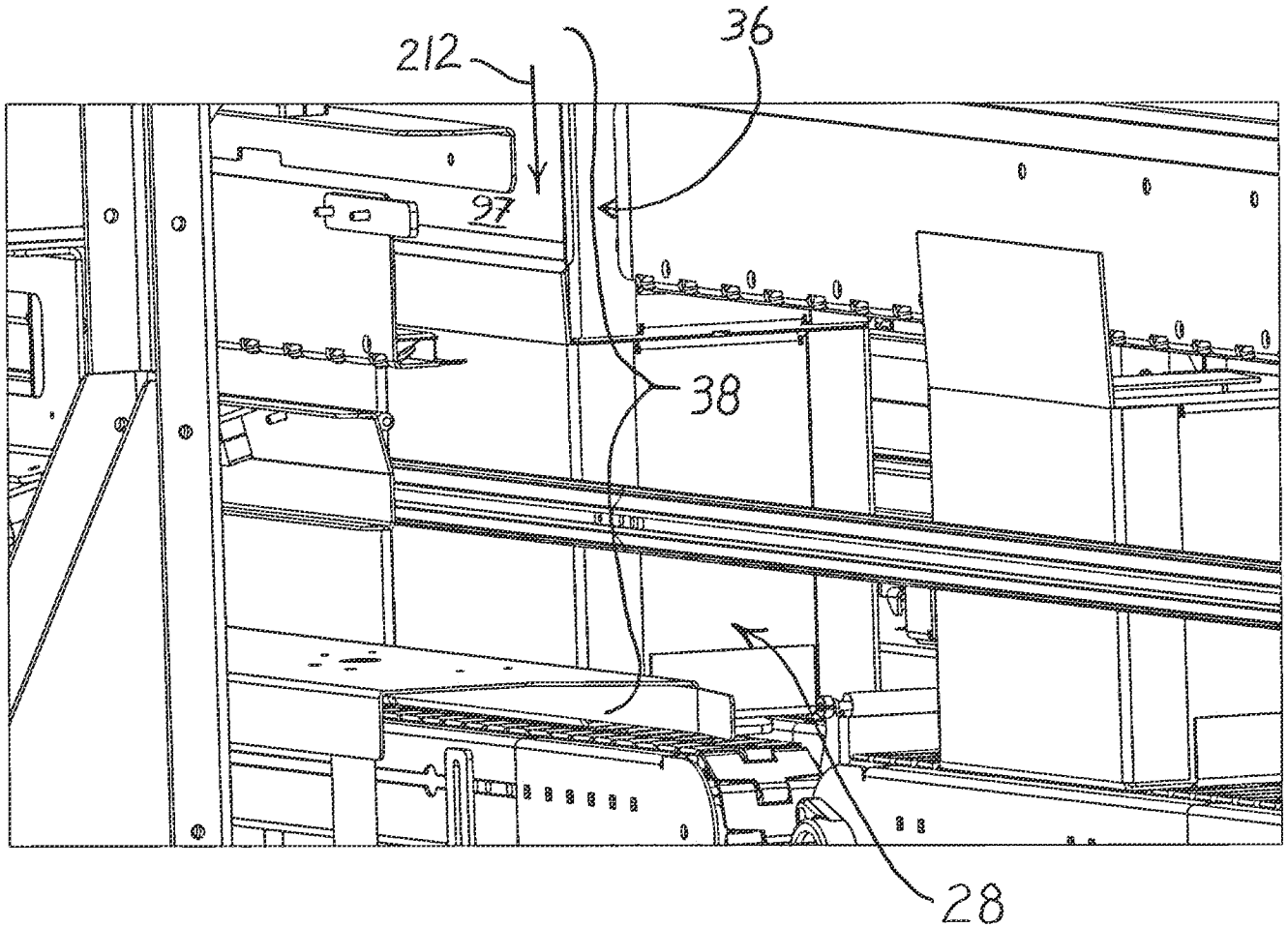

As shown in FIGS. 62-63, substantially simultaneously or immediately after forming first vertically stacked row 38, opposed substantially vertical guide sheets 97 are urged into a substantially vertical downward movement direction 212 to be positioned laterally over respective ends of the flaps 25 (flaps 25 not shown in FIGS. 62-63).

Figure 64:
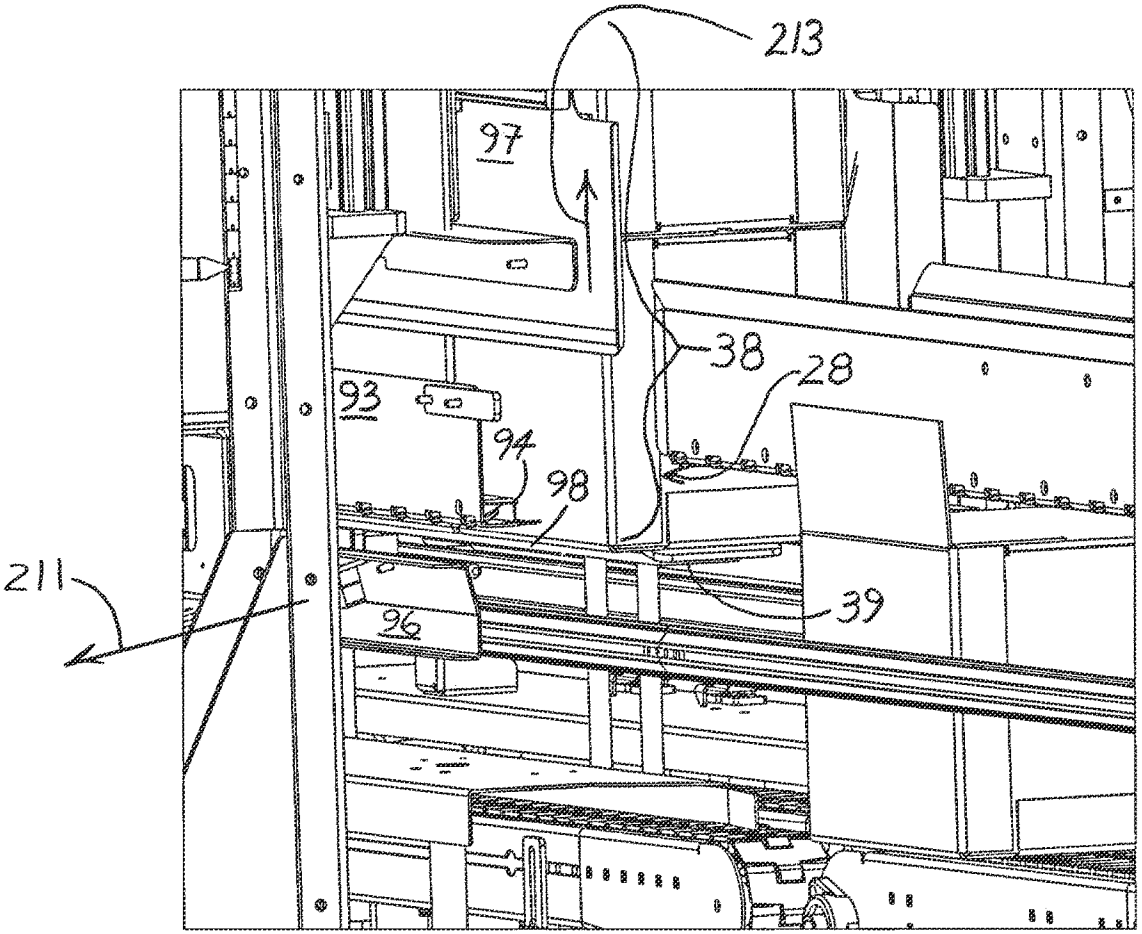

As shown in FIG. 64, substantially simultaneously or immediately after sheets 97 are positioned laterally over respective ends of flaps 25 (FIG. 62), opposed flap folding mechanisms 96 are urged in a slightly downwardly movement direction 211 away from each other. Once flap folding mechanisms 96 are "clear", a lifting device 98 is raised in a substantially vertical direction, contacting bottom surface 39 of first vertically stacked row 38 and similarly raising the first vertically stacked row 38. Substantially simultaneously or immediately thereafter, opposed vertical guide sheets 97 are urged in movement direction 213 such that vertical guide sheets 97 continue to be positioned laterally over (i.e., laterally cover) respective ends of flaps 25 (flaps 25 not shown in FIG. 64).

Figure 65:
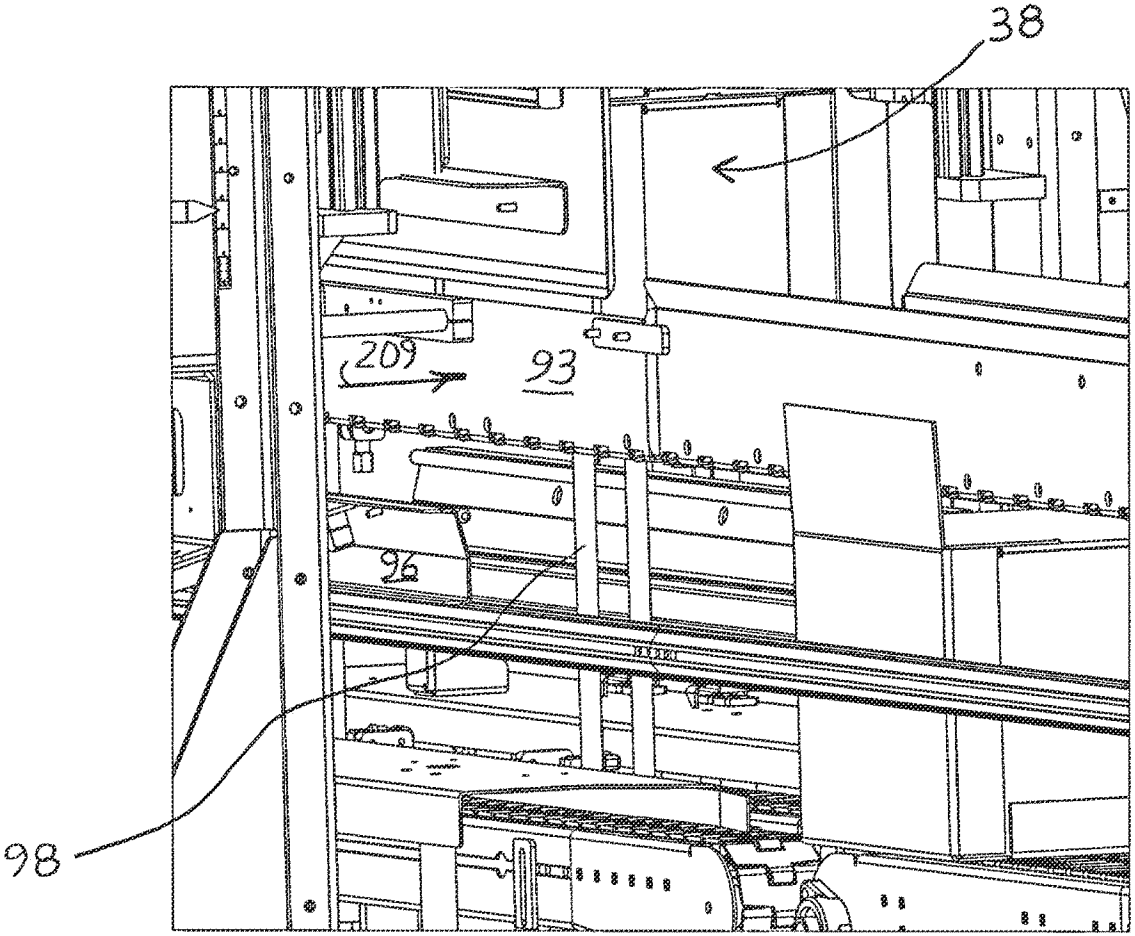

As shown in FIG. 65, substantially simultaneously or immediately after first vertically stacked row 38 is raised sufficiently by lifting device 98, opposed box support portions 93 are urged into movement direction 209 toward each other such that each guide/support member 94 (FIG. 64) is positioned vertically beneath a corresponding corner of first vertically stacked row 38 (better shown in FIG. 64), thereby supporting first vertically stacked row 38. Substantially simultaneously or immediately after opposed box support portions 93 are positioned to support first vertically stacked row 38, lifting device 98 is moved to a retracted position.

Figure 66:
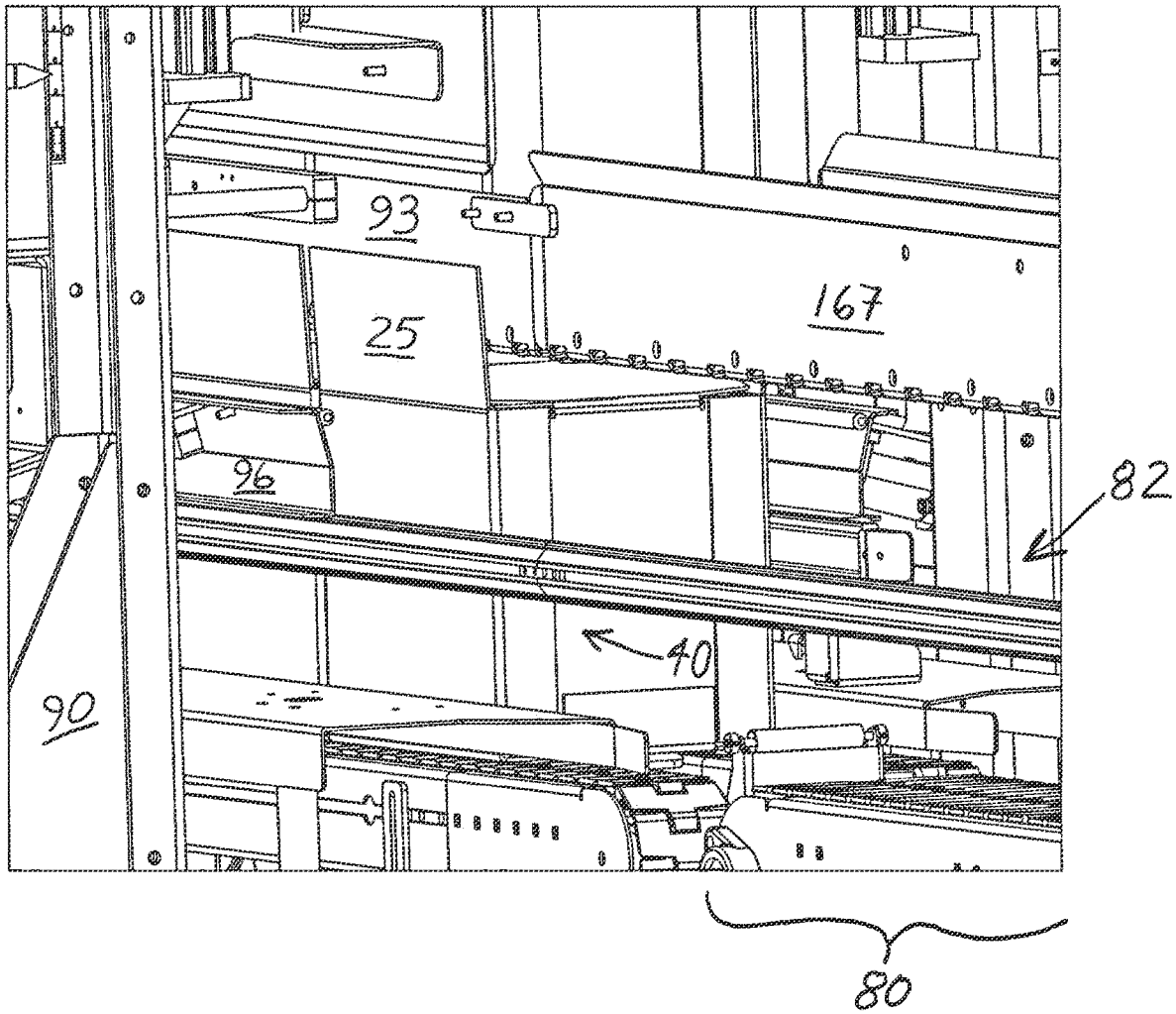

As shown in FIG. 66, substantially simultaneously or immediately after lifting device 98 is moved to a retracted position, the second non-inverted row 40 is conveyed from first portion 82 of staging area 80 (FIG. 30) into stacking area 90.

Figure 67:
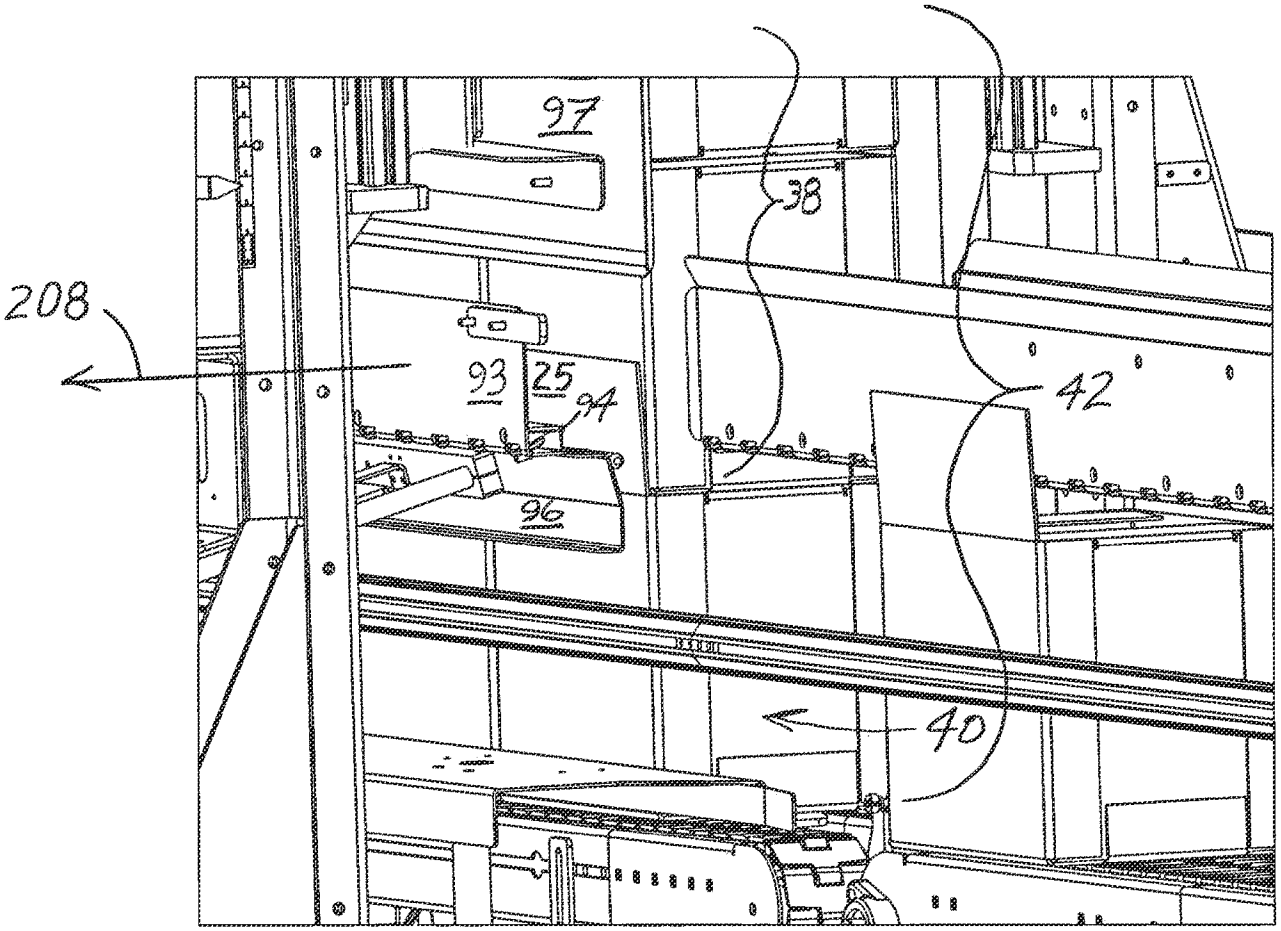

As shown in FIG. 67, substantially immediately after the second non-inverted row 40 has been conveyed from first portion 82 of staging area 80 to stacking area 90 beneath the first vertically stacked row 38, the previously discussed choreographed movements of guide/support members 94, flap folding mechanisms 96 and vertical guide sheets 97 result in second non-inverted row 40 being positioned beneath and supporting first vertically stacked row 38, forming first extended vertically stacked row 42. Further previously discussed choreographed movements of lifting device 98, guide/support members 94, vertical guide sheets 97 and flap folding mechanisms 96 are repeated to raise first extended vertically stacked row 42 in preparation for receiving an additional row of boxes, if desired.

Figure 84:
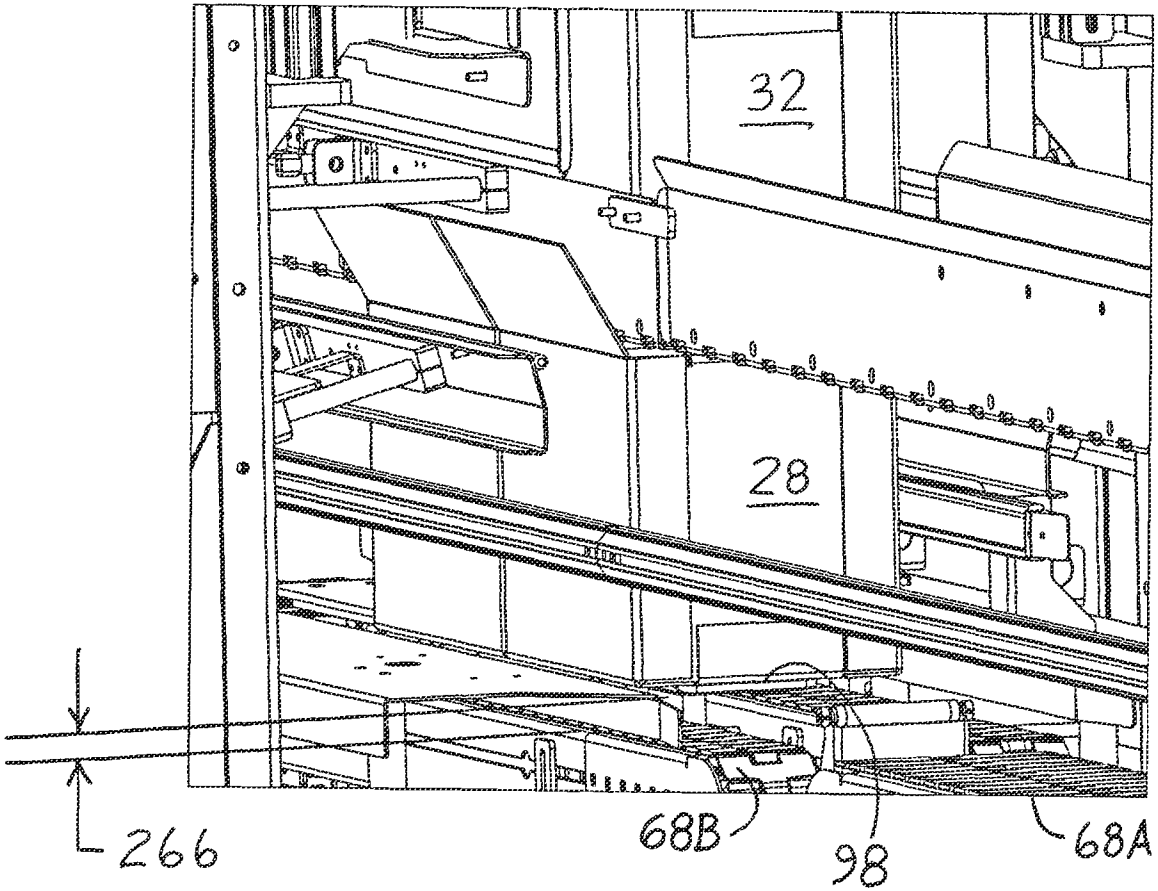
FIGS. 84-85 are sequential views illustrating operation of an exemplary stacking area according to the disclosure.
Figure 85:
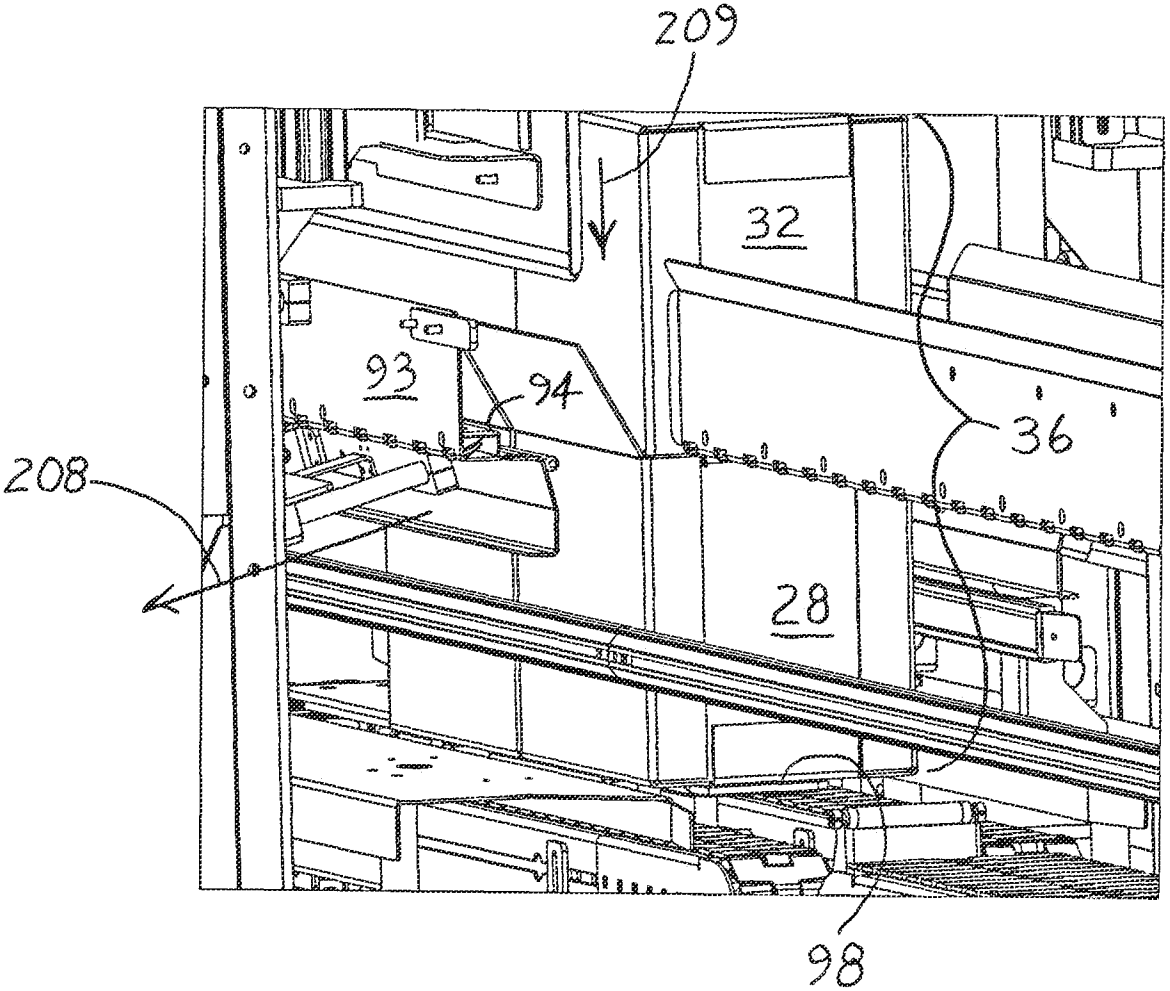

In one embodiment, as operation as previously discussed in FIGS. 52-55 for conveying inverted first fully folded boxes 32 from second portion 84 of staging area 80 into stacking area 90 is occurring, and after operation as previously discussed in FIG. 58 for conveying first non-inverted row 28 of boxes from first portion 82 of staging area 80 to stacking area 90 has occurred, additional steps as shown in FIGS. 84-85 are inserted prior to operation as previously discussed in FIGS. 59-67.

Figure 86:
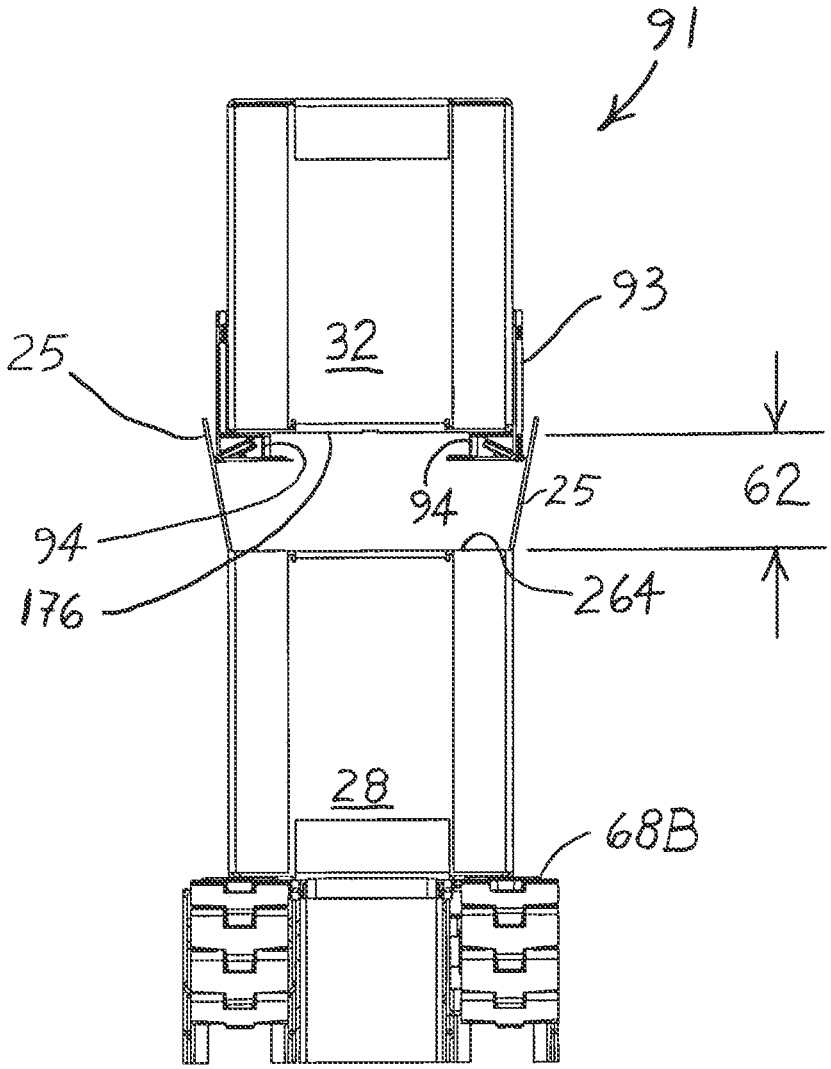
FIG. 86 is a cross section taken along line 59-59 of FIG. 59 of a stacking area according to the disclosure.

More specifically, prior to operation in FIG. 59, as shown in FIG. 86 which is a cross section taken along line 59-59 of FIG. 59, a gap 262 exists between guide/support members 94 of the opposed box support portions 93 of box support 91 that support inverted first fully folded boxes 32 and an upper surface 264 of the first non-inverted row 28 of boxes generally corresponding to a crease of inwardly folded flaps (not shown), which upper surface 264 will subsequently support inverted first fully folded boxes 32. As further shown in FIG. 86, transport platform 176 (FIG. 52) which extends between opposed guide/support members 94 and temporarily supports inverted first fully folded boxes 32, and has not yet been retracted from the stacking area (and ultimately returned to the staging area as previously discussed), is depicted having an enlarged thickness for purposes of understanding the invention, but for practical purposes negligibly increases the magnitude of gap 262.

As shown in FIG. 84, lifting device 98 (and non-inverted row 28 of boxes) is partially raised a predetermined distance 266 toward inverted first fully folded boxes 32, substantially reducing the magnitude of or substantially removing gap 262 between inverted first fully folded boxes 32 and non-inverted row 28 of boxes. Subsequent to partially raising non-inverted row 28 of boxes, transport platform 176 is retracted (not shown in FIG. 84) such that opposed guide/support members 94 support first fully folded boxes 32.

As shown in FIG. 85, in a manner similar to that previously discussed in FIGS. 59-60, opposed box support portions 93 are urged into sufficient movement direction 208 such that inverted first fully folded boxes 32 formerly supported by guide/support members 94 of corresponding box support portions 93 are urged to fall a significantly reduced distance in movement direction 209 by force of gravity prior to being supported by first non-inverted row 28.

As a result of the reduction of the gap 262 discussed above in FIGS. 84-86 between first non-inverted row 28 of boxes and inverted first fully folded boxes 32, articles contained in first non-inverted row 28 of boxes, especially articles of reduced height, are substantially prevented from inadvertently falling out of or remaining extending partially exterior of inverted first fully folded boxes 32, which is highly undesirable.

Figure 68:
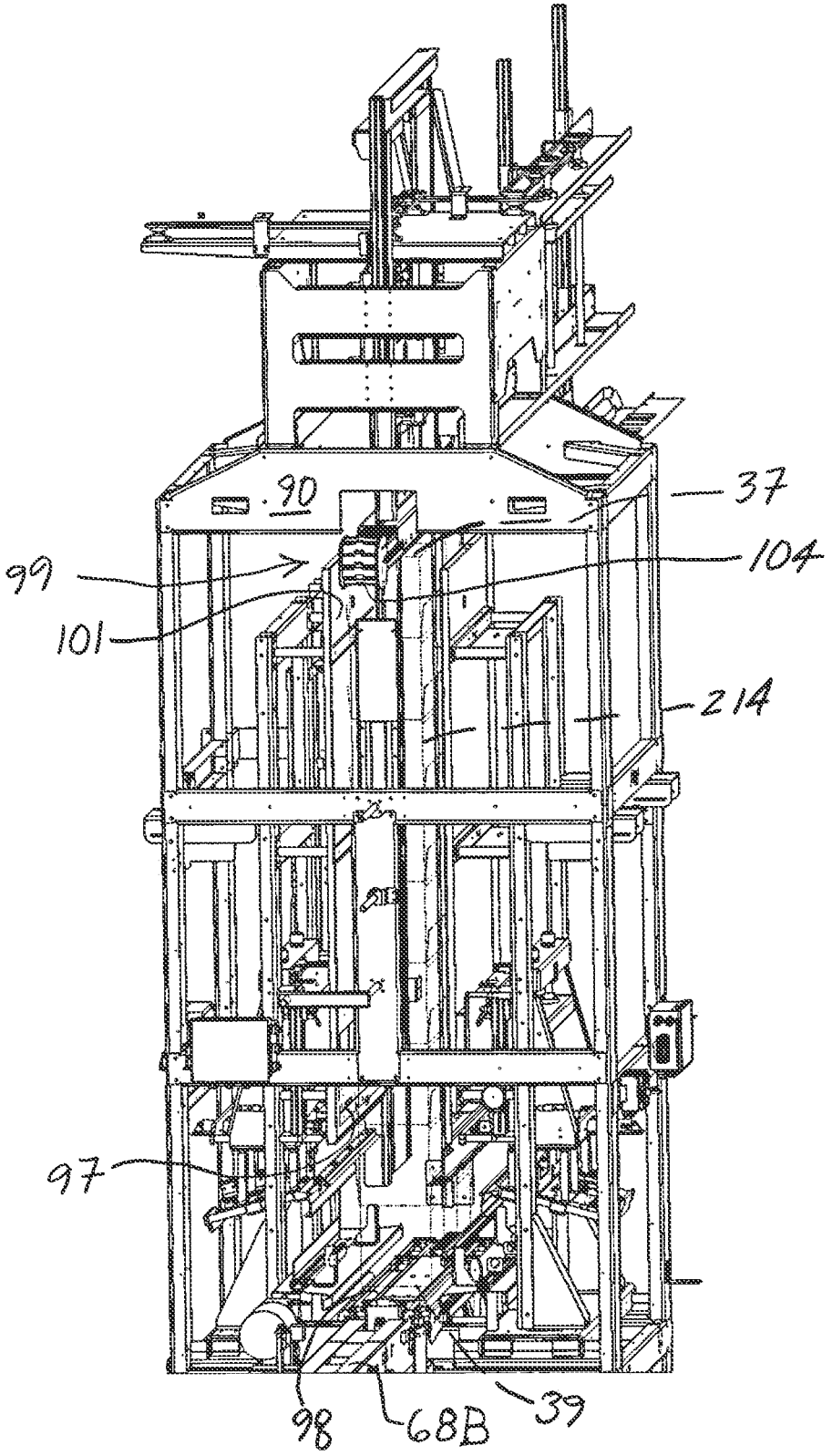
FIG. 68 is a lower perspective view of a compression member of an exemplary stacking area according to the disclosure.
Figure 69:
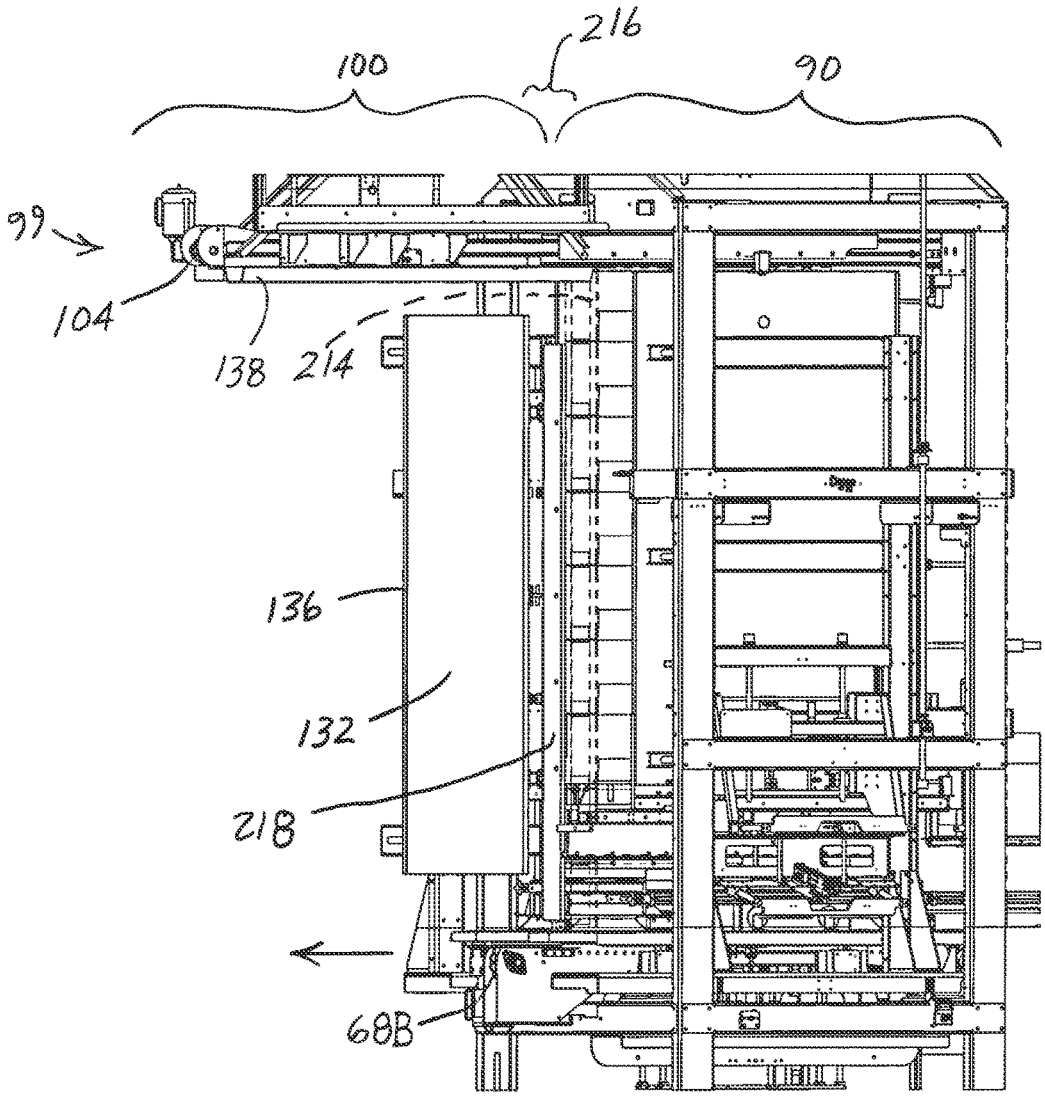
FIG. 69 is an elevation view showing an exemplary interface between the staging area and the stacking area according to the disclosure.

As shown in FIGS. 68-69, after, for example, an extended vertically stacked row 214 has been formed, which represents the desired number of rows, lifting device 98 is raised to contact bottom surface 39 of extended vertically stacked row 214 until top surface 37 of extended vertically stacked row 214 slides along opposed extended vertical guide sheets 101 until top surface 37 compressively abuts a compression member 99. As a result, gaps between rows of extended vertically stacked row 214 are removed, providing a more consolidated and stable extended vertically stacked row 214. Once extended vertically stacked row 214 has been vertically compressed, stop 218 of stacking area 90 is retracted, and depending upon the extent of a gap 216, if there is one, separating stacking area 90 from accumulator 100, extended vertically stacked row 214 is conveyed by conveyor 68B toward accumulator 100. As further shown in FIG. 69, gap 216 is minimal, and as a result, stabilizing support for extended vertically stacked row 214 is continuously provided between stacking area 90 and accumulator 100. In one embodiment, gap 216 is not minimal, but continuous stabilizing support is provided. In another embodiment, gap 216 is not minimal, and stabilizing support is not provided for at least a portion of travel along gap 216.

Figure 70:
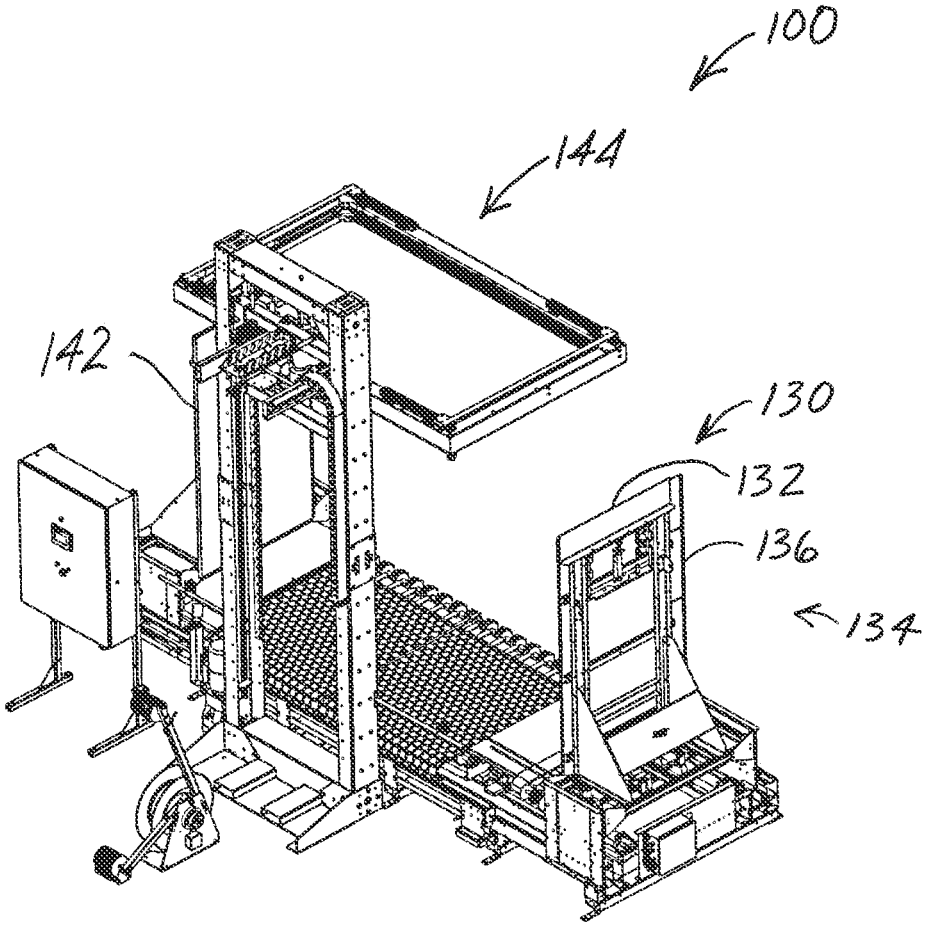
FIG. 70 is an upper perspective view of an exemplary accumulator according to the disclosure.

In one embodiment of FIG. 68, compression member 99 incorporates a conveyor 104 that is selectively synchronized with conveyor 68B (FIG. 69), as well as a vertical positioner (not shown in FIG. 68). In one embodiment, compression member 99 and conveyor 104 may be operated independently from one another. In one embodiment, upon construction of extended vertically stacked row 214, lifting device 98 is not actuated, but the compression member 99 is sufficiently lowered to compress extended vertically stacked row 214 between the compression member 99 and conveyor 68B. Once extended vertically stacked row 214 has been compressed, the conveyor 104 associated with compression member 99 and conveyor 68B are synchronized such that extended vertically stacked row 214 is conveyed from stacking area 90 toward accumulator 100 (FIGS. 69-70). By virtue of the opposed conveyors movably supporting extended vertically stacked row 214, additional stability is provided to extended vertically stacked row 214, as extended vertically stacked row 214 is continuously supported while being conveyed from stacking area 90 toward accumulator 100, with extended vertically stacked row 214 being reidentified as first extended vertically stacked row 42, as previously discussed.

FIGS. 69-71 show an exemplary accumulator 100 of the present disclosure. Accumulator 100 includes a support assembly 130 that supports a first lateral support member 132 having an initial position 134, a second lateral support member 136 that is of unitary construction or one-piece construction with first lateral support member 132, a third lateral support member 138, conveyor 104 of compression member 99, a fourth lateral support member 142 and a banding device 144. As indicated previously, FIGS. 72-78 schematically show the above-identified support members, conveyor 104 (of compression member 99) and banding device 144 of accumulator 100 for performing additional manipulations on box groupings previously formed, such as first extended vertically stacked row 42 and second extended vertically stacked row 56 that are shown in FIG. 12, as well as an additional not previously discussed third extended vertically stacked row 57 (FIG. 77), for purposes of clarity. During such manipulations of the box groupings in accumulator 100, the box groupings are continuously supported to prevent inadvertent tipping.

Figure 72:
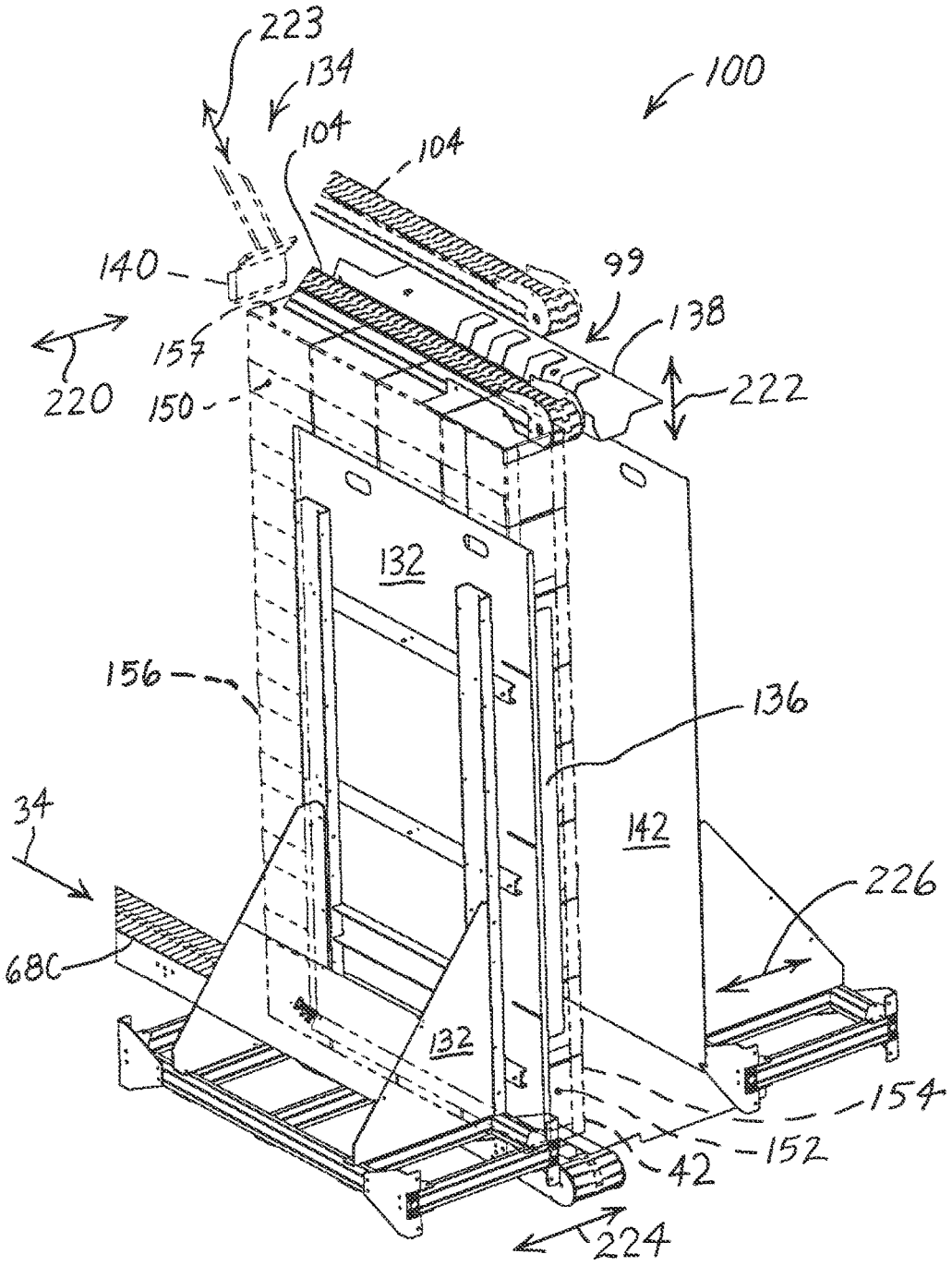
FIGS. 72, 72A, 73, 73A and 74-78 are sequential schematic views of the operation of an exemplary accumulator according to the disclosure.

As shown in FIG. 10 and FIG. 72, first extended vertically stacked row 42 includes a first side surface 150, a second side surface 152, a third side surface 154, an upper surface 157 that correspond to respective first lateral support member 132, second lateral support member 136, third lateral support member 138, conveyor 104 of compression member 99. During operation of accumulator 100, fourth lateral support member 142 provides support in a manner similar to the support provided by third lateral support member 138 to third side surface 154 of first extended vertically stacked row 42 in its initial position as received in accumulator 100.

Figure 72A:
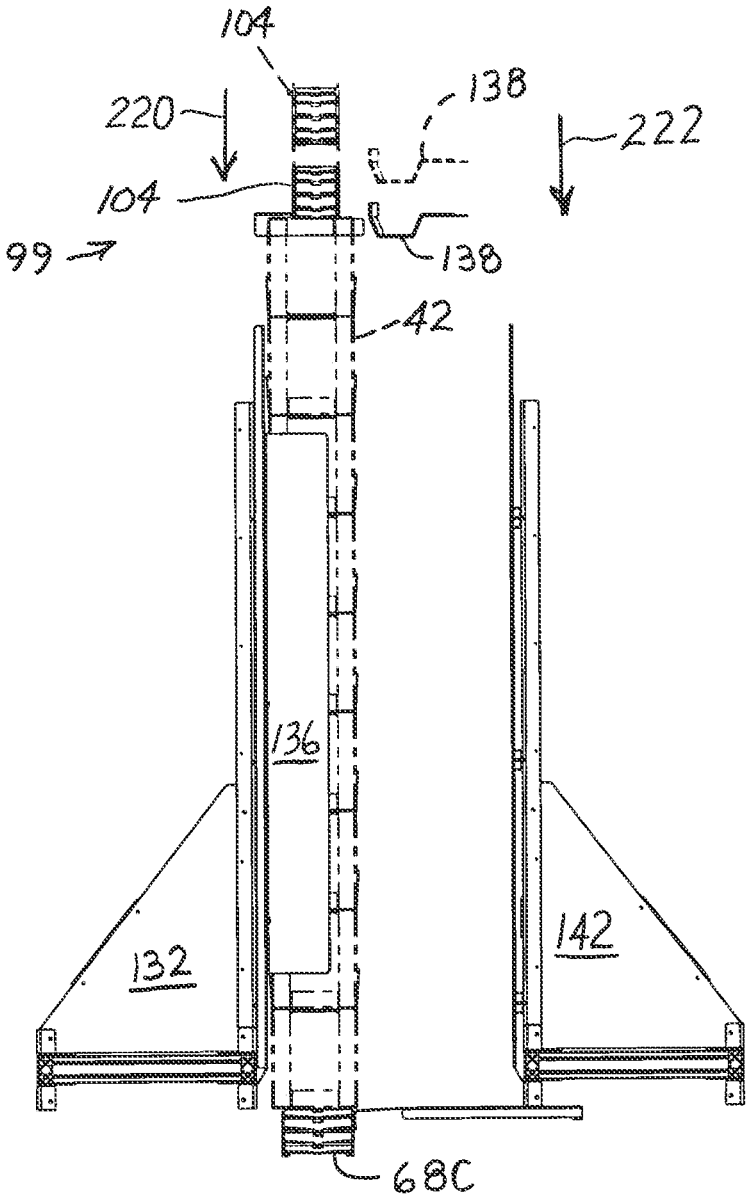

More specifically, in FIGS. 72 and 72A, in preparation of receiving first extended vertically stacked row 42 conveyed from stacking area 90 (FIG. 68) in conveyance direction 34 by conveyor 68B (FIG. 68), in accumulator 100, conveyor 104 is urged into movement direction 220 toward conveyor 68C to apply a compressive force to first extended vertically stacked row 42 and conveyor 104 is also urged to move synchronously with conveyor 68C. During receipt of first extended vertically stacked row 42 in an initial position (on conveyor 68C), conveyor 104 maintains the compressive force as a result of compressive contact with upper surface 157.

In an alternate embodiment, in combination with or in place of conveyor 104, an optional fifth lateral support member 140 (FIG. 72) is urged into movement direction 223 away from conveyor 68C (in preparation of receiving first extended row 42 conveyed in conveyance direction 34) and urged into movement direction 223 toward conveyor 68C (for providing support to fourth side surface 156 (FIG. 72).

Figure 73:
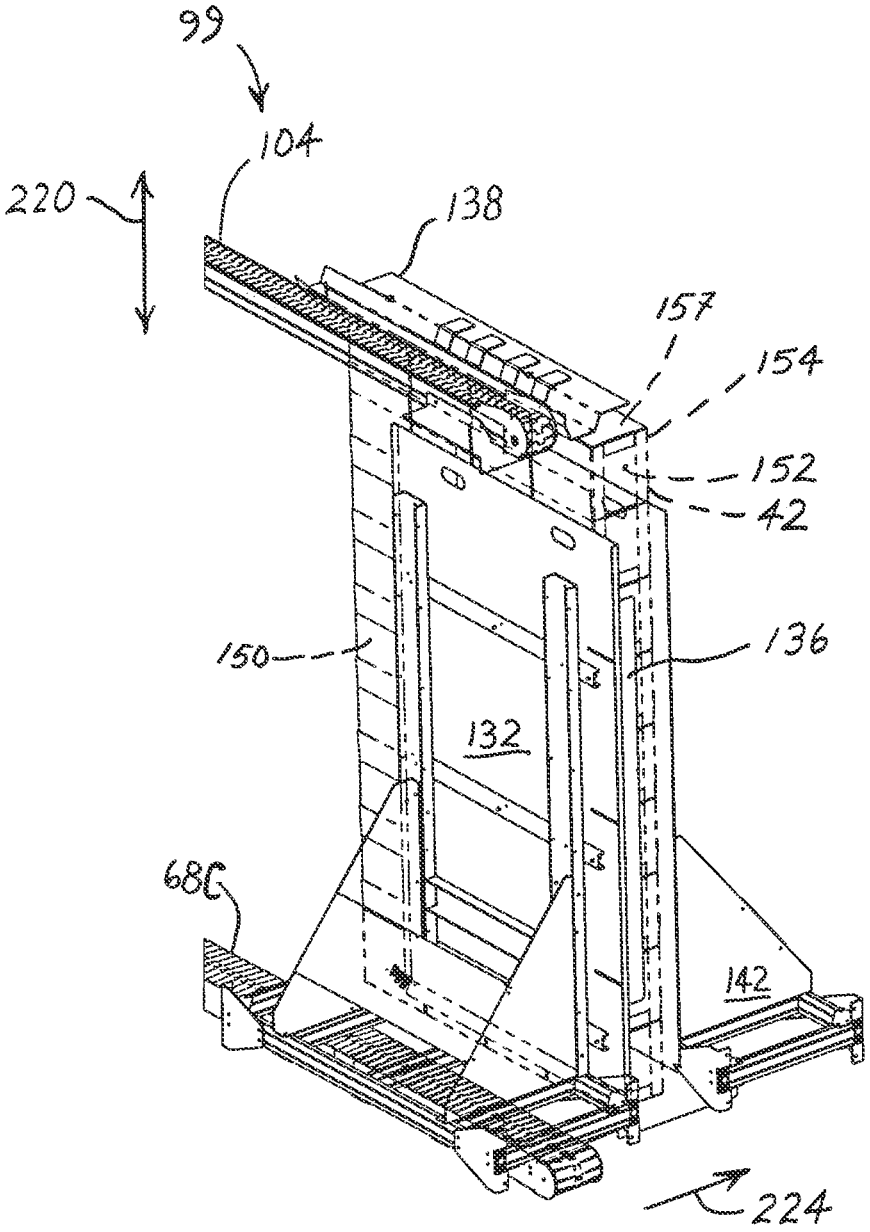
Figure 73A:
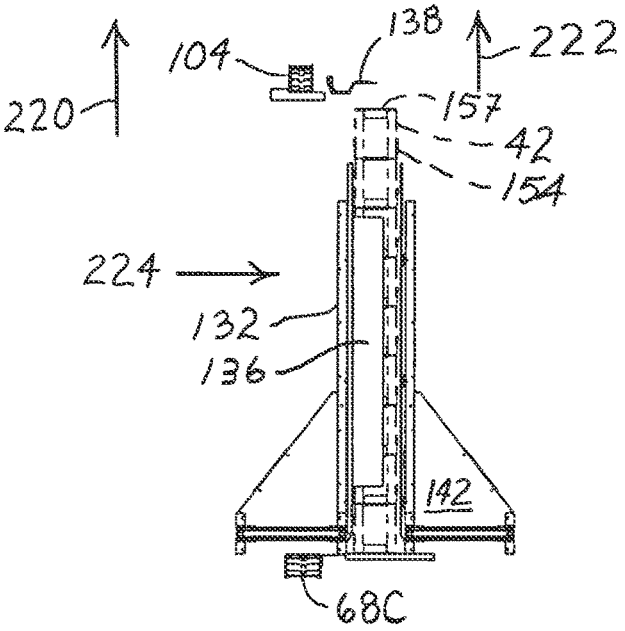

As shown in FIGS. 73 and 73A, in preparation of receiving a second extended vertically stacked row 56 (FIG. 11E), conveyor 104 is urged in movement direction 220 away from conveyor 68C. Third lateral support member 138 is urged in movement direction 222 away from conveyor 68C, and first lateral support member 132 (and second lateral support member 136) are urged in movement direction 224 that is transverse to conveyor 68C until third side surface 154 of first extended vertically stacked row 42 is brought into supporting contact with fifth lateral support member 142. By virtue of one or more of compressive contact between conveyors 68C, 104, resulting in increased stability of first extended vertically stacked row 42, and/or contact of the first extended vertically stacked row 42 with first lateral support member 132 substantially simultaneously or subsequent to movement of conveyor 104 out of contact with upper surface 157 of first extended vertically stacked row 42, first extended vertically stacked row 42 is continuously supported in accumulator 100 such that inadvertent tipping is prevented.

Figure 74:
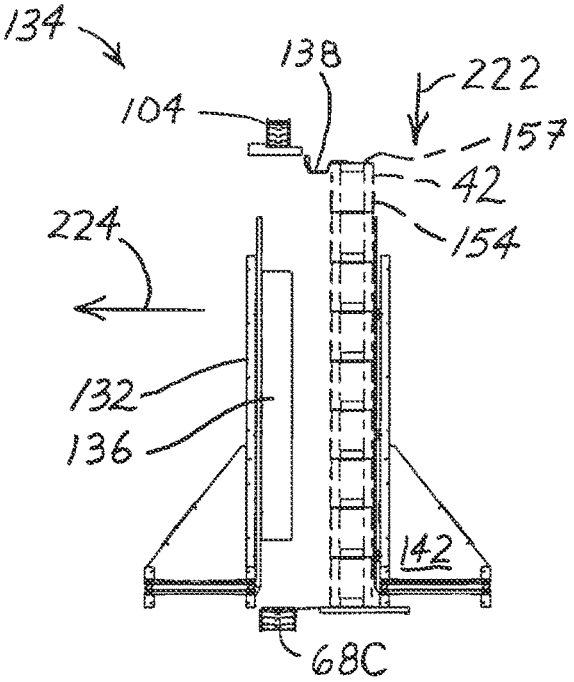

As shown in FIG. 74, after third side surface 154 of first extended vertically stacked row 42 is brought into supporting contact with fourth lateral support member 142, third lateral support member 138 is urged in movement direction 222 toward conveyor 68C, after which first lateral support member 132 (and second lateral support member 136) are urged in movement direction 224 that is transverse to conveyor 68C and toward conveyor 68C until reaching initial position 134.

Figure 75:
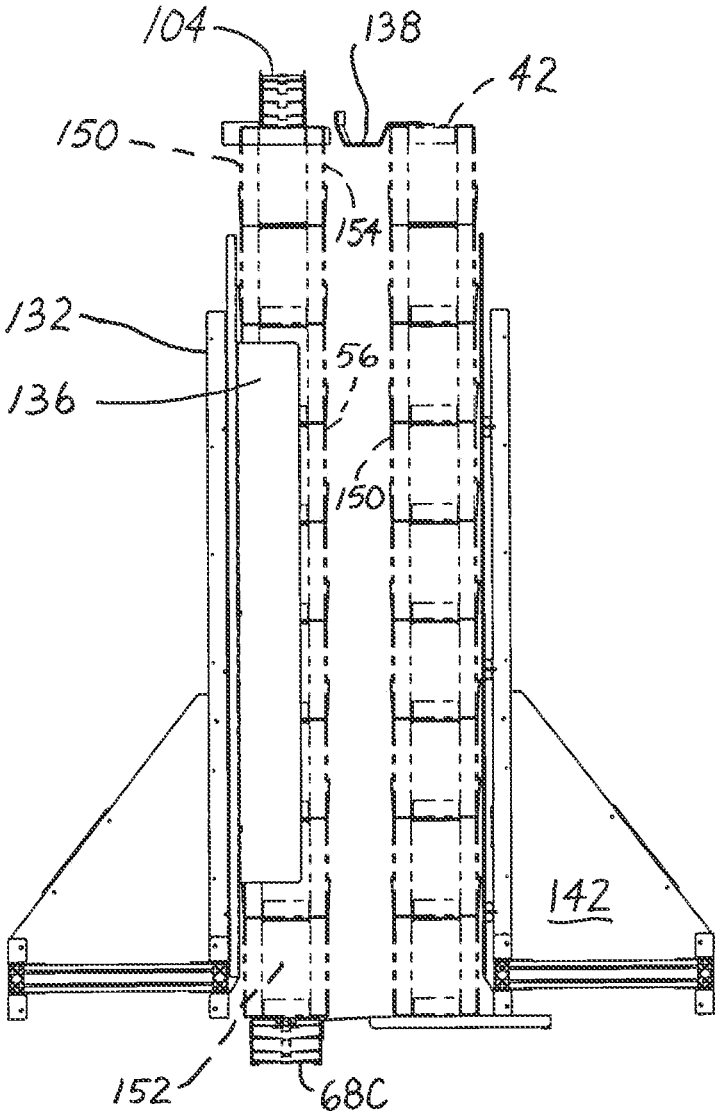

As shown in FIG. 75, second extended vertically stacked row 56 (FIG. 11E) is compressively received by accumulator 100 between conveyors 68C, 104 as previously discussed. Upon receipt of second extended vertically stacked row 56 in a similar fashion as shown in FIG. 72 for first extended vertically stacked row 42, surfaces 150, 152 of second extended vertically stacked row 56 are supported by respective lateral support members 132, 136. As further shown in FIG. 75, third lateral support member 138 provides lateral support for each of corresponding surfaces of the first extended vertically stacked row 42 (surface 150) and second extended vertically stacked row 56 (surface 154).

Figure 76:
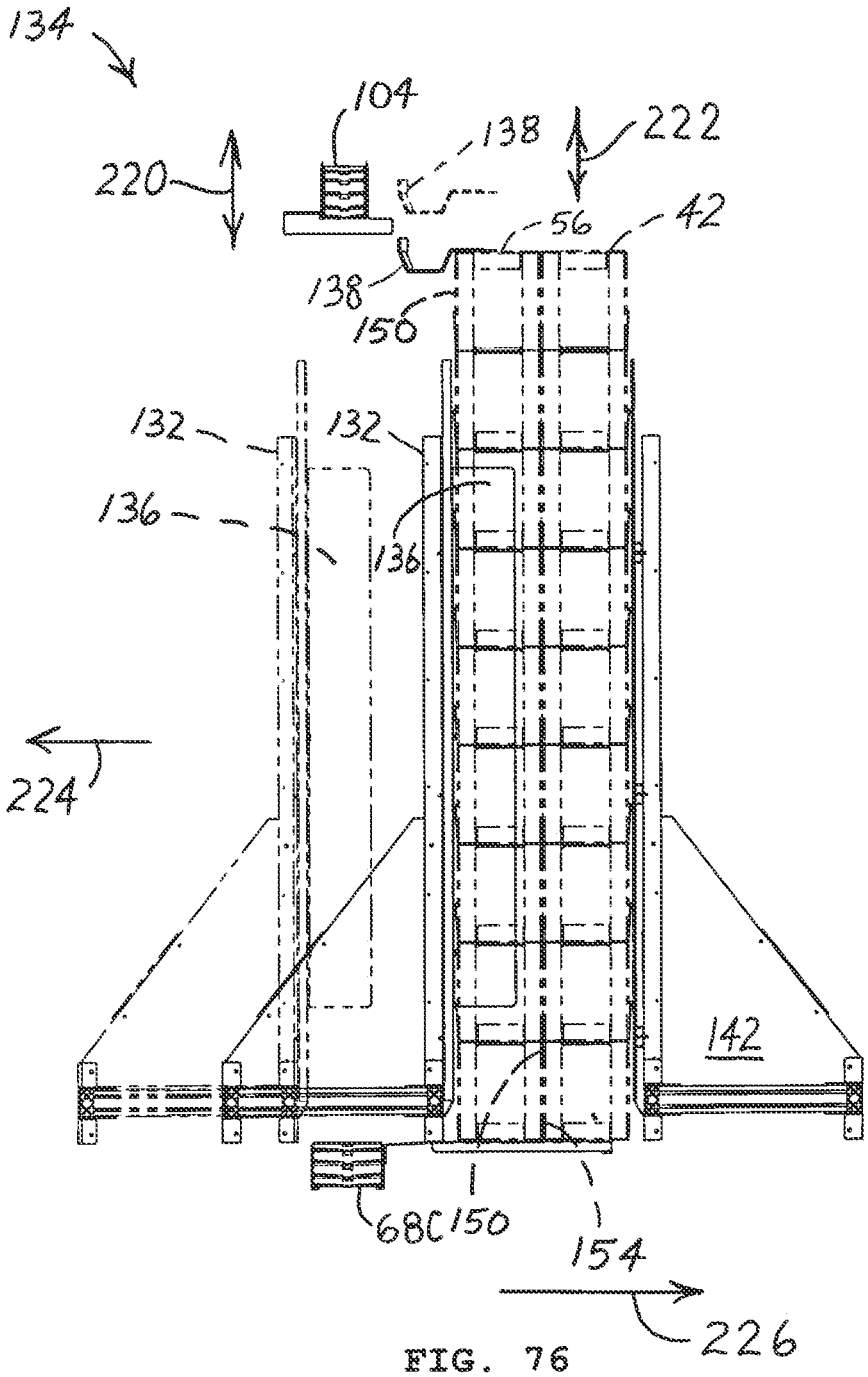

As shown in FIG. 76, conveyor 104 is urged in movement direction 220 away from conveyor 68C. Third lateral support member 138 is urged in movement direction 222 away from conveyor 68C, and first lateral support member 132 (and second lateral support member 136) are urged in movement direction 224 that is transverse to conveyor 68C, along with second extended vertically stacked row 56, until third side surface 154 of second extended vertically stacked row 56 is brought into supporting contact with first side surface 150 of first extended vertically stacked row 42. After such supporting contact is formed, third lateral support member 138 is urged into movement direction 222 toward conveyor 68C for providing lateral support to first surface 150 of first extended vertically stacked row 42, after which first lateral support member 132 (and second lateral support member 136) are urged in movement direction 224 that is transverse to conveyor 68C and toward conveyor 68C until reaching initial position 134.

Figure 77:
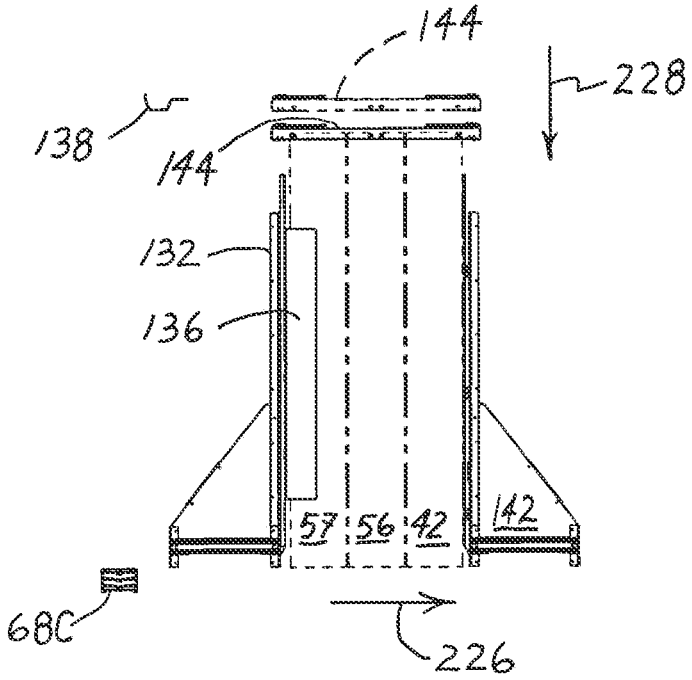
Figure 78:
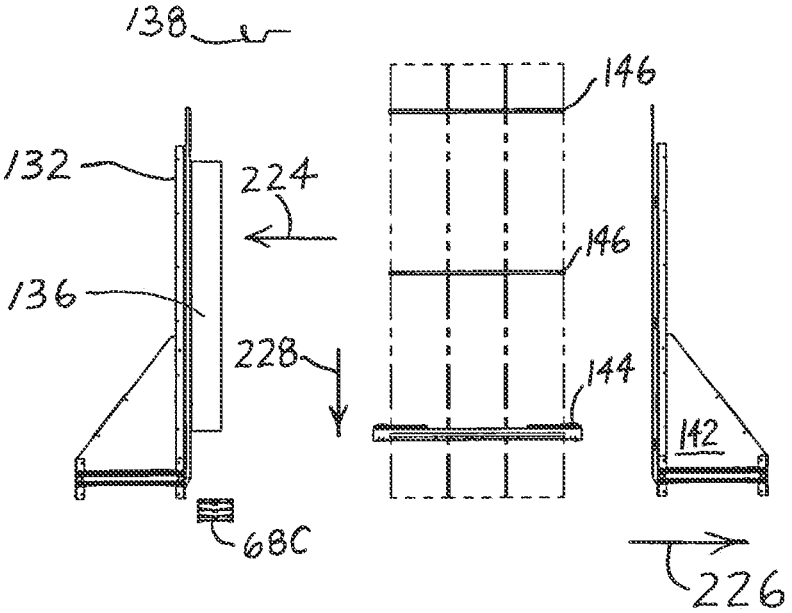

FIG. 77 shows, third extended vertically stacked row 57 subsequent to its addition in the accumulator in a manner similar as previously discussed, such as for second extended vertically stacked row 56 as shown in FIGS. 75-76, and is not repeated here. For purposes of example, the compilation of first, second and third extended vertically stacked rows 42, 56, 57 are selected as a shipping unit and prepared for banding. As further shown in FIG. 77, banding device 144 is positioned over the compilation of first, second and third extended vertically stacked rows 42, 56, 57 and urged in movement direction 228 toward conveyor 68C until reaching the desired vertical position preferably corresponding to the flaps surrounding opposed sides of the inverted top row, as previously discussed. As shown in FIG. 78, banding device 144 then secures a band 146 which compressively secures together the first, second and third extended vertically stacked rows 42, 56, 57, after which fourth lateral support member 142 is urged in movement direction 226 away from the compilation of stacked rows 42, 56, 57 and first lateral support member 132 (and second lateral support member 136) are urged in movement direction 224 that is transverse to conveyor 68C and toward conveyor 68C. Banding device 144 then secures a desired number of additional bands 146 to the shipping unit defined by the compilation of first, second and third extended vertically stacked rows 42, 56, 57 and is prepared for transport.

Figure 79:
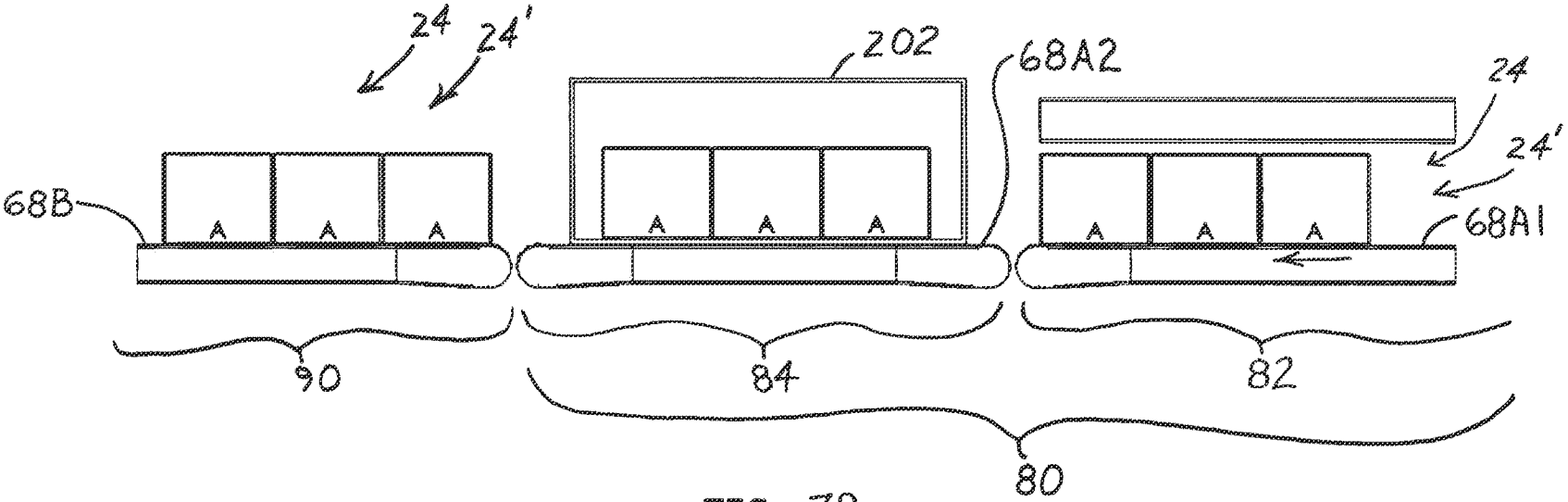
FIGS. 79, 80A and 80B are exemplary embodiments of a device associated with the staging area according to the disclosure.
Figure 80A:
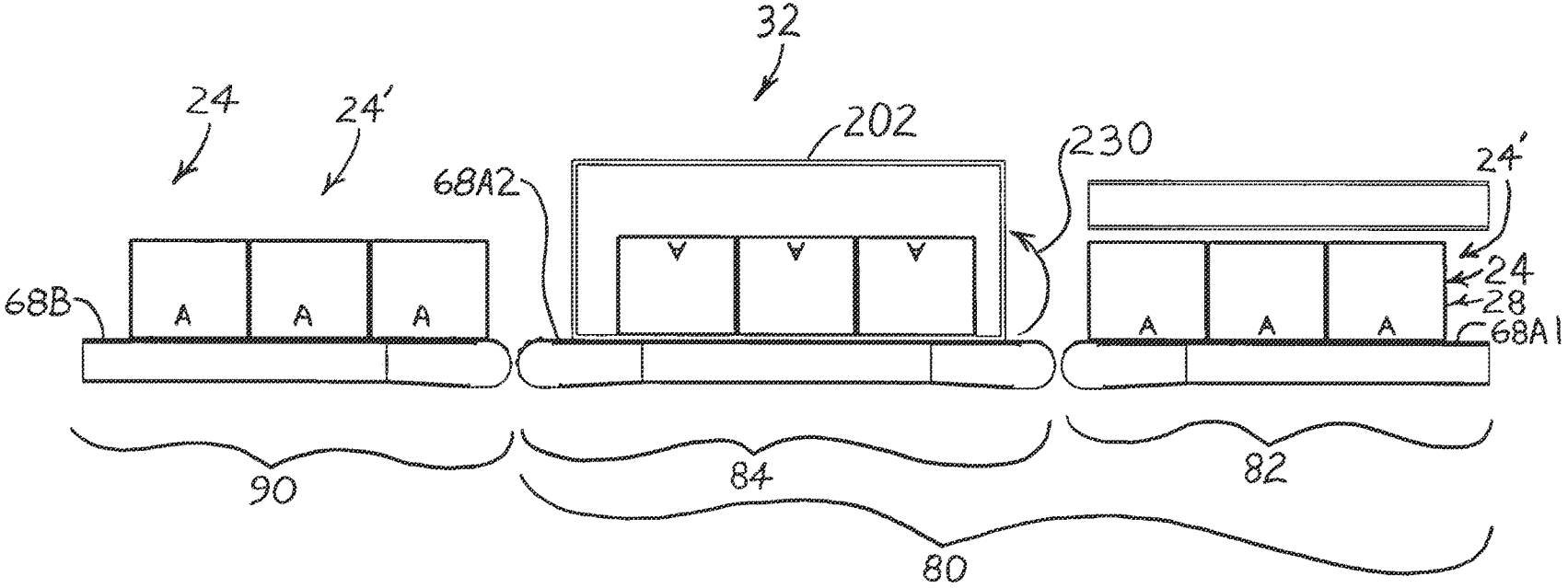
Figure 80B:
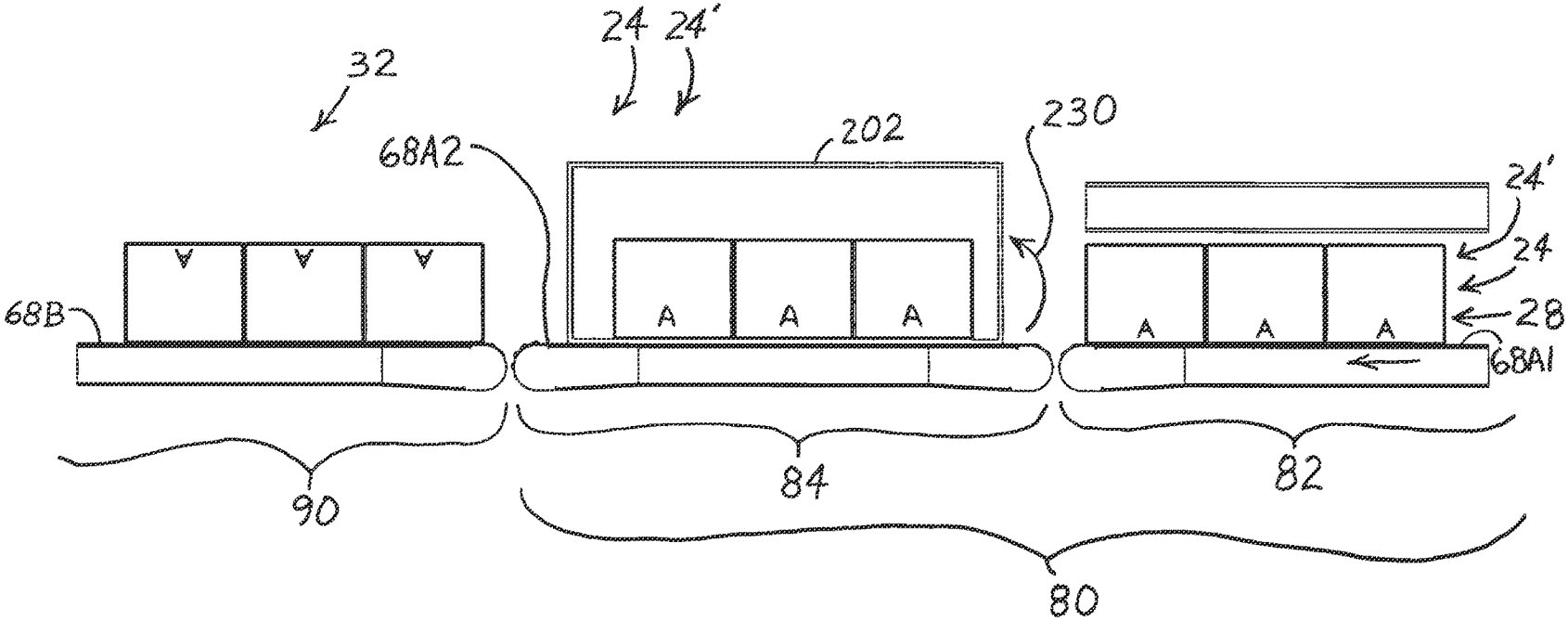

FIGS. 79, 80A and 80B show another embodiment of device 202 that can be used as part or the entirety of second portion 84 of staging area 80 to receive partially folded boxes 24 (from flap conditioner 70 operating in a first mode; see FIG. 28A) or partially folded boxes 24' (from flap conditioner 70 operating in a second mode; see FIG. 28B). As further shown in FIGS. 79, 80A and 80B, boxes 24, 24' are conveyed via conveyor 68A1 along first portion 82, then conveyed via conveyor 68A2 along second portion 84, and then conveyed via conveyor 68B along stacking area 90. Upon receipt of either of partially folded boxes 24 or 24', device 202 can selectively provide inverted boxes, such as inverted first fully folded boxes 32 to stacking area 90 or provide non-inverted boxes, such as partially folded boxes 24 or 24' to stacking area 90. FIGS. 80A and 80B are provided to show sequential operation or sequential movement of boxes along the conveyors using device 202. As shown in FIG. 80A, device 202 rotates boxes 24, 24' in second portion 84, forming inverted first fully folded boxes 32 in device 202. FIG. 80B shows inverted first fully folded boxes 32 that have been conveyed from second portion 84 to stacking area 90, and boxes 24, 24' that have been conveyed from first portion 82 to second portion 84, as well as boxes 24, 24' that have been conveyed from flap conditioner 70 (FIG. 28B). Device 202 can be a rotating chamber that can be urged in rotational movement 230 and that can receive one or more boxes. In exemplary embodiments, device 202 can have a conveyor incorporated therein or be removably coupled to a conveyor. In one embodiment, first portion 82 and second portion 84 can be substantially aligned, such as being axially aligned with stacking area 90.

It is to be understood that apparatus of the present disclosure can be constructed in a manner to control the distances or gaps between adjacent rows during manipulation in the stacking area such that components which could otherwise possibly protrude downward from inverted rows and extend through the closed flaps are secured.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An apparatus for forming a shipping unit comprising a plurality of boxes containing components, the shipping unit including a top row of inverted boxes, the apparatus comprising:

a flap conditioner for receiving partially closed boxes closed at a first end and open at a second end, the flap conditioner inwardly folding one pair of opposed flap pairs at the second end, forming partially folded boxes, the flap conditioner engaging and securing the remaining opposed flap pairs of the partially folded boxes in a predetermined open position;

a staging area comprising a first portion configured to receive partially folded boxes from the flap conditioner, and a second portion configured to receive a top row of inverted fully folded boxes, the staging area continuing to secure the remaining opposed flap pairs received from the flap conditioner in the predetermined open position;

a stacking area for receiving a first non-inverted row of partially folded boxes from the first portion of the staging area positioned beneath the top row of inverted fully folded boxes from the second portion of the staging area, the top row of inverted fully folded boxes positioned between extended opposed flaps at second ends of the first non-inverted row of partially folded boxes, the stacking area continuing to secure the remaining opposed flap pairs received from the flap conditioner in the predetermined open position;

the stacking area including movable flap conditioning devices which allow the top row of inverted fully folded boxes to be supported by the first non-inverted row of partially folded boxes and the top row of inverted fully folded boxes to be positioned between extended opposed flaps at second ends of the first non-inverted row of partially folded boxes, the top row of inverted fully folded boxes and the first non-inverted row of partially folded boxes together forming a first vertically stacked row;

wherein upon formation of the first vertically stacked row, a lifting device raises the first vertically stacked row prior to receiving a second non-inverted row of partially folded boxes from the first portion of the staging area, the second non-inverted row of partially folded boxes positioned beneath the first non-inverted row of partially folded boxes of the first vertically stacked row, wherein the flap conditioning devices of the stacking area allow the first non-inverted row of partially folded boxes of the first vertically stacked row to be positioned between extended opposed flaps at second ends of the second non-inverted row of partially folded boxes and the second non-inverted row of partially folded boxes to support the first vertically stacked row, the first vertically stacked row and the second non-inverted row of partially folded boxes together forming a first extended vertically stacked row; and an accumulator for receiving and positioning the first extended vertically stacked row, or the first extended vertically stacked row and subsequently formed extended vertically stacked rows together to form the shipping unit.

2. The apparatus of claim 1, comprising a device for removing partially folded boxes from the first portion of the staging area and providing inverted fully folded boxes to the second portion of the staging area.

3. The apparatus of claim 2, wherein the device includes a movable retention member for securing the remaining opposed flap pair at the second end of a partially folded box of the plurality of partially folded boxes in a closed position as a result of the device manipulating the partially folded box removed from the first portion of the staging area such that surfaces of the opposed flaps of the remaining opposed flap pair are brought into contact with other surfaces to inwardly fold the opposed flaps to the closed position, forming a fully folded box, the device inverting and placing the fully folded box on the second portion of the staging area.

4. The apparatus of claim 3, wherein the other surfaces that contact the surfaces of the opposed flaps to form the fully folded box are immobile relative to one another.

5. The apparatus of claim 3, wherein at least two of the other surfaces that contact the surfaces of the opposed flaps to form the fully folded box are movable relative to one another.

6. The apparatus of claim 1, wherein the stacking area further includes opposed guide/support members for supporting the top row of inverted fully folded boxes vertically above the first non-inverted row of partially folded boxes;

in response to sufficient movement of the opposed guide/support members away from each other, the first non-inverted row of partially folded boxes supports the top row of inverted fully folded boxes.

7. The apparatus of claim 6, wherein the flap conditioning devices include opposed flap folding mechanisms movable toward each other in response to the sufficient movement of the opposed guide/support members such that the remaining opposed flap pairs of the first non-inverted row of partially folded boxes are directed from the predetermined open position to positions in close proximity to sides of the top row of inverted fully folded boxes by the flap folding mechanisms; and opposed vertical guide sheets are laterally positioned over the remaining opposed flap pairs of the first non-inverted row of partially folded boxes simultaneously with or prior to movement of the opposed flap folding mechanisms away from each other.

8. The apparatus of claim 7, wherein the opposed vertical guide sheets move to maintain lateral positioning over the remaining opposed flap pairs of the first non-inverted row of partially folded boxes in response to the lifting device raising the first vertically stacked row.

9. The apparatus of claim 6, wherein in response to the lifting device raising the first vertically stacked row, the opposed guide/support members move inwardly to support the first vertical stacked row.

10. The apparatus of claim 1, wherein the stacking area includes a compression member;

wherein a top surface of the top row of inverted fully folded boxes and a bottom surface of the first non-inverted row of partially folded boxes are brought into compressive contact with the compression member and the lifting device, respectively, resulting in a more compact arrangement of the first vertically stacked row.

11. The apparatus of claim 1, wherein the accumulator comprises a support assembly for providing continued support for the shipping unit.

12. The apparatus of claim 11, wherein the support assembly comprises:

a first lateral support member having an initial position on one side of a conveyor for supporting at least a portion of a first side surface of the first extended vertically stacked row;

a second lateral support member positioned adjacent to the first lateral support member for supporting at least a portion of a second side surface of the first extended vertically stacked row;

a third lateral support member positioned along an opposite side of the conveyor relative to the first lateral support member and facing the first lateral support member for supporting at least an upper portion of a third side surface of the first extended vertically stacked row;

wherein once the first, second, and third side surfaces of the first extended vertically stacked row are supported by the first, second, and third lateral support members, respectively, simultaneously with or subsequent to sufficiently moving the third lateral support member away from the third side surface of the first extended vertically stacked row, the first lateral support member is directed to move the first extended vertically stacked row laterally over the conveyor until the third side surface is supported by a fourth lateral support member, the third lateral support member moving to a position for supporting the first side surface simultaneously with the first lateral support member returning to the initial position for supporting a subsequently formed extended vertically stacked row conveyed to the support assembly.

13. The apparatus of claim 12, wherein the accumulator includes a banding device positionable to secure a horizontal band surrounding a perimeter of the first extended vertically stacked row or of the first extended vertically stacked row and subsequently formed extended vertically stacked rows together to form the shipping unit, the horizontal band is surroundingly secured over a perimeter of extended opposed flaps at second ends of the first non-inverted row of partially folded boxes, the extended opposed flaps securing corresponding boxes of the top row of inverted fully folded boxes of the shipping unit.

14. The apparatus of claim 13, wherein subsequent to surroundingly securing the horizontal band over the perimeter of extended opposed flaps at second ends of the first non-inverted row of partially folded boxes, the first, second, third, and fourth lateral support members are movable away from the shipping unit, permitting the banding device to surroundingly secure at least one additional horizontal band along a different portion of the perimeter of the first extended vertically stacked row or of the first extended vertically stacked row and subsequently formed extended vertically stacked rows together.

15. The apparatus of claim 1, wherein prior to formation of the first vertically stacked row, the lifting device raises the first non-inverted row of partially folded boxes toward the top row of inverted fully folded boxes such that a gap therebetween is removed prior to the first non-inverted row of partially folded boxes supporting the top row of inverted fully folded boxes.

16. The apparatus of claim 12, wherein the support assembly includes a conveyor for applying compressive force to an upper surface of the first extended vertically stacked row.

* * * * *